US010271705B2

(12) United States Patent
Shigeto et al.

(10) Patent No.: US 10,271,705 B2
(45) Date of Patent: Apr. 30, 2019

(54) AUTONOMOUS TRAVEL-TYPE CLEANER

(71) Applicant: Panasonic Intellectual Property Management Co., Ltd., Osaka (JP)

(72) Inventors: Motonobu Shigeto, Shiga (JP); Kenji Watanabe, Shiga (JP); Hideharu Ogahara, Shiga (JP); Shinichi Matsumura, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 114 days.

(21) Appl. No.: 15/329,448

(22) PCT Filed: Oct. 6, 2015

(86) PCT No.: PCT/JP2015/005070
§ 371 (c)(1),
(2) Date: Jan. 26, 2017

(87) PCT Pub. No.: WO2016/056226
PCT Pub. Date: Apr. 14, 2016

(65) Prior Publication Data

US 2018/0206686 A1 Jul. 26, 2018

(30) Foreign Application Priority Data

Oct. 10, 2014 (JP) ..... 2014-208654
Mar. 13, 2015 (JP) ..... 2015-051342

(51) Int. Cl.
*A47L 9/28* (2006.01)
*A47L 9/04* (2006.01)

(52) U.S. Cl.
CPC ..... *A47L 9/2847* (2013.01); *A47L 9/0411* (2013.01); *A47L 2201/04* (2013.01); *A47L 2201/06* (2013.01)

(58) Field of Classification Search
CPC ..... A47L 2201/04; A47L 2201/06; A47L 9/0411; A47L 9/284; A47L 9/2847
See application file for complete search history.

(56) References Cited

U.S. PATENT DOCUMENTS 5,012,886 A * 5/1991 Jonas ..... A47L 9/0009 180/279
2006/0184293 A1* 8/2006 Konandreas ..... A47L 11/4072 701/23

(Continued)

FOREIGN PATENT DOCUMENTS

CA 2832981 11/2012
CN 101217907 A 7/2008

(Continued)

OTHER PUBLICATIONS

JP 2014188001 A—Oct. 2014—English Machine Translation.*

(Continued)

*Primary Examiner* — Marc Carlson
(74) *Attorney, Agent, or Firm* — Brinks Gilson & Lione

(57) ABSTRACT

Once it is determined in Step S2 that a corner has been detected, a control unit causes a body to perform a reciprocating motion and initiate corner cleaning in Step S3. Then, once it is determined in Step S4 that a rubbish detection sensor detects no rubbish, the corner cleaning is terminated in Step S6. Once it is determined in Step S4 that the rubbish detection sensor detects rubbish, the corner cleaning continues to be executed by the body being caused to perform the reciprocating motion in Step S5. In other words, an autonomous travel-type cleaner is realized that can remove a large amount of the rubbish accumulating at the corner by causing the body to perform the reciprocating motion.

7 Claims, 35 Drawing Sheets

(56) References Cited

U.S. PATENT DOCUMENTS

| | | | | |
|---|---|---|---|---|
| 2008/0276407 | A1 | 11/2008 | Schnittman et al. | |
| 2008/0300720 | A1 | 12/2008 | Kim et al. | |
| 2009/0126143 | A1 | 5/2009 | Haegermarck | |
| 2011/0239382 | A1 | 10/2011 | Lee et al. | |
| 2014/0013538 | A1 | 1/2014 | Dyson et al. | |
| 2014/0075689 | A1 | 3/2014 | Windorfer | |
| 2016/0051104 | A1 | 2/2016 | Shin et al. | |
| 2017/0100007 | A1 * | 4/2017 | Matsumoto | A47L 9/00 |
| 2017/0235309 | A1 * | 8/2017 | Nakanishi | A47L 9/28 15/319 |

FOREIGN PATENT DOCUMENTS

| | | | | | |
|---|---|---|---|---|---|
| CN | 104068787 | A | | 10/2014 | |
| DE | 102011011852 | A1 | * | 8/2012 | A47L 1/02 |
| DE | 202014003375 | U1 | | 7/2014 | |
| EP | 2979603 | A1 | * | 2/2016 | A47L 11/4072 |
| JP | 63-127310 | A | | 5/1988 | |
| JP | 2000-037333 | A | | 2/2000 | |
| JP | 2004267236 | A | * | 9/2004 | A47L 5/28 |
| JP | 2006-020831 | A | | 1/2006 | |
| JP | 2008-529752 | | | 8/2008 | |
| JP | 2008-284052 | A | | 11/2008 | |
| JP | 2008-296007 | | | 12/2008 | |
| JP | 2010-526594 | | | 8/2010 | |
| JP | 2011-212444 | | | 10/2011 | |
| JP | 2013-106820 | A | | 6/2013 | |
| JP | 2014-000150 | A | | 1/2014 | |
| JP | 2014-018562 | A | | 2/2014 | |
| JP | 2014-504534 | | | 2/2014 | |
| JP | 2014-061375 | | | 4/2014 | |
| JP | 2014-073192 | | | 4/2014 | |
| JP | 2014-094233 | | | 5/2014 | |
| JP | 2014-512247 | | | 5/2014 | |
| JP | 2014-111190 | A | | 6/2014 | |
| JP | 2014-147845 | A | | 8/2014 | |
| JP | 2014-188001 | | | 10/2014 | |
| JP | 2014-188001 | A | | 10/2014 | |
| JP | 2014188001 | A | * | 10/2014 | |
| JP | 2017080449 | A | * | 5/2017 | A47L 11/34 |
| WO | 2014/157974 | A1 | | 10/2014 | |

OTHER PUBLICATIONS

The Extended European Search Report dated Jan. 23, 2018 for the related European Patent Application No. 15848938.5.

International Search Report of PCT application No. PCT/JP2015/005070 dated Dec. 15, 2015.

English Translation of Chinese Search Report dated Nov. 2, 2018 for the related Chinese Patent Application No. 201580027641.9.

* cited by examiner

AUTONOMOUS TRAVEL-TYPE CLEANER

This application is a 371 application of PCT/JP2015/005070 having an international filing date of Oct. 6, 2015, which claims priority to JP2014-208654 filed Oct. 10, 2014 and JP2015-051342 filed Mar. 13, 2015. The enter contents of all of these applications are incorporated herein by reference.

TECHNICAL FIELD

The present invention relates to an autonomous travel-type cleaner.

BACKGROUND ART

Autonomous travel-type cleaners provided with a body on which various components are mounted, a driving unit moving the body, a main brush, and a suction unit are disclosed in the related art (refer to, for example, PTL 1 and PTL 2). The main brush is placed at a suction port formed in the body and collects rubbish present on a cleaning surface. The suction unit suctions the rubbish from the suction port in the body.

The autonomous travel-type cleaners disclosed in a number of patent documents such as PTL 1 and PTL 2 have substantially circular bodies. These shapes of the bodies give the autonomous travel-type cleaners a high level of turning performance.

The autonomous travel-type cleaners according to the related art that have the circular bodies cause a relatively wide gap to be formed between the suction port in the body and a tip part of a corner even if the autonomous travel-type cleaner approaches the corner in an object region to the maximum extent possible. Accordingly, in some cases, the rubbish that is present at the corner in the object region cannot be sufficiently suctioned by the suction unit.

Autonomous travel-type cleaners that further include one or more side brushes placed on a bottom surface of the body are disclosed so that the above-described problem can be addressed (refer to, for example, PTL 3 to PTL 6). The side brush is provided with a bristle bundle sticking out from the outline of the body. The bristle bundle collects the rubbish present outside the outline of the body in the suction port of the body. Accordingly, the autonomous travel-type cleaners disclosed in PTL 3 to PTL 6 can suction more of the rubbish present at the corner in the object region.

The ability of the autonomous travel-type cleaners disclosed in PTL 3 to PTL 6 to suction the rubbish present at the corner in the object region (hereinafter, simply referred to as a "corner cleaning ability" in some cases) is regarded as being determined mainly by the side brush. The length of the bristle bundle, in the meantime, is set under various constraints. Accordingly, the corner cleaning ability obtained based on the side brush is also affected by the constraint. In other words, the autonomous travel-type cleaners disclosed in PTL 3 to PTL 6 have room for improvement in terms of the corner cleaning ability.

An example of the autonomous travel-type cleaner with a further improved corner cleaning ability is also disclosed (refer to, for example, PTL 7).

The autonomous travel-type cleaner disclosed in PTL 7 is provided with a substantially D-shaped body, a suction port formed in a bottom surface of the body, and a pair of side brushes attached to corners of the bottom surface of the body.

At the position of the corner in the object region, this autonomous travel-type cleaner allows the axis of the side brush and the suction port of the body to approach a vertex of the corner to a greater extent than the autonomous travel-type cleaners disclosed in, for example, PTL 3 to PTL 6.

Accordingly, more of the rubbish becomes likely to be suctioned by the body. In a case where the autonomous travel-type cleaner disclosed in PTL 7 is positioned at the corner in the object region, however, a front surface and one side surface of the body come into contact with a wall that forms the corner or approach the wall to the point of being comparable to the contact. Accordingly, this autonomous travel-type cleaner cannot rotate in that place in some cases.

In other words, a relatively significant constraint is imposed on the operation trajectory of the autonomous travel-type cleaner disclosed in PTL 7 when the autonomous travel-type cleaner moves to another place from a cleaned corner in the object region after the cleaning of the corner is completed.

CITATION LIST

Patent Literature

PTL 1: Japanese Patent Unexamined Publication No. 2008-296007

PTL 2: PCT Japanese Translation Patent Publication No. 2014-504534

PTL 3: Japanese Patent Unexamined Publication No. 2011-212444

PTL 4: Japanese Patent Unexamined Publication No. 2014-073192

PTL 5: Japanese Patent Unexamined Publication No. 2014-094233

PTL 6: PCT Japanese Translation Patent Publication No. 2014-512247

PTL 7: Japanese Patent Unexamined Publication No. 2014-061375

SUMMARY OF THE INVENTION

The present invention provides an autonomous travel-type cleaner performing efficient cleaning until rubbish present at a corner in an object region is removed.

An autonomous travel-type cleaner according to an aspect of the present invention includes a body having a suction port in a bottom surface, a suction unit mounted on the body, a corner detection unit detecting a corner in an object region, a driving unit driving the body to perform a reciprocating motion, and a control unit controlling the driving unit. The control unit controls the driving unit for the reciprocating motion of the body once the corner is detected by the corner detection unit.

In this manner, the autonomous travel-type cleaner performing the efficient cleaning until the rubbish present at the corner in the object region is removed can be realized.

DETAILED DESCRIPTION OF THE PREFERRED EMBODIMENTS

Hereinafter, embodiments will be described with reference to accompanying drawings. The present invention is not limited to the embodiments.

Embodiment 1

A basic configuration of an autonomous travel-type cleaner according to Embodiment 1 will be described below with reference to FIGS. 1 and 2.

Figure 1:
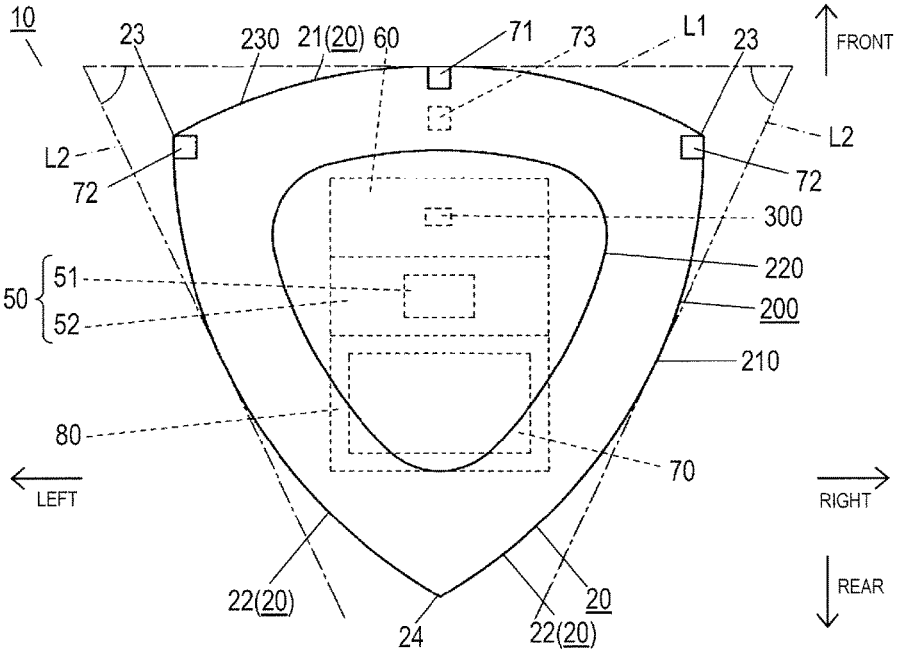
FIG. 1 is a front view of an autonomous travel-type cleaner according to Embodiment 1.

FIG. 1 is a front view of autonomous travel-type cleaner 10 according to Embodiment 1. FIG. 2 is a bottom view of the autonomous travel-type cleaner illustrated in FIG. 1.

Figure 2:
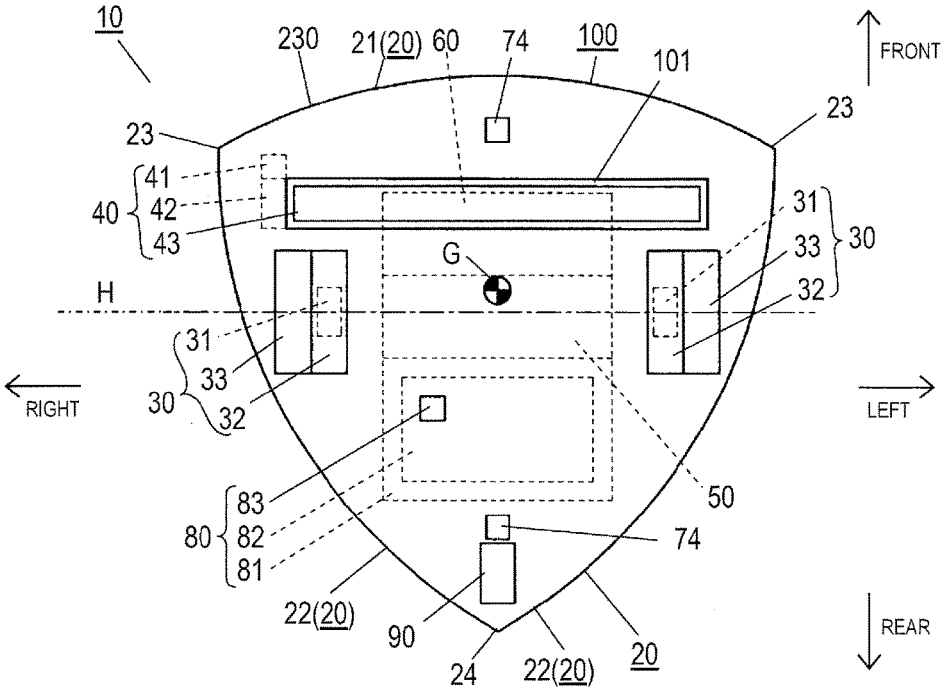
FIG. 2 is a bottom view of the autonomous travel-type cleaner illustrated in FIG. 1.

As illustrated in FIGS. 1 and 2, autonomous travel-type cleaner 10 according to this embodiment is a robot-type cleaner that autonomously travels on a cleaning surface in an object region and suctions rubbish present on the cleaning surface. A room is an example of the object region and a floor surface in the room is an example of the cleaning surface.

Autonomous travel-type cleaner 10 according to this embodiment is provided with functional blocks such as body 20 on which various components are mounted, a pair of driving units 30, cleaning unit 40, suction unit 50, rubbish bin unit 60, control unit 70, power supply unit 80, and caster 90. The pair of driving units 30 cause body 20 to move to be capable of reciprocating back and forth, to the left and right, and the like. Cleaning unit 40 collects the rubbish present in the object region. Suction unit 50 suctions the rubbish collected by cleaning unit 40 into body 20. Rubbish bin unit 60 accumulates the rubbish suctioned by suction unit 50. Control unit 70 controls driving unit 30, cleaning unit 40, suction unit 50, and the like. Power supply unit 80 supplies electric power to driving unit 30, cleaning unit 40, suction unit 50, and the like. Caster 90 rotates to follow rotation of driving unit 30.

Right driving unit 30 that is placed on a right side with respect to the width-direction center of body 20 and left driving unit 30 that is placed on a left side with respect to the width-direction center of body 20 constitute the pair of driving units 30. One of driving units 30 that is on the right side or the left side constitutes a first driving unit and the other one of driving units 30 that is on the left side or the right side constitutes a second driving unit. A horizontal direction, which is the width direction of autonomous travel-type cleaner 10, is defined on the basis of a forward direction of autonomous travel-type cleaner 10.

Lower unit 100 (refer to FIG. 2) that forms the external shape of a lower side of body 20 and upper unit 200 (refer to FIG. 1) that forms the external shape of an upper side of body 20 are combined with each other to constitute body 20.

As illustrated in FIG. 1, upper unit 200 is provided with cover 210, lid 220, bumper 230, and the like. Cover 210 forms a main outer part of upper unit 200. Lid 220 is disposed to be opened and closed with respect to cover 210. Bumper 230 is displaced with respect to cover 210 and mitigates an impact or the like.

Body 20 has, for example, the planar shape of a Reuleaux triangle, the planar shape of a polygon that has substantially the same shape as the Reuleaux triangle, or a shape in which R is formed in a top portion of the triangle or the polygon. This shape contributes to giving body 20 properties identical or similar to geometric properties of the Reuleaux triangle. As illustrated in FIG. 1, body 20 according to this embodiment has, for example, a planar shape that is substantially the same as the Reuleaux triangle.

Body 20 is also provided with a plurality of outer peripheral surfaces and a plurality of top portions. Front surface 21, right side surface 22, and left side surface 22 are examples of the plurality of outer peripheral surfaces. Front surface 21 is present on a forward side of autonomous travel-type cleaner 10. Right side surface 22 is present on a right rear side with respect to front surface 21. Left side surface 22 is present on a left rear side with respect to front surface 21. Front surface 21 is formed as a curved surface curved toward the outside and mainly by bumper 230. Each side surface 22 is formed in a side portion of bumper 230 and a side portion of cover 210 with the shape of a curved surface curved toward the outside.

Right front top portion 23, left front top portion 23, and rear top portion 24 are examples of the plurality of top portions. Right front top portion 23 is defined by front surface 21 and right side surface 22. Left front top portion 23 is defined by front surface 21 and left side surface 22. Rear top portion 24 is defined by right side surface 22 and left side surface 22.

As illustrated in FIG. 1, front surface 21 and side surface 22 are formed such that the angle formed by tangent L1 of front surface 21 and tangent L2 of side surface 22 is an acute angle.

In addition, right front top portion 23 and left front top portion 23 define the maximum width of body 20. According to the example that is illustrated in FIG. 1, the maximum width of body 20 is equivalent to the distance between a vertex of right front top portion 23 and a vertex of left front top portion 23, that is, the distance between two vertices of the Reuleaux triangle.

As illustrated in FIG. 2, body 20 is also provided with suction port 101 for suctioning the rubbish into body 20. Suction port 101 is formed in a bottom surface of lower unit 100, which is a bottom surface of body 20. Suction port 101 is formed in, for example, a rectangular shape. The longitudinal direction of suction port 101 is substantially the same as the width direction of body 20. The short direction of suction port 101 is substantially the same as the front-rear direction of body 20.

Suction port 101 is formed at a part of the bottom surface of body 20 that is close to front surface 21. A positional relationship of suction port 101 is defined by, for example, one or both of the following two types of relationships related to respective elements. The first relationship is the center line of suction port 101 along the longitudinal direction of suction port 101 (hereinafter, referred to as the "longitudinal-direction center line of suction port 101") being present on the front side of body 20 with respect to the center of body 20 in the front-rear direction. The second relationship is suction port 101 being formed on the front side of body 20 with respect to the pair of driving units 30.

The width of suction port 101, which is a longitudinal-direction dimension of suction port 101, exceeds the inside gap between right driving unit 30 and left driving unit 30. Accordingly, a greater width can be ensured for suction port 101. This contributes to an increase in the amount of the rubbish suctioned by suction unit 50.

As illustrated in FIG. 2, driving unit 30 is provided with a plurality of elements and placed on the bottom surface side of lower unit 100. For example, driving unit 30 is provided with wheel 33 traveling on the cleaning surface, traveling motor 31 giving torque to wheel 33, and housing 32 accommodating traveling motor 31. Wheel 33 is accommodated in a recessed portion formed in lower unit 100. Wheel 33 is supported by lower unit 100 to be capable of rotating with respect to lower unit 100.

Wheel 33 is placed on a width-direction outer side of body 20 with respect to traveling motor 31. This placement allows the gap between right wheel 33 and left wheel 33 to be wider than in a case where wheel 33 is placed on a width-direction inner side with respect to traveling motor 31. This contributes to stability improvement for body 20.

Driving of autonomous travel-type cleaner 10 is based on the two wheels facing each other. Therefore, right driving unit 30 and left driving unit 30 are placed to face each other in the width direction of body 20. In other words, axis of rotation H of right wheel 33 and axis of rotation H of left wheel 33 are present in a substantially coaxial manner as illustrated in FIG. 2.

At this time, the distance between axis of rotation H of the wheel and center of gravity G of autonomous travel-type cleaner 10 is set with an intention to give, for example, a predetermined turning performance to autonomous travel-type cleaner 10. The predetermined turning performance is a performance that allows a trajectory which is identical or similar to a quadrangular trajectory formed by the outline of the Reuleaux triangle to be formed by body 20. Specifically, for example, the position of axis of rotation H is set on the rear side of body 20 with respect to center of gravity G of autonomous travel-type cleaner 10 and a predetermined distance is set as the distance between axis of rotation H and center of gravity G. As a result of this setting, the quadrangular or similar trajectory can be formed by contact between body 20 and a surrounding object being used.

As illustrated in FIG. 2, cleaning unit 40 is provided with a plurality of elements and placed inside and outside body 20. For example, cleaning unit 40 is provided with brush driving motor 41, gearbox 42, and main brush 43. Brush driving motor 41 and gearbox 42 are placed inside body 20. Main brush 43 is placed at suction port 101 of body 20 with a length that is substantially equal to the longitudinal-direction dimension of suction port 101.

Brush driving motor 41 and gearbox 42 are attached to lower unit 100. Gearbox 42 is connected to an output shaft of brush driving motor 41 and main brush 43 and transmits torque of brush driving motor 41 to main brush 43.

Figure 14:
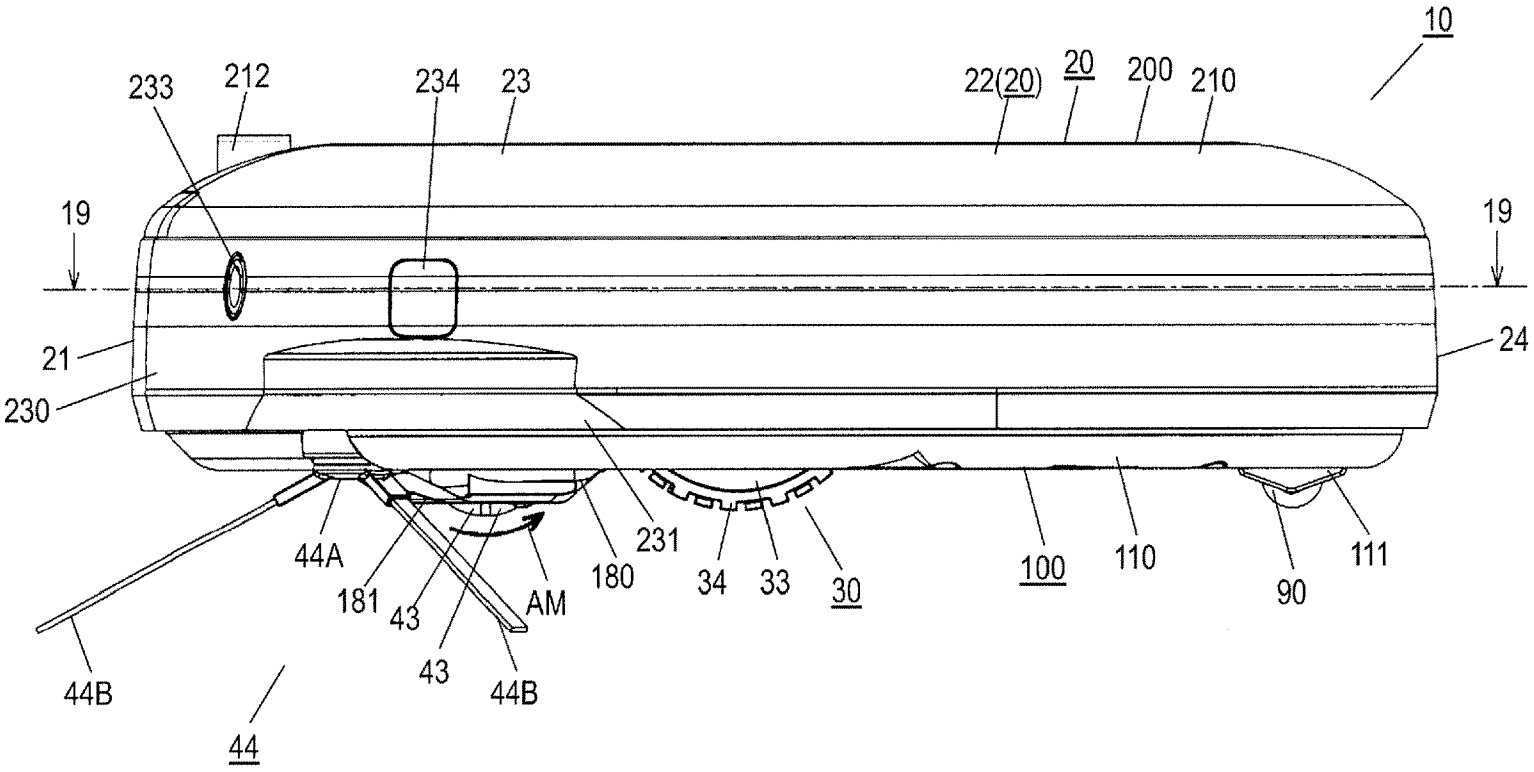
FIG. 14 is a side view of the autonomous travel-type cleaner illustrated in FIG. 10.

Main brush 43 is supported by a bearing portion (not illustrated) to be capable of rotating with respect to lower unit 100. The bearing portion is formed in, for example, one or both of gearbox 42 and lower unit 100. As shown by the arrow AM that is illustrated in FIG. 14, for example, main brush 43 has a direction of rotation set such that its orbit of rotation is toward the rear from the front of body 20 on the cleaning surface side.

As illustrated in FIG. 1, suction unit 50 is provided with a plurality of elements and placed in body 20. Suction unit 50 is placed on, for example, the rear side of rubbish bin unit 60 and on the front side of power supply unit 80 (described later).

For example, suction unit 50 is provided with fan case 52 attached to lower unit 100 (refer to FIG. 2) and electric fan 51 placed in fan case 52. Electric fan 51 suctions air in rubbish bin unit 60 and discharges the air to the outside in the circumferential direction of electric fan 51. The air discharged from electric fan 51 passes through the space in fan case 52 and the space surrounding fan case 52 in body 20 and is exhausted to the outside from body 20.

As illustrated in FIG. 2, rubbish bin unit 60 is placed between the pair of driving units 30, on the rear side of main brush 43, and on the front side of suction unit 50 in body 20. Body 20 and rubbish bin unit 60 are provided with a removable structure that allows a user to select at will a state where rubbish bin unit 60 is attached to body 20 or a state where rubbish bin unit 60 is detached from body 20.

As illustrated in FIG. 1, control unit 70 is placed on the rear side of suction unit 50 in body 20.

As illustrated in FIGS. 1 and 2, autonomous travel-type cleaner 10 according to this embodiment is also provided with a plurality of sensors. The plurality of sensors include, for example, obstacle detection sensor 71, a pair of distance measurement sensors 72, collision detection sensor 73, and a plurality of floor surface detection sensors 74. Obstacle detection sensor 71 detects an obstacle present in front of body 20. The pair of distance measurement sensors 72 detects the distance between the object present around body 20 and body 20. Collision detection sensor 73 detects a collision between body 20 and the surrounding object. Floor surface detection sensor 74 detects the cleaning surface present on the bottom surface of body 20. Detection signals of obstacle detection sensor 71, distance measurement sensor 72, collision detection sensor 73, and floor surface detection sensor 74 are input to control unit 70. Autonomous travel-type cleaner 10 is controlled based on the detection signals.

An ultrasonic sensor or the like constitutes obstacle detection sensor 71 provided with a transmitting unit and a receiving unit. Infrared sensors or the like constitute distance measurement sensor 72 and floor surface detection sensor 74 provided with light emitting units and light receiving units. A contact-type displacement sensor or the like constitutes collision detection sensor 73. A switch that is turned ON by bumper 230 coming into contact with the object and being pressed against cover 210 also constitutes collision detection sensor 73.

As illustrated in FIG. 1, right distance measurement sensor 72 and left distance measurement sensor 72 constitute the pair of distance measurement sensors 72. Right distance measurement sensor 72 is placed on the right side with respect to the width-direction center of body 20. Left distance measurement sensor 72 is placed on the left side with respect to the width-direction center of body 20. Right distance measurement sensor 72 is placed in the vicinity of right front top portion 23 and outputs light (such as an infrared ray) obliquely forward and to the right from body 20. Left distance measurement sensor 72 is placed in the vicinity of left front top portion 23 and outputs light (such as an infrared ray) obliquely forward and to the left from body 20. Because of this placement, the distance between the surrounding object that is the closest to the outline of body 20 and body 20 can be detected regardless of whether autonomous travel-type cleaner 10 turns to the left or turns to the right.

As illustrated in FIG. 2, for example, front-side floor surface detection sensor 74 that is placed on the front side of body 20 with respect to driving unit 30 and rear-side floor surface detection sensor 74 that is placed on the rear side of body 20 with respect to driving unit 30 constitute the plurality of floor surface detection sensors 74.

Autonomous travel-type cleaner 10 according to this embodiment is also provided with power supply unit 80. Power supply unit 80 supplies electric power to obstacle detection sensor 71, distance measurement sensor 72, collision detection sensor 73, floor surface detection sensor 74, and the like as well as driving unit 30, cleaning unit 40, and suction unit 50 as described above. Power supply unit 80 is placed on the rear side of body 20 with respect to suction unit 50 on the rear side of body 20 with respect to the center of body 20 in the front-rear direction. Power supply unit 80 is provided with, for example, battery case 81, storage battery 82, and main switch 83. Battery case 81 is attached to lower unit 100. A secondary battery or the like constitutes storage battery 82 accommodated in battery case 81. Main switch 83 switches between electric power supply from power supply unit 80 to each element and stop of the electric power supply from power supply unit 80 to each element.

Autonomous travel-type cleaner 10 according to this embodiment has the configuration described above.

Hereinafter, a configuration of an electrical system of autonomous travel-type cleaner 10 according to this embodiment will be described with reference to FIG. 3.

Figure 3:
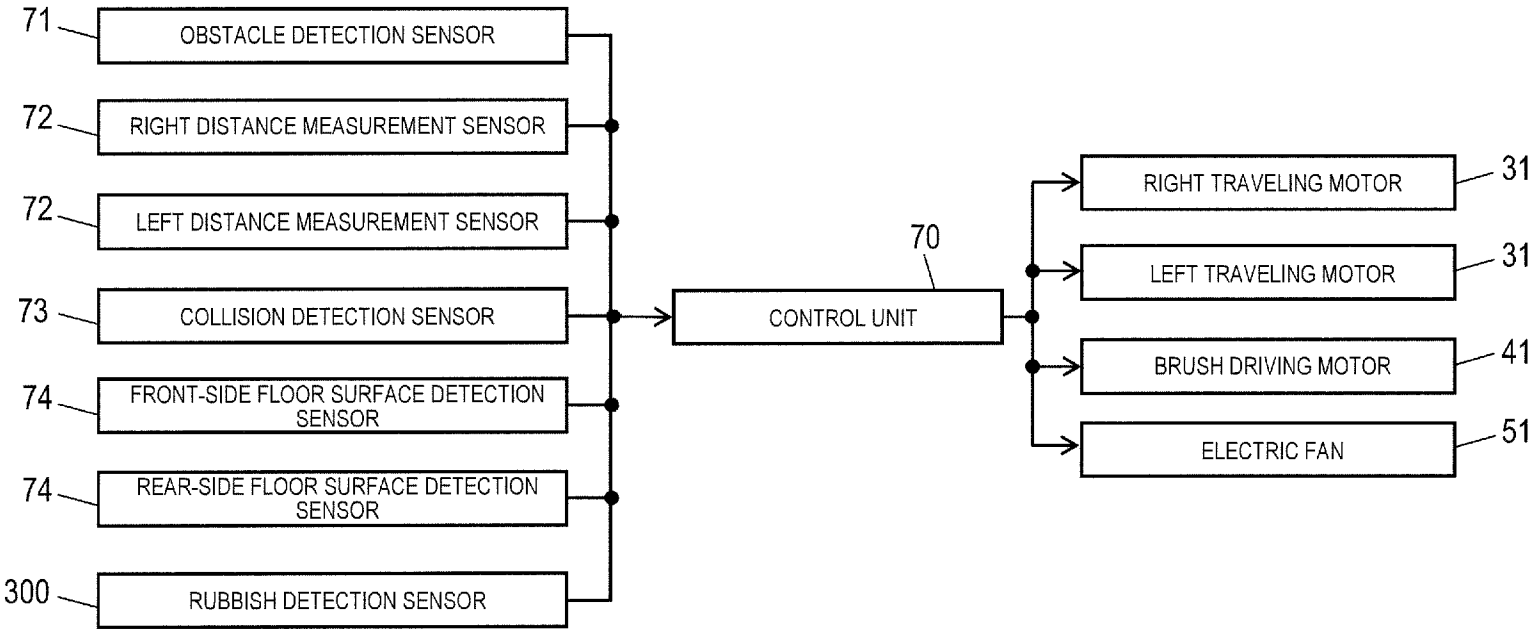
FIG. 3 is a functional block diagram illustrating a configuration of an electrical system in the autonomous travel-type cleaner illustrated in FIG. 1.

FIG. 3 is a functional block diagram illustrating the configuration of the electrical system in the autonomous travel-type cleaner illustrated in FIG. 1.

Control unit 70 is placed on power supply unit 80 in body 20 as illustrated in FIG. 1 and is electrically connected to power supply unit 80. In addition, control unit 70 is electrically connected to above-described obstacle detection sensor 71, distance measurement sensor 72, collision detection sensor 73, floor surface detection sensor 74, rubbish detection sensor 300, the pair of traveling motors 31, brush driving motor 41, electric fan 51, and the like.

A semiconductor integrated circuit such as a central processing unit (CPU) constitutes control unit 70 controlling each circuit. Control unit 70 also has a storage unit (not illustrated) storing various programs executed by control unit 70, a parameter, and the like. A nonvolatile semiconductor memory device such as a flash memory constitutes the storage unit.

Specifically, control unit 70 determines whether or not an object hampering the traveling of autonomous travel-type cleaner 10 is present within a predetermined range in front of body 20 based on the detection signal input from obstacle detection sensor 71. Control unit 70 calculates the distance between the object that is present around front top portion 23 of body 20 and the outline of body 20 based on the detection signal input from distance measurement sensor 72.

In addition, control unit 70 determines whether or not body 20 has collided with the surrounding object based on the detection signal input from collision detection sensor 73. Control unit 70 determines whether or not the cleaning surface in the object region is present below body 20 based on the detection signal input from floor surface detection sensor 74.

Then, control unit 70 controls the pair of traveling motors 31, brush driving motor 41, and electric fan 51 by using at least one of the determination and calculation results described above. In this manner, control unit 70 controls an operation of autonomous travel-type cleaner 10 or the like for the cleaning surface in the object region to be cleaned.

As illustrated in FIG. 1, autonomous travel-type cleaner 10 is also provided with rubbish detection sensor 300 that is electrically connected to control unit 70. Rubbish detection sensor 300 detects at least one of the rubbish suctioned from suction port 101 illustrated in FIG. 2 and house dust. Rubbish detection sensor 300 is placed on a passage that leads to, for example, rubbish bin unit 60 from suction port 101 and detects the amount of the rubbish passing through the passage or the like. Electric power is supplied to rubbish detection sensor 300 from power supply unit 80.

An infrared sensor that has a light emitting element and a light receiving element or the like constitutes rubbish detection sensor 300. In rubbish detection sensor 300, the light receiving element detects information related to the amount of light emitted from the light emitting element. Then, rubbish detection sensor 300 outputs a detection signal related to the detected information to control unit 70. Control unit 70 determines the amount of the rubbish based on the detection signal input from rubbish detection sensor 300. Specifically, control unit 70 determines that the amount of the rubbish is large in a case where the amount of the light is small and determines that the amount of the rubbish is small in a case where the amount of the light is large. The detection signal is a signal output from, for example, an operational amplifier that is an amplification element connected to the light receiving element.

The electrical system of autonomous travel-type cleaner 10 according to this embodiment has the configuration described above.

Figure 4:
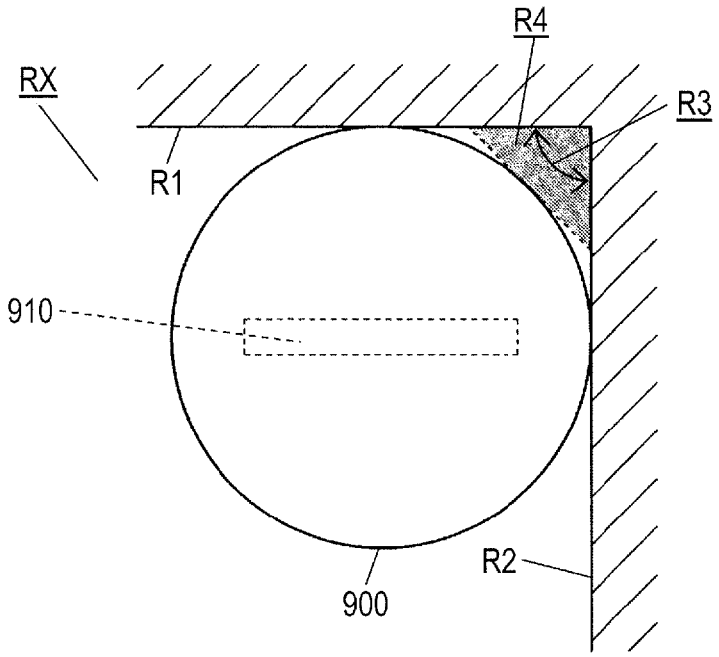
FIG. 4 is an operational diagram illustrating a state where an autonomous travel-type cleaner according to the related art has reached a corner.

Hereinafter, the operation of autonomous travel-type cleaner 10 according to this embodiment will be described with reference to FIGS. 5 to 7 and in comparison to an operation of autonomous travel-type cleaner 900 according to the related art that is illustrated in FIG. 4.

FIG. 4 is an operational diagram illustrating a state where the autonomous travel-type cleaner according to the related art has reached a corner. FIG. 5 is an operational diagram illustrating a state where the autonomous travel-type cleaner illustrated in FIG. 1 approaches the corner. FIG. 6 is an operational diagram illustrating a state where the autonomous travel-type cleaner illustrated in FIG. 5 has reached the corner. FIG. 7 is an operational diagram illustrating a state where the autonomous travel-type cleaner illustrated in FIG. 6 has rotated.

As illustrated in FIGS. 4 to 7, room RX as the object region is provided with corner R3 that is formed by, for example, first wall R1 and second wall R2. Herein, a case where corner R3 has a substantially right angle (including a right angle) will be described as an example.

Autonomous travel-type cleaner 900 according to the related art cannot cover tip part R4 of corner R3, due to its external shape, when autonomous travel-type cleaner 900 according to the related art has reached corner R3 as illustrated in FIG. 4. Therefore, a relatively large gap is formed between suction port 910 of autonomous travel-type cleaner 900 and tip part R4.

At this time, autonomous travel-type cleaner 900 according to the related art still can collect the rubbish present at tip part R4 in suction port 910 with a side brush mounted on autonomous travel-type cleaner 900 according to the related art. However, autonomous travel-type cleaner 900 according to the related art suctions the rubbish with suction port 910 at a position separated from tip part R4 regardless of the presence or absence of the side brush.

In this embodiment, corner R3 of room RX is cleaned by control unit 70 causing autonomous travel-type cleaner 10 to travel in, for example, the following manner.

Figure 5:
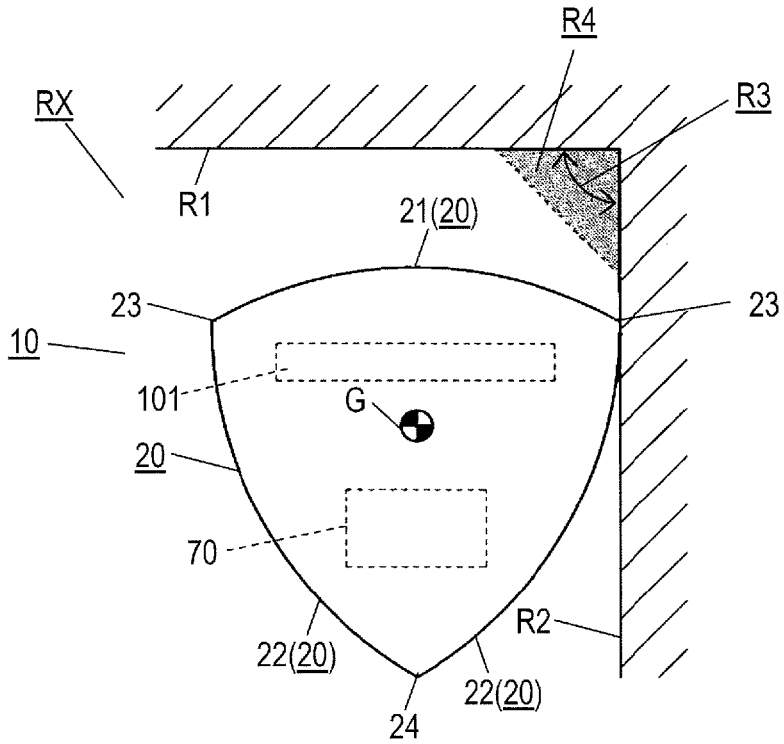
FIG. 5 is an operational diagram illustrating a state where the autonomous travel-type cleaner illustrated in FIG. 1 approaches the corner.

As illustrated in FIG. 5, control unit 70 first causes a posture to be assumed in which front surface 21 of body 20 directly faces, for example, first wall R1 of room RX as the object region. Then, control unit 70 causes autonomous travel-type cleaner 10 to move forward along second wall R2 and toward first wall R1. At this time, autonomous travel-type cleaner 10 travels while maintaining a state where one of front top portions 23 (right front top portion 23) is in contact with second wall R2 or a state where one of front top portions 23 (right front top portion 23) has approached second wall R2 to the same extent.

Figure 6:
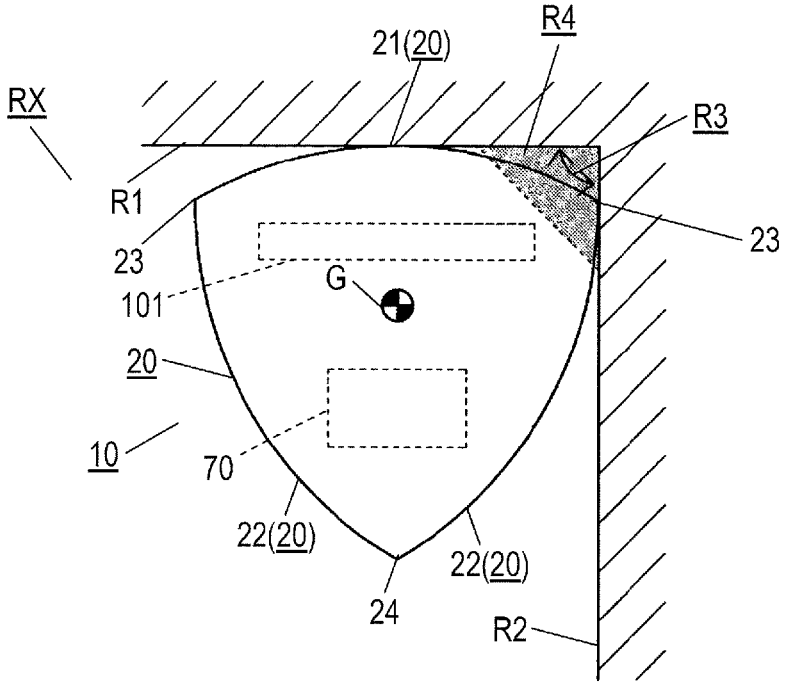
FIG. 6 is an operational diagram illustrating a state where the autonomous travel-type cleaner illustrated in FIG. 5 has reached the corner.

Then, once front surface 21 of body 20 has come into contact with first wall R1 as illustrated in FIG. 6 or once front surface 21 of body 20 has approached first wall R1 to the same extent, control unit 70 temporarily stops the operation of autonomous travel-type cleaner 10. At this time, a part of right front top portion 23 of body 20 covers a part of tip part R4 of corner R3. In other words, autonomous travel-type cleaner 10 according to this embodiment allows suction port 101 of body 20 to approach tip part R4 of corner R3 to a greater extent than in a case where autonomous travel-type cleaner 900 according to the related art that is illustrated in FIG. 4 has approached corner R3 to the maximum extent possible.

Then, control unit 70 causes autonomous travel-type cleaner 10 to repeatedly execute a turning operation for front surface 21 of body 20 to come into contact with first wall R1 and a turning operation for right side surface 22 to come into contact with second wall R2. At this time, autonomous travel-type cleaner 10 is subjected to a reaction force that acts on body 20 as a result of the contact between front surface 21 and first wall R1 and a reaction force that acts on body 20 as a result of the contact between right side surface 22 and second wall R2. Accordingly, autonomous travel-type cleaner 10 turns to the left with center of gravity G changing its position. This turning operation is a simulation of part of an operation at a time when the Reuleaux triangle forms the quadrangular trajectory.

Figure 7:
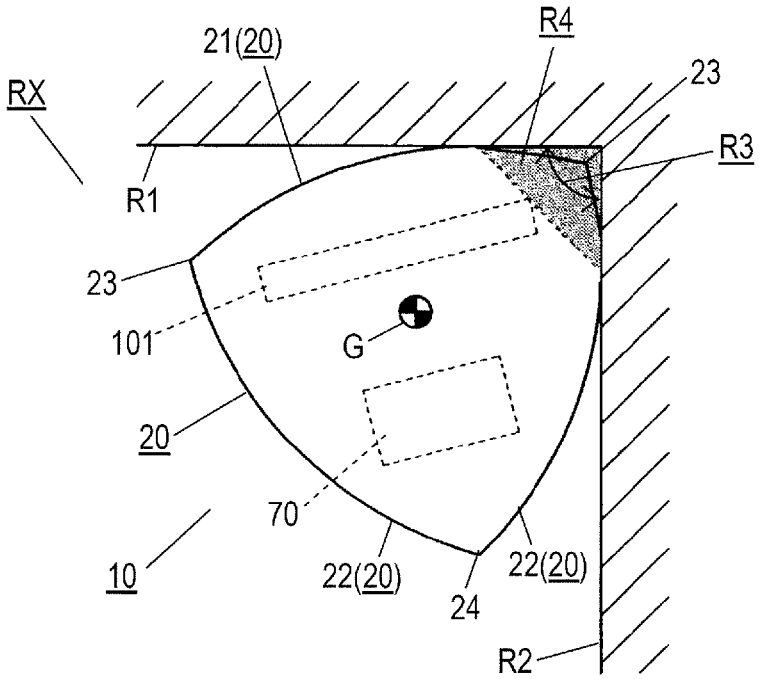
FIG. 7 is an operational diagram illustrating a state where the autonomous travel-type cleaner illustrated in FIG. 6 has rotated.

After turning over a certain angle from the state where front surface 21 of autonomous travel-type cleaner 10 directly faces first wall R1, right front top portion 23 is directed toward a vertex of corner R3 or the vicinity of the vertex as illustrated in FIG. 7. Accordingly, a state is achieved where right front top portion 23 has approached the vertex of corner R3 to the maximum extent possible. At this time, body 20 covers a relatively wide range of tip part R4 of corner R3. In addition, the distance between suction port 101 of body 20 and tip part R4 of corner R3 is shorter than the distance between suction port 910 and tip part R4 of corner R3 in the case where autonomous travel-type cleaner 900 according to the related art that is illustrated in FIG. 4 has approached corner R3 to the maximum extent possible. This placement of suction port 101 contributes to autonomous travel-type cleaner 10 outdoing autonomous travel-type cleaner 900 according to the related art in terms of corner cleaning ability.

What has been described in relation to the corner cleaning ability of autonomous travel-type cleaner 10 can also be described as follows.

In autonomous travel-type cleaner 10 according to this embodiment, the angle that is formed by tangent L1 of front surface 21 of body 20 and tangent L2 of side surface 22 is an acute angle as illustrated in FIG. 1. Therefore, autonomous travel-type cleaner 10 can turn once autonomous travel-type cleaner 10 is positioned at corner R3 in the object region. Accordingly, autonomous travel-type cleaner 10 can assume various postures with respect to corner R3.

Examples of the postures include a posture in which front top portion 23 of body 20 is directed toward the vertex of corner R3 in the object region or the vicinity thereof.

In a case where autonomous travel-type cleaner 10 assumes the above-described posture, the outline of body 20 approaches the vertex of corner R3 to a greater extent than in the case where autonomous travel-type cleaner 900 according to the related art, which is provided with a circular body, has approached corner R3 in the object region to the maximum extent possible. Accordingly, suction port 101 of body 20 further approaches the vertex of corner R3, too. Therefore, body 20 becomes more likely to suction the rubbish present on the cleaning surface of corner R3 from suction port 101. In other words, autonomous travel-type cleaner 10 is more likely to suction the rubbish present at corner R3 in the object region than autonomous travel-type cleaner 900 according to the related art that is provided with the circular body.

In a case where the posture is assumed in which front top portion 23 of body 20 is directed toward the vertex of corner R3 or the vicinity thereof, autonomous travel-type cleaner 10 can change its direction by rotation. Therefore, the constraint that is imposed on an autonomous travel-type cleaner according to the related art which is provided with a D-shaped body can be reduced (mitigated) in the case of a movement from corner R3 in the object region to another place. In other words, autonomous travel-type cleaner 10 is capable of promptly moving from corner R3 to another place compared to the autonomous travel-type cleaner according to the related art that is provided with the D-shaped body.

Autonomous travel-type cleaner 10 according to this embodiment is operated as described above.

Hereinafter, effects of autonomous travel-type cleaner 10 according to this embodiment will be described.

(1) In another form of autonomous travel-type cleaner 10, the width of suction port 101 may be smaller than the inside gap between the pair of driving units 30. However, it is more preferable that the width of suction port 101 exceeds the inside gap between the pair of driving units 30 as in the illustration of autonomous travel-type cleaner 10 according to this embodiment. In other words, in the configuration of this embodiment, the width of suction port 101 is larger than in the alternative form described above. Therefore, suction unit 50 is capable of suctioning more of the rubbish.

(2) In another form of autonomous travel-type cleaner 10, suction port 101 may be formed between the pair of driving units 30. However, it is more preferable that suction port 101 is formed on the front side of body 20 with respect to the pair of driving units 30 as in the illustration of autonomous travel-type cleaner 10 according to this embodiment. In other words, in the configuration of this embodiment, suction port 101 can approach the wall (corner R3) to a greater extent than in the alternative form described above. Therefore, suction unit 50 is capable of suctioning more of the rubbish.

(3) In autonomous travel-type cleaner 10, the maximum width of body 20 is defined by left and right front top portions 23. Accordingly, the width of a rear portion of body 20 is smaller than the width of a front portion of body 20. Therefore, the risk of contact between the rear portion of body 20 and the surrounding object is reduced in a case where autonomous travel-type cleaner 10 turns in a place where the surrounding object is present. Accordingly, the mobility of autonomous travel-type cleaner 10 can be enhanced.

(4) Another form of autonomous travel-type cleaner 10 may be configured to be provided with steering-type driving. However, the driving based on the two facing wheels that the pair of driving units 30 constitute as in the illustration of autonomous travel-type cleaner 10 according to this embodiment is more preferable. In other words, in the configuration of this embodiment, structural simplification can be achieved compared to the alternative form described above. Accordingly, reduction in size, weight, and cost can be achieved.

(5) In general, a relationship between axis of rotation H of each driving unit 30 and center of gravity G of autonomous travel-type cleaner 10 constitutes one of main factors that determine a trajectory of rotation which is formed by body 20. In this regard, axes of rotation H of the pair of driving units 30 in autonomous travel-type cleaner 10 according to this embodiment are present on the rear side of body 20 with respect to center of gravity G. In this case, autonomous travel-type cleaner 10 is likely to form an operation of turning while changing the position of its center of gravity G by using contact with the surrounding object. Accordingly, autonomous travel-type cleaner 10 can appropriately form (clean) at least a part of the quadrangular trajectory based on the turning operation of body 20 formed by the Reuleaux triangle. As a result, the corner cleaning ability of autonomous travel-type cleaner 10 can be further enhanced.

Embodiment 2

Hereinafter, an autonomous travel-type cleaner according to Embodiment 2 will be described with reference to FIGS. 8 and 9. Elements in the description of Embodiment 2 that have the same reference numerals as in Embodiment 1 have functions identical or similar to those of the corresponding elements of Embodiment 1.

Figure 8:
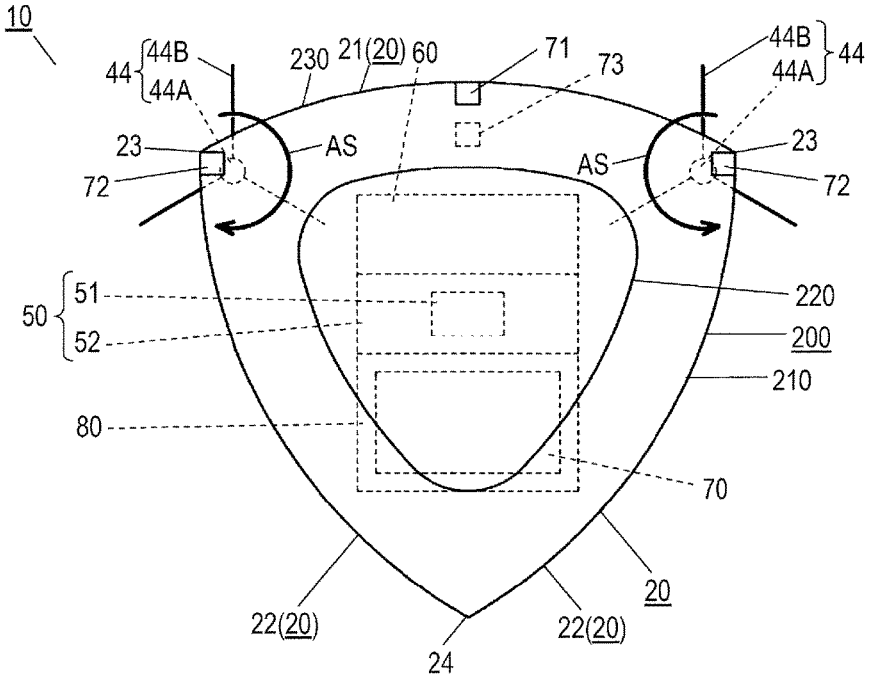
FIG. 8 is a front view of an autonomous travel-type cleaner according to Embodiment 2.

FIG. 8 is a front view of the autonomous travel-type cleaner according to Embodiment 2. FIG. 9 is a bottom view of the autonomous travel-type cleaner illustrated in FIG. 8.

Figure 9:
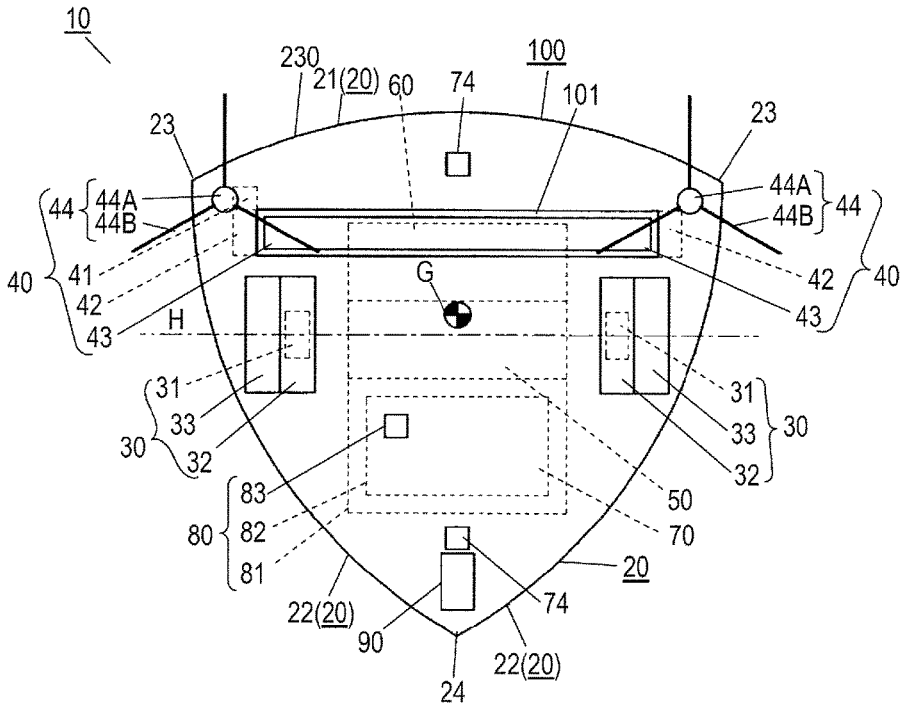
FIG. 9 is a bottom view of the autonomous travel-type cleaner illustrated in FIG. 8.

As illustrated in FIGS. 8 and 9, autonomous travel-type cleaner 10 according to this embodiment differs from the autonomous travel-type cleaner according to Embodiment 1 in that cleaning unit 40 is further provided with a pair of side brushes 44, brush driving motor 41, and a pair of second gearboxes 42.

The pair of side brushes 44 of cleaning unit 40 is placed on the bottom surface of lower unit 100, which is the bottom surface of body 20. One (for example, the left one) of the pair of second gearboxes 42 is connected to the output shaft of brush driving motor 41, main brush 43, and one (for example, the left one) of side brushes 44. The torque of brush driving motor 41 is transmitted to main brush 43 and one (for example, the left one) of side brushes 44. The other (for example, the right) second gearbox 42 is connected to main brush 43 and the other (for example, the right) side brush 44 and transmits torque of main brush 43 to the other (for example, the right) side brush 44.

Side brush 44 is provided with brush shaft 44A, a plurality of bristle bundles 44B, and the like. Brush shaft 44A is attached to front top portion 23 of body 20. Bristle bundles 44B are attached to brush shaft 44A.

Side brush 44 is disposed, with respect to body 20, at a position where an orbit of rotation is formed that allows the rubbish collection in suction port 101. Three bundles, for example, constitute bristle bundles 44B as illustrated in FIG. 8. Respective bristle bundles 44B are attached to brush shaft 44A with a constant angular interval (such as 120°).

Brush shaft 44A has an axis of rotation that extends in the same direction as the height direction of body 20 or in substantially the same direction as the height direction of body 20. Brush shaft 44A is supported by body 20 to be capable of rotating with respect to body 20. In addition, brush shaft 44A is placed on the front side of body 20 with respect to the longitudinal-direction center line of suction port 101.

A plurality of bristles constitute each of bristle bundles 44B. Each of bristle bundles 44B is fixed to brush shaft 44A to extend in the same direction as the radial direction of brush shaft 44A or in substantially the same direction as the radial direction of brush shaft 44A. At this time, the length of bristle bundle 44B is set to, for example, a length at which tips of bristle bundles 44B stick out at least from the outline of body 20.

As shown by the arrows AS that are illustrated in FIG. 8, the directions of rotation of the pair of side brushes 44 are set to directions in which the orbits of rotation are directed toward the rear from the front of body 20 on the width-direction center side of body 20. In other words, the pair of side brushes 44 rotates in opposite directions. In other words, the rotation occurs toward the rear from the front of body 20 at a part of the orbit of rotation of each side brush 44 that approaches the orbit of rotation of the other side brush 44.

Autonomous travel-type cleaner 10 according to this embodiment has the configuration described above.

In other words, autonomous travel-type cleaner 10 according to this embodiment achieves the following effects in addition to the effects of (1) to (5) achieved by autonomous travel-type cleaner 10 according to Embodiment 1.

(6) Autonomous travel-type cleaner 10 according to this embodiment is provided with side brush 44. According to this configuration, the rubbish present at corner R3 in the object region can be collected in suction port 101 of body 20 by side brush 44. Accordingly, the corner cleaning ability of autonomous travel-type cleaner 10 is further enhanced.

(7) Side brush 44 is attached to a bottom surface of front top portion 23. According to this configuration, brush shaft 44A of side brush 44 approaches the vertex of corner R3 to a greater extent than in a case where autonomous travel-type cleaner 900 according to the related art is positioned at corner R3. Accordingly, the corner cleaning ability of autonomous travel-type cleaner 10 is further enhanced.

(8) In autonomous travel-type cleaner 10 according to this embodiment, respective side brushes 44 rotate in the opposite directions. In other words, the rotation occurs toward the rear from the front of body 20 at the part of the orbit of rotation of each side brush 44 that approaches the orbit of rotation of the other side brush 44. According to this configuration, the rubbish is collected in suction port 101 from the front side of body 20 by side brush 44. Therefore, the rubbish is more likely to be suctioned in suction port 101 than in a case where, for example, the rubbish is collected in suction port 101 from the vicinity of a side of suction port 101. Accordingly, the rubbish that is present on the cleaning surface of corner R3 can be efficiently removed.

(9) An autonomous travel-type cleaner that is provided with a general side brush has a high level of risk in the form of a bristle bundle being caught by a surrounding object during traveling of the autonomous travel-type cleaner in a case where the bristle bundle is excessively large in length. However, autonomous travel-type cleaner 10 according to this embodiment can allow suction port 101 of body 20 to further approach tip part R4 of corner R3, and thus the corner cleaning ability does not depend much on the length of bristle bundle 44B. Accordingly, bristle bundle 44B is allowed to be relatively small in length. As a result, the risk of bristle bundle 44B being caught by the surrounding object can be reduced.

(10) Likewise, in the autonomous travel-type cleaner that is provided with the side brush, the bristle bundle becomes increasingly prone to bending during a movement of the rubbish by the bristle bundle as the length of the bristle bundle increases. In a case where the bristle bundle is bent to a significant extent, the bristle bundle might be unable to move the rubbish to a suction port of a body in an appropriate manner. However, autonomous travel-type cleaner 10 according to this embodiment allows a relatively small length to be set for bristle bundle 44B as described above, and thus the amount of bending of bristle bundle 44B is reduced by the small length being set for bristle bundle 44B. Accordingly, the rubbish that is present at corner R3 is likely to be collected in suction port 101 by bristle bundle 44B.

Embodiment 3

Hereinafter, an autonomous travel-type cleaner according to Embodiment 3 will be described with appropriate reference to FIGS. 10 to 26. Elements in the description of Embodiment 3 that have the same reference numerals as in Embodiment 2 have functions identical or similar to those of the corresponding elements of Embodiment 2.

Figure 10:
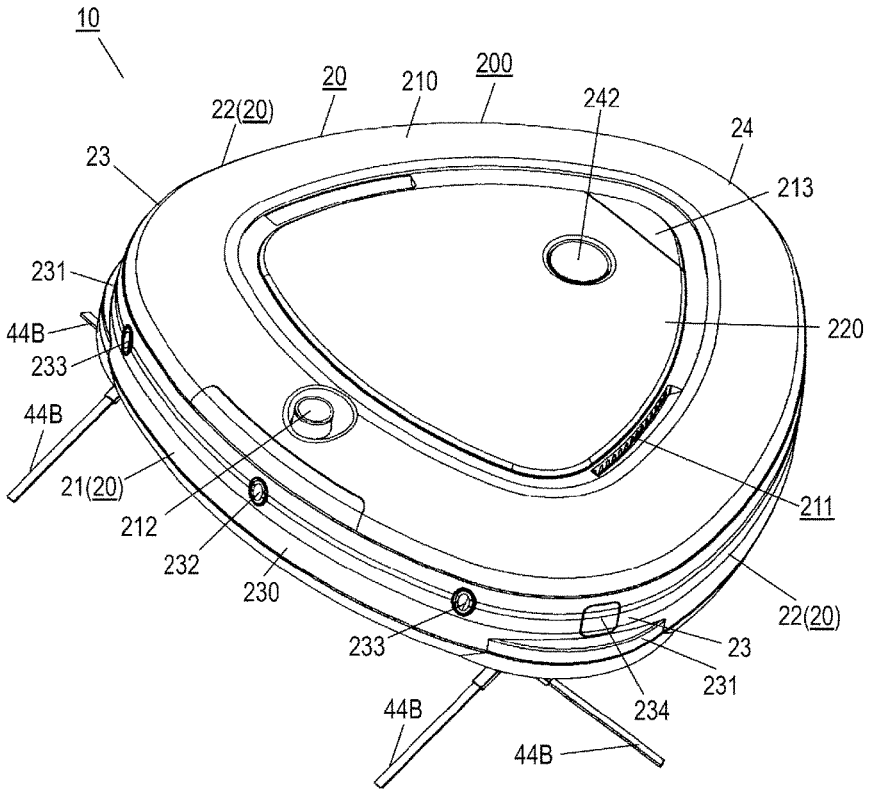
FIG. 10 is a perspective view of an autonomous travel-type cleaner according to Embodiment 3.

FIG. 10 is a perspective view of autonomous travel-type cleaner 10 according to Embodiment 3.

Autonomous travel-type cleaner 10 according to this embodiment is further provided with the following configurations unspecified in Embodiment 2.

Each element of autonomous travel-type cleaner 10 illustrated in FIG. 10 is an example of a specific form that can be taken by each element of autonomous travel-type cleaner 10 according to Embodiment 2 schematically illustrated in FIGS. 8 and 9.

As illustrated in FIG. 10, each of right front top portion 23, left front top portion 23, and rear top portion 24 of body 20 of autonomous travel-type cleaner 10 according to this embodiment has an R shape. Upper unit 200 is provided with a plurality of exhaust ports 211, light receiving unit 212, and lid button 213. The plurality of exhaust ports 211 are formed to line up along, for example, an edge of lid 220 to be directed toward left and right side surfaces 22 of body 20 and allow the space in body 20 and the outside to communicate with each other. Light receiving unit 212 is formed on the front side of lid 220. Lid button 213 is disposed for opening and closing of lid 220 in a case where, for example, the rubbish accumulated in rubbish bin unit 60 is disposed of.

Light receiving unit 212 receives a light signal that is output from a charging stand (not illustrated) charging autonomous travel-type cleaner 10 or a light signal that is output from a remote controller (not illustrated) operating autonomous travel-type cleaner 10. After the light signal is received, light receiving unit 212 outputs a light receiving signal corresponding to the signal to control unit 70 (refer to, for example, FIG. 15).

Figure 11:
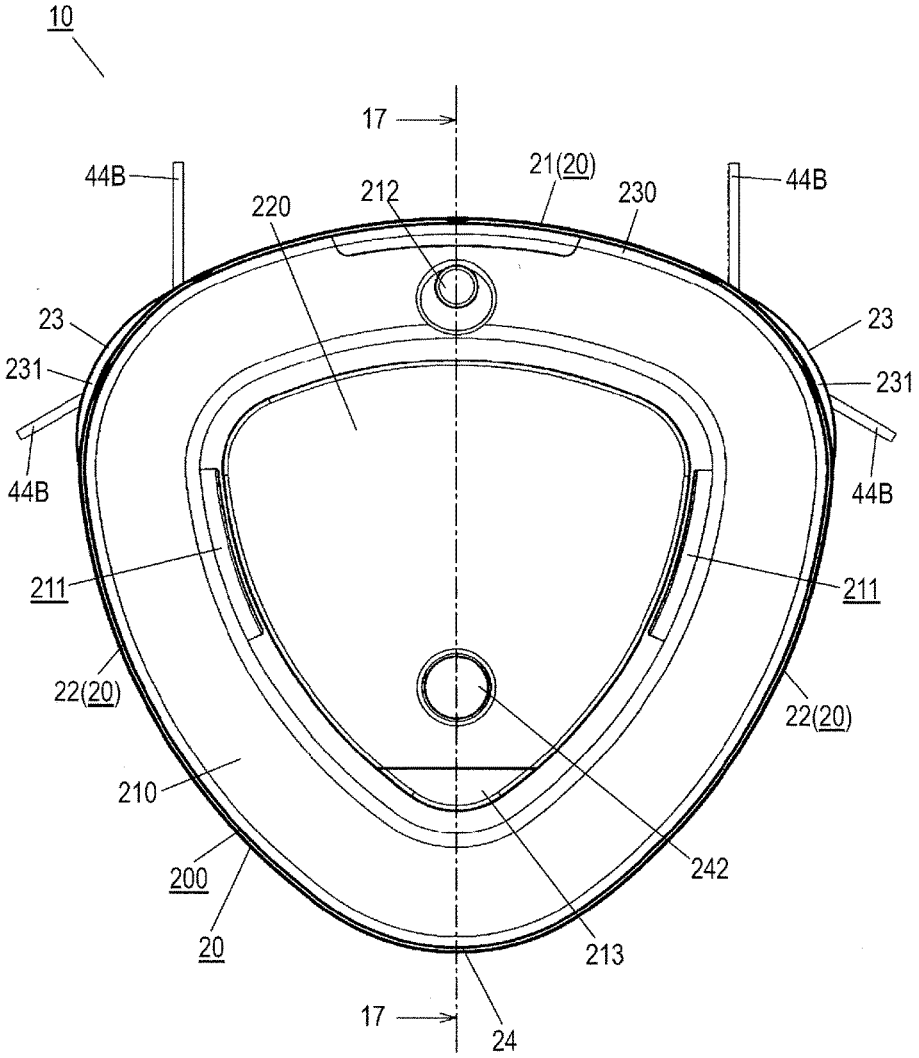
FIG. 11 is a front view of the autonomous travel-type cleaner illustrated in FIG. 10.

FIG. 11 is a front view of autonomous travel-type cleaner 10 illustrated in FIG. 10.

As illustrated in FIG. 11, autonomous travel-type cleaner 10 has a substantially axisymmetric shape with respect to its center line (refer to line 17-17 in the drawing) that extends in the front-rear direction. Bumper 230 is provided with a pair of curved convex portions 231 protruding from left and right front top portions 23. Curved convex portions 231 are curved to imitate the R shapes of front surface 21 and side surface 22 and form a part of the outline of body 20.

Figure 12:
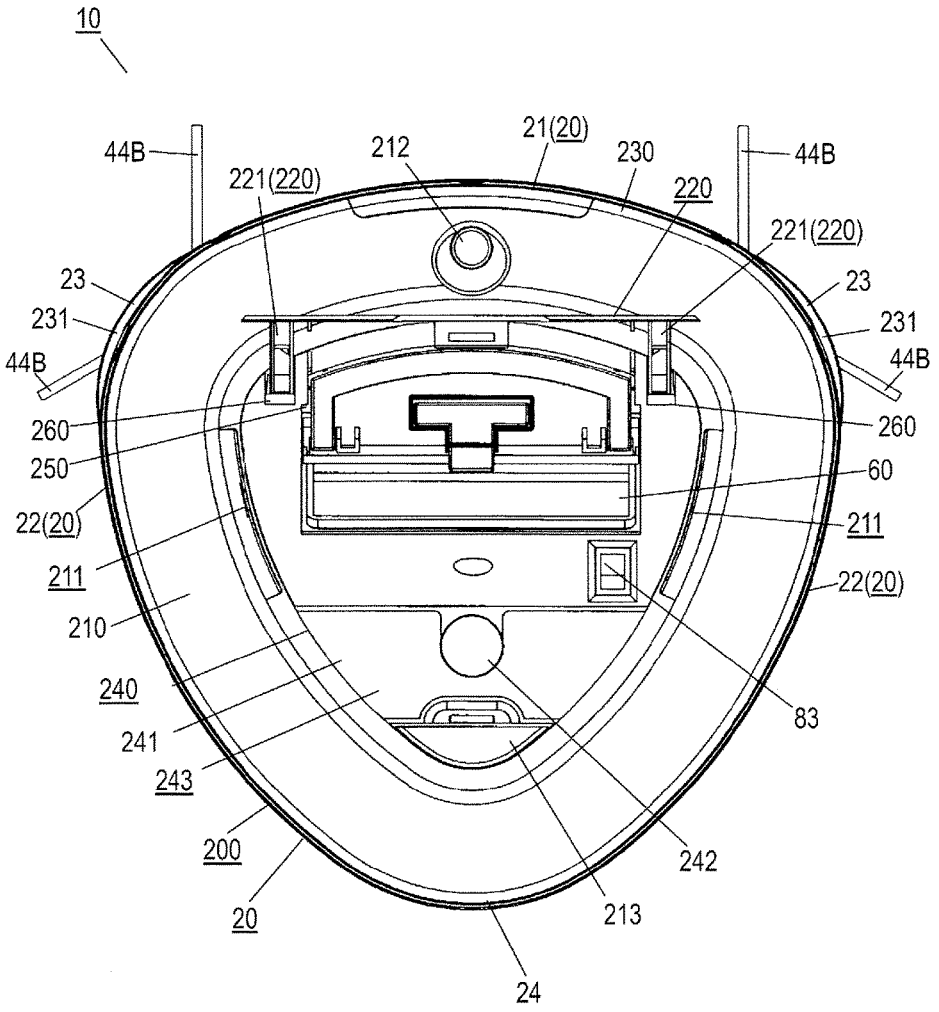
FIG. 12 is a front view showing a state where a lid of the autonomous travel-type cleaner illustrated in FIG. 10 is open.

FIG. 12 is a front view illustrating a state where lid 220 of the autonomous travel-type cleaner illustrated in FIG. 10 is open.

As illustrated in FIG. 12, upper unit 200 is provided with cover 210, lid 220, bumper 230, interface portion 240, rubbish bin receiver 250, and the like. An element operated by the user is placed in interface portion 240. Rubbish bin receiver 250 supports rubbish bin unit 60. Lid 220 is provided with a pair of arms 221 constituting a hinge structure of lid 220. In addition, upper unit 200 is provided with a pair of arm accommodating portions 260 (refer to FIG. 25) accommodating arms 221.

Interface portion 240 constitutes a part of cover 210. Interface portion 240 is closed when lid 220 is closed (refer to, for example, FIG. 11) and is opened when lid 220 is opened. Interface portion 240 is provided with, for example, panel 241 that includes main switch 83, operation button 242, display unit 243, and the like. Operation button 242 turns ON or OFF the operation of autonomous travel-type cleaner 10. Panel 241 displays information related to autonomous travel-type cleaner 10 in display unit 243. In addition, panel 241 is provided with an operation button (not illustrated) for various setting inputs related to the operation of autonomous travel-type cleaner 10. Main switch 83 is placed in interface portion 240.

Figure 24:
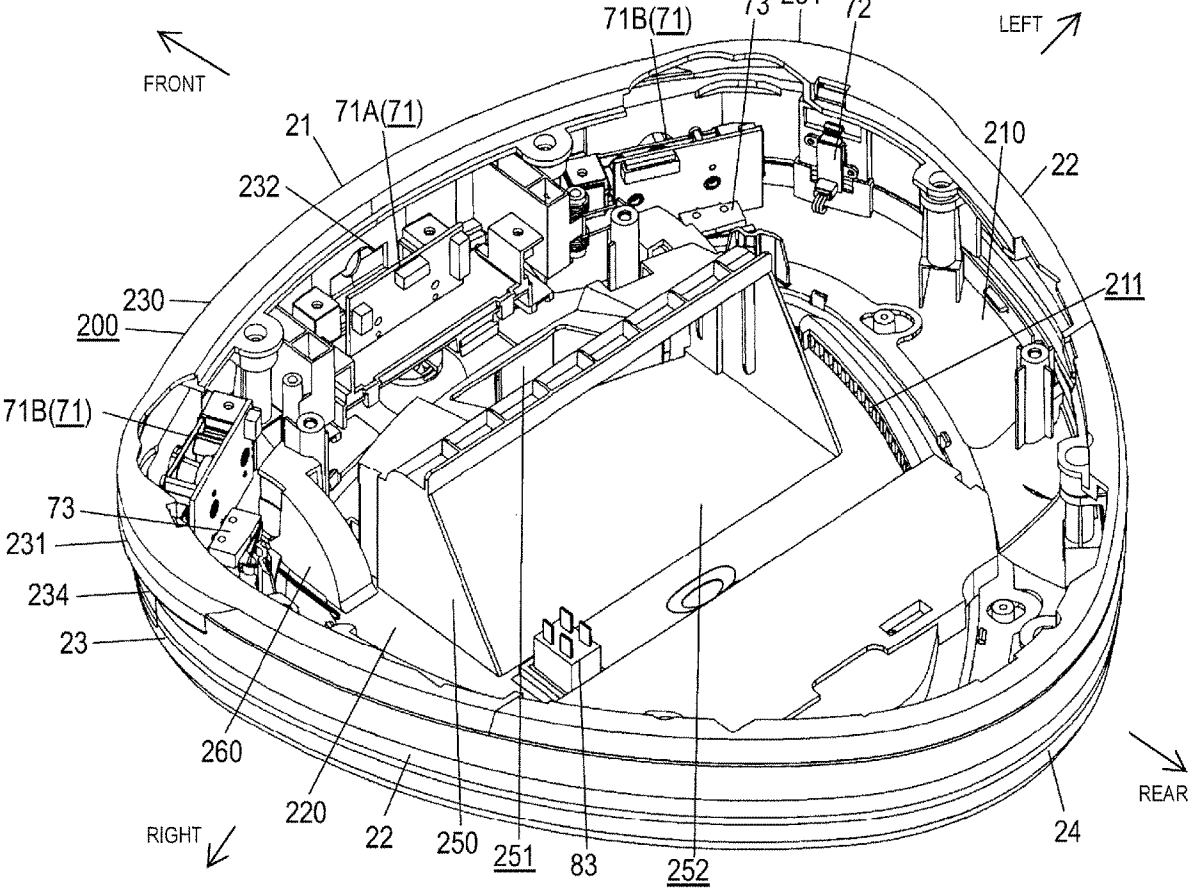
FIG. 24 is a perspective view of an upper unit illustrated in FIG. 10.
Figure 25:
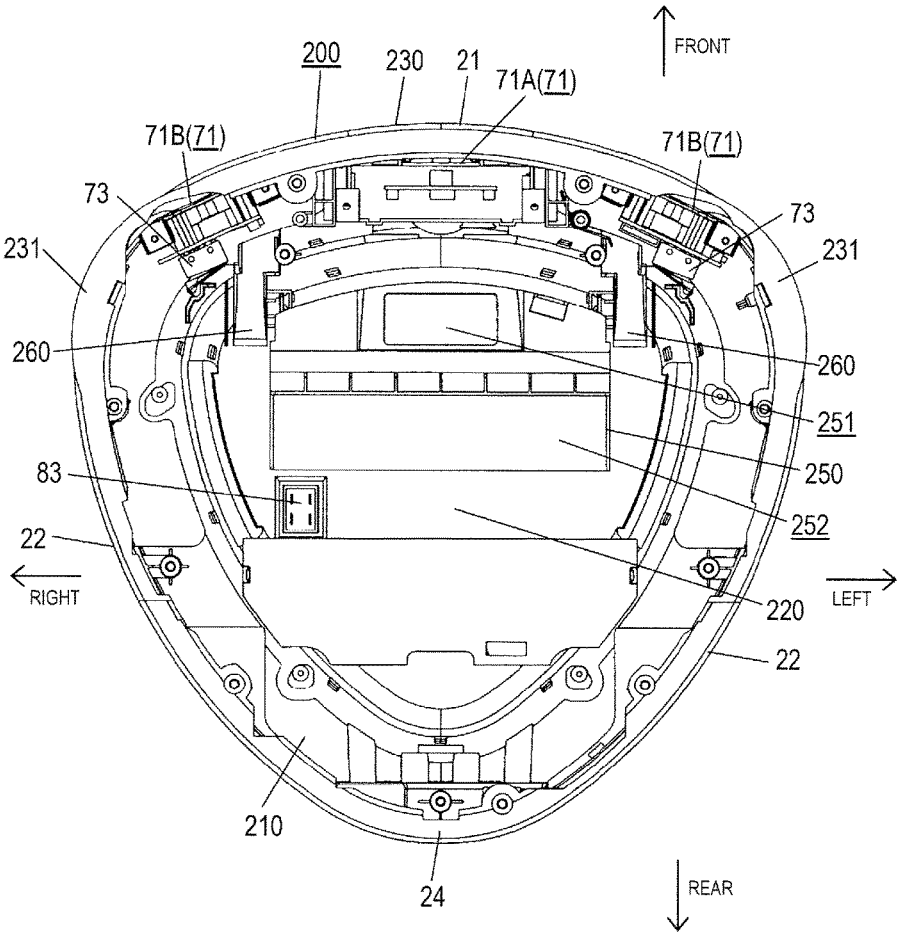
FIG. 25 is a bottom view of the upper unit illustrated in FIG. 24.

FIG. 24 is a perspective view of the bottom surface side of upper unit 200 illustrated in FIG. 10.

As illustrated in FIG. 24, rubbish bin receiver 250 is configured as a box-shaped object that is open to an upper surface side of upper unit 200. Rubbish bin receiver 250 is provided with bottom portion opening 251 open to a bottom portion side of body 20 and rear opening 252 open to the rear side of body 20. Rubbish bin unit 60 illustrated in FIG. 12 is inserted into rubbish bin receiver 250.

Figure 13:
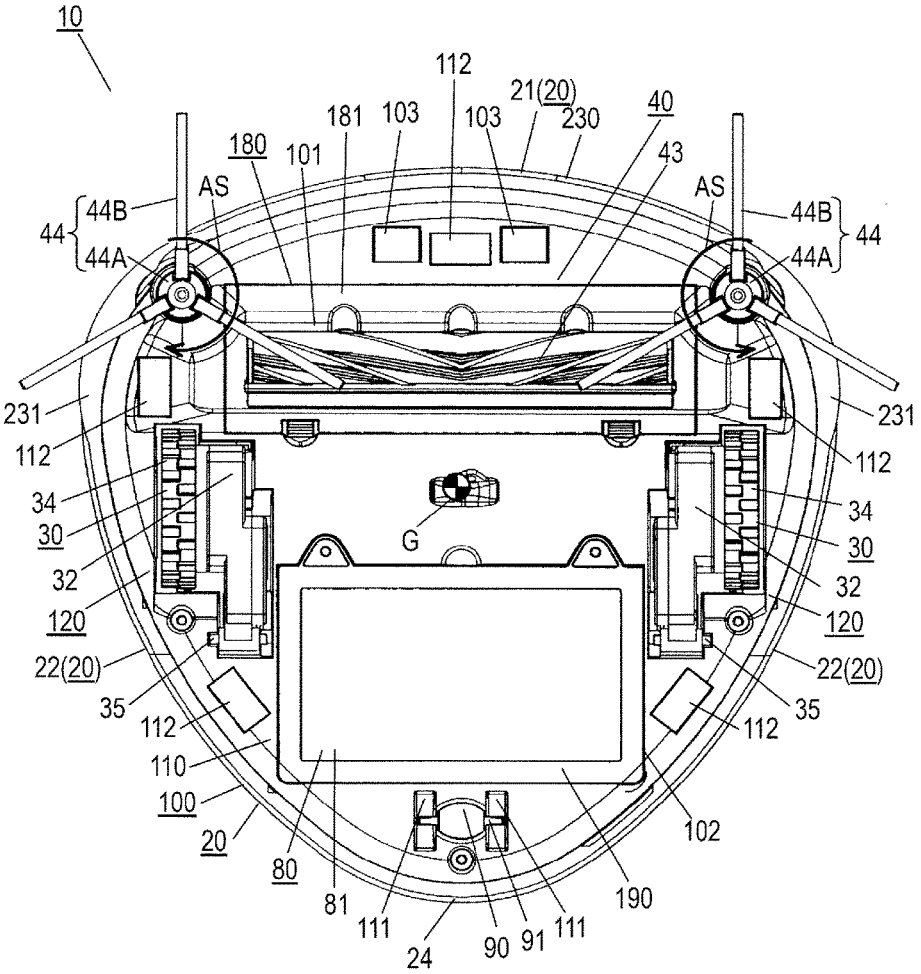
FIG. 13 is a bottom view of the autonomous travel-type cleaner illustrated in FIG. 10.

FIG. 13 is a bottom view of autonomous travel-type cleaner 10 illustrated in FIG. 11.

As illustrated in FIG. 13, lower unit 100 is provided with base 110, supporting shaft 91, and the like. Base 110 forms a frame of lower unit 100. Supporting shaft 91 is placed in parallel, to the longitudinal direction of suction port 101 and supports caster 90.

Base 110 is provided with power supply port 102 that is open to the bottom surface and has a shape corresponding to power supply unit 80, a pair of charging terminals 103 that are connected to the charging stand (not illustrated), and the like. Power supply port 102 is formed on the rear side of body 20 with respect to the center of body 20 in the front-rear direction and a part of power supply port 102 is formed between the pair of driving units 30. Charging terminal 103 is formed on the front side of body 20 with respect to suction port 101. Charging terminal 103 is formed at, for example, a part of the bottom surface of base 110 that is close to the front surface 21 side.

Base 110 is also provided with a pair of bottom portion bearings 111 for supporting supporting shaft 91. Bottom portion bearing 111 is formed on the rear side of body 20 with respect to driving unit 30. Bottom portion bearing 111 is placed in, for example, the rear of body 20 with respect to power supply port 102 at a bottom-surface position on the rear top portion 24 side in the bottom surface of base 110.

Supporting shaft 91 is inserted to caster 90 to be capable of rotating with respect to caster 90. Each end portion of supporting shaft 91 is press-fitted into bottom portion bearing 111. In this manner, caster 90 is coupled with base 110 in a rotatable manner.

FIG. 14 is a side view of autonomous travel-type cleaner 10 illustrated in FIG. 10.

As illustrated in FIG. 14, main brush 43 rotates in the direction of the arrow AM. The gap between the axis of rotation of wheel 33 of driving unit 30 and the axis of rotation of caster 90 is placed to be wider than the gap between the axis of rotation of wheel 33 and the axis of rotation of main brush 43. This positional relationship contributes to stabilization of the posture of body 20 of autonomous travel-type cleaner 10.

Figure 15:
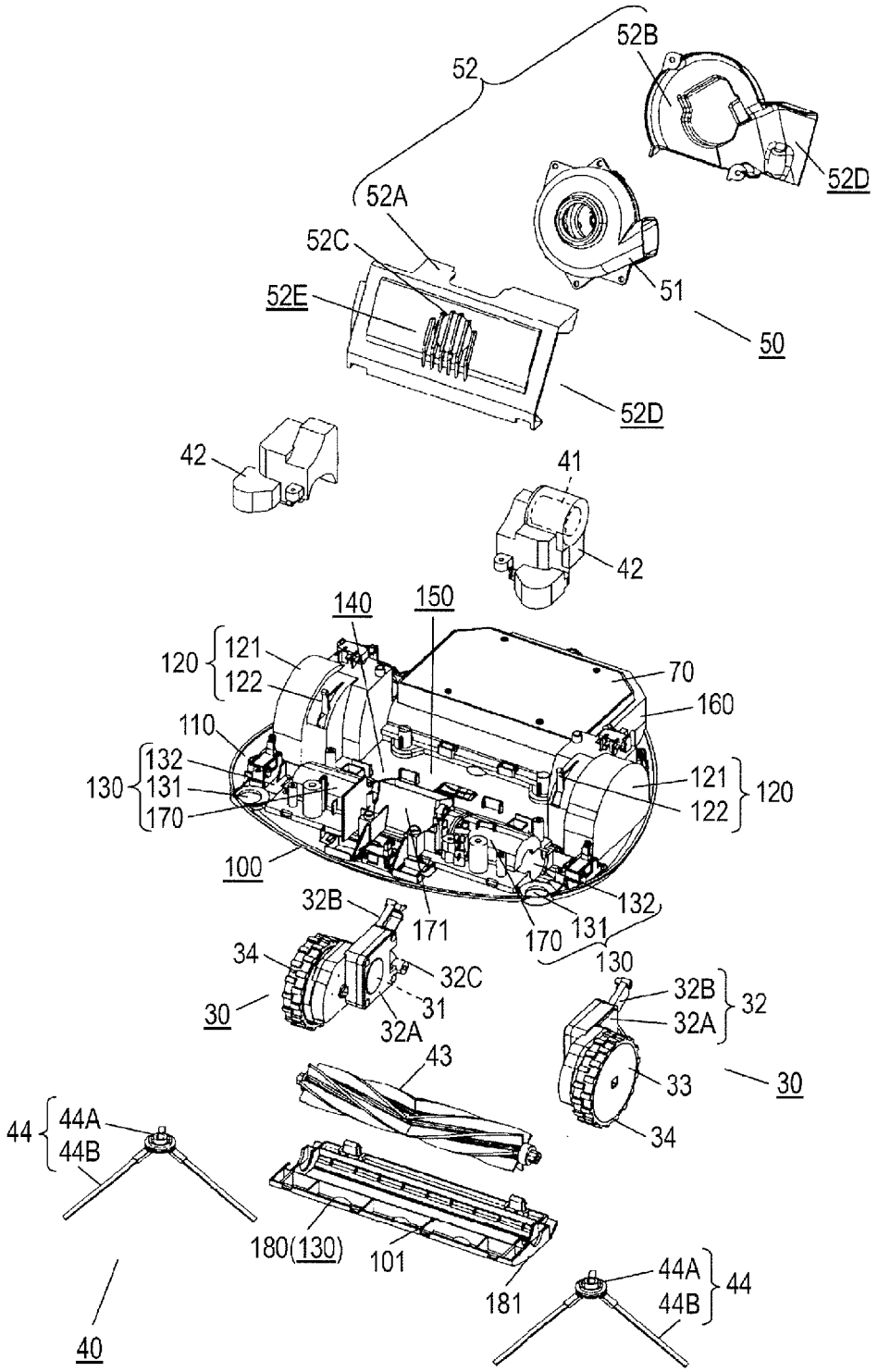
FIG. 15 is a perspective view illustrating a state of a front surface side where some of elements illustrated in FIG. 10 are separated.

FIG. 15 is a perspective view illustrating an upper surface side of lower unit 100 in which some of the elements illustrated in FIG. 10 are disassembled.

As illustrated in FIG. 15, the pair of second gearboxes 42, suction unit 50, fan case 52, rubbish bin unit 60 (refer to FIG. 12), control unit 70, and the like are attached to the upper surface side of lower unit 100. Brush driving motor 41 is accommodated in one of the second gearboxes 42.

Lower unit 100 is provided with not only base 110 but also brush housing 170 that is attached to an upper surface side of base 110. Brush housing 170 is provided with duct 171 connected to rubbish bin unit 60 and forms a space in which main brush 43 is accommodated.

Fan case 52 is provided with, for example, front-side case element 52A and rear-side case element 52B. Front-side case element 52A is placed on the front side of electric fan 51. Rear-side case element 52B is placed on the rear side of electric fan 51. Front-side case element 52A and rear-side case element 52B are combined with each other to constitute fan case 52.

In addition, front-side case element 52A of fan case 52 is provided with suction port 52C, discharge port 52D (refer to FIG. 19), louver 52E, and the like. Suction port 52C is placed to face outlet 61B (refer to FIG. 17) of rubbish bin 61. Discharge port 52D is placed to be open to the driving unit 30 side. Louver 52E is disposed to cover suction port 52C.

Figure 16:
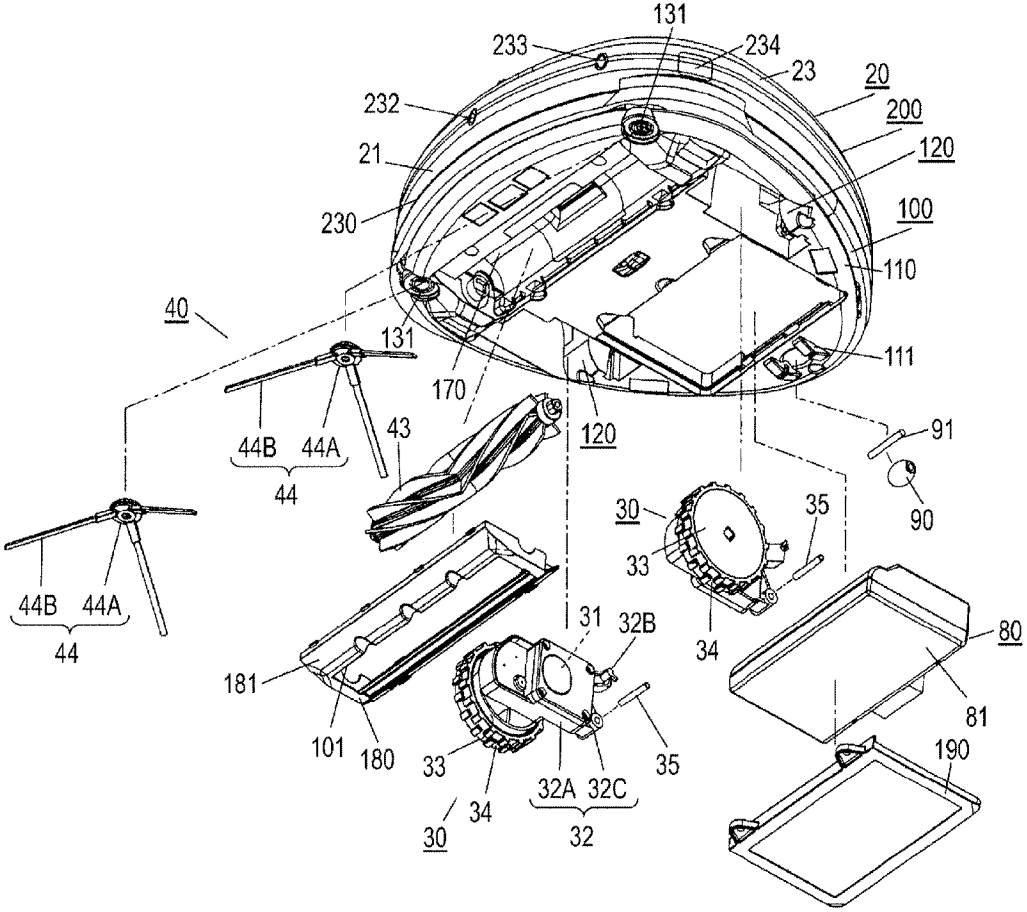
FIG. 16 is a perspective view illustrating a state of a bottom surface side where some of elements illustrated in FIG. 10 are separated.

FIG. 16 is a perspective view illustrating the bottom surface side of lower unit 100 in which some of the elements illustrated in FIG. 10 are disassembled.

As illustrated in FIG. 16, the pair of driving units 30, main brush 43, the pair of side brushes 44, caster 90, and power supply unit 80 are attached to the bottom surface side of lower unit 100. In addition, lower unit 100 is provided with brush cover 180 that is attached to a bottom surface side of brush housing 170 and holding frame 190 that is attached to power supply port 102. Holding frame 190 is fixed to power supply port 102. In this manner, holding frame 190 holds power supply unit 80 in cooperation with base 110.

In addition, base 110 and brush cover 180 are provided with a removable structure that allows the user to select at will a state where brush cover 180 is attached to base 110 or a state where brush cover 180 is detached from base 110. Likewise, base 110 and holding frame 190 are provided with a removable structure that allows the user to select at will a state where holding frame 190 is attached to base 110 or a state where holding frame 190 is detached from base 110.

Figure 20:
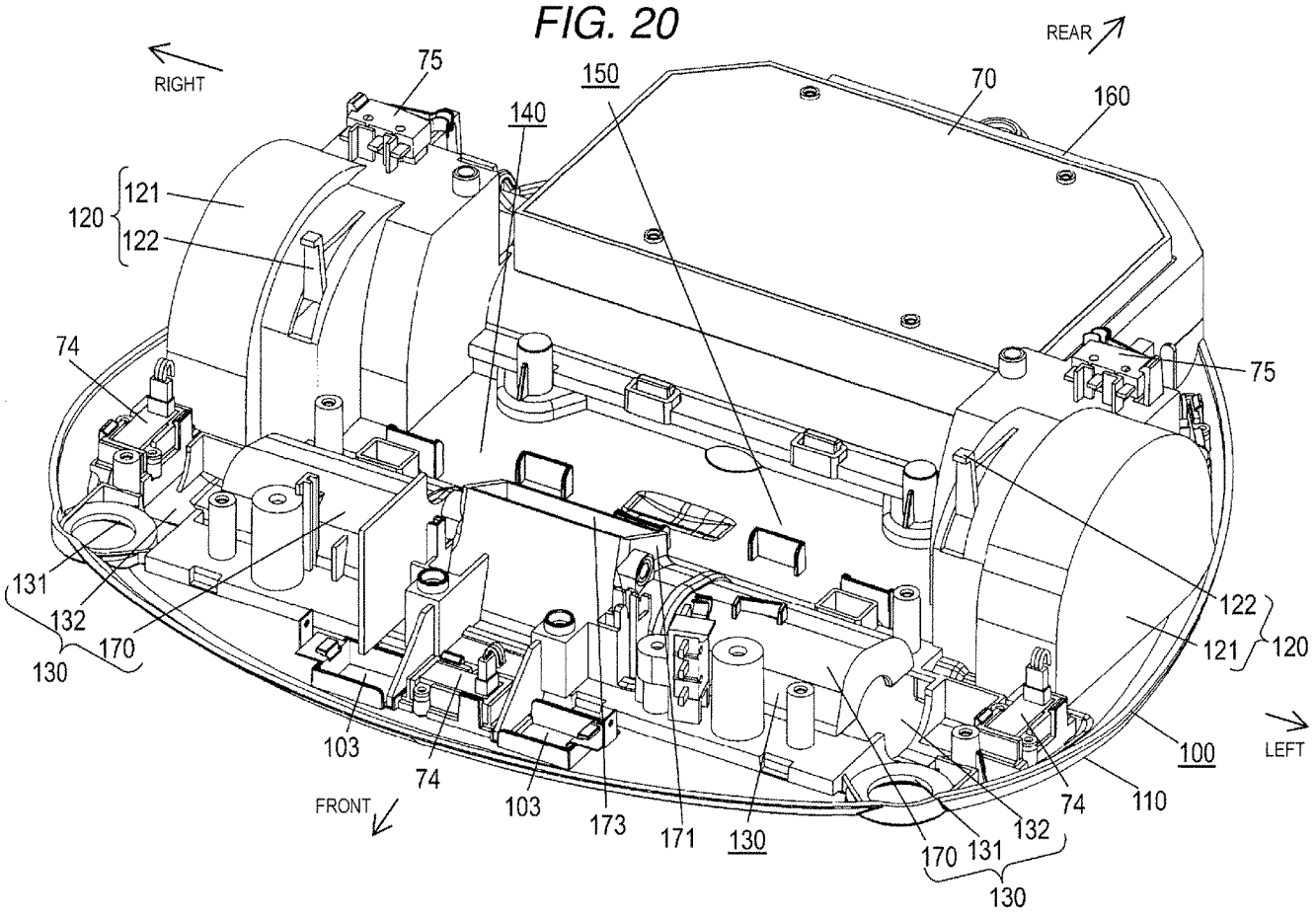
FIG. 20 is a perspective view of a lower unit illustrated in FIG. 15.
Figure 21:
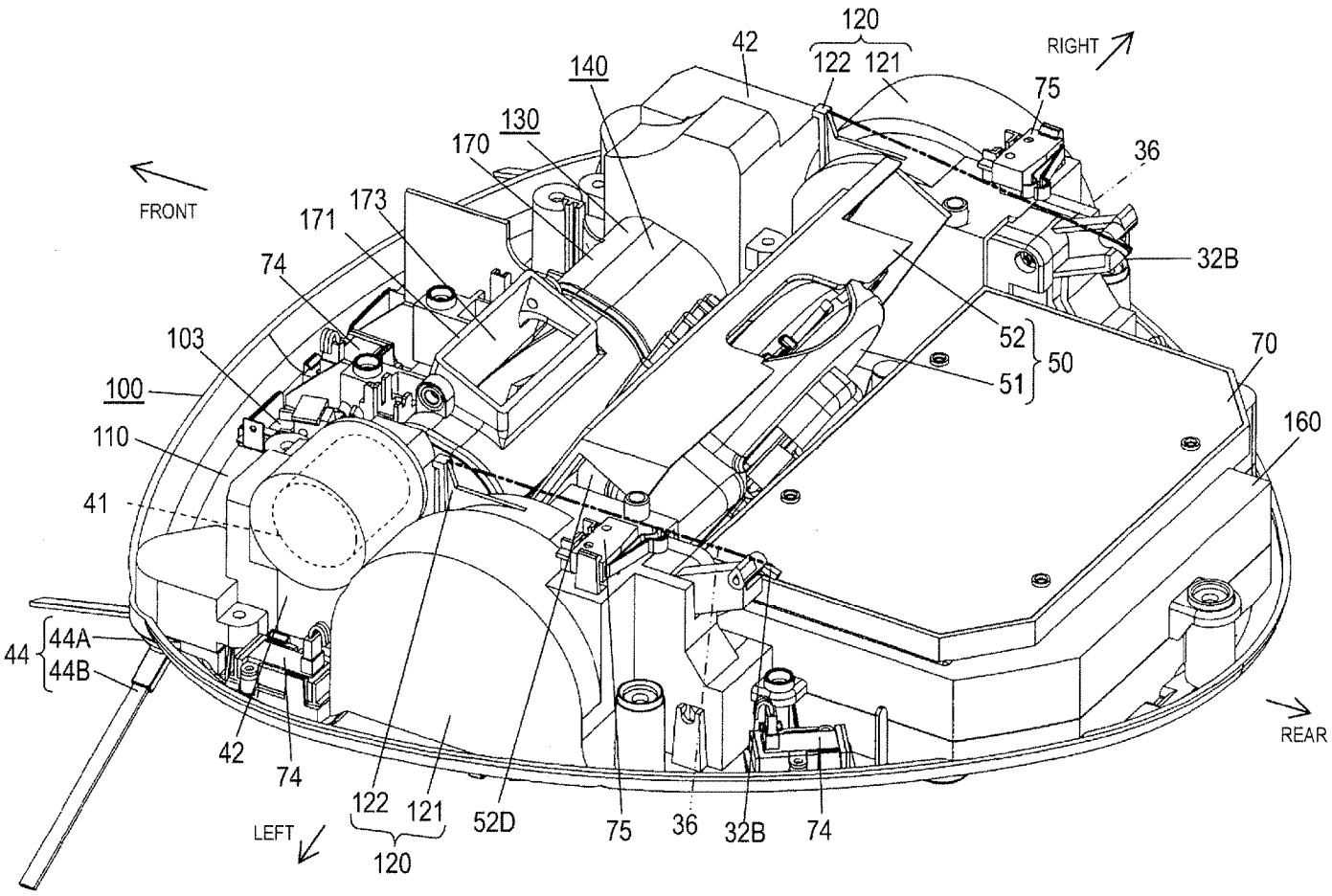
FIG. 21 is a perspective view of the lower unit illustrated in FIG. 15.

FIG. 20 is an enlarged perspective view in which lower unit 100 illustrated in FIG. 15 is viewed from the front side. FIG. 21 is an enlarged perspective view in which lower unit 100 illustrated in FIG. 15 is viewed from the left side.

As illustrated in FIG. 20, base 110 is provided with a plurality of functional regions in which respective corresponding elements are supported or accommodated. Examples of the functional regions include driving part 120, cleaning part 130, rubbish bin part 140, suction part 150, and power supply part 160.

Driving part 120, which is a functional region accommodating driving unit 30, is provided with a plurality of functional parts. Examples of the functional parts of driving part 120 include wheel house 121 and spring hook portion 122. Wheel house 121 is open to the bottom surface side of base 110 and accommodates driving unit 30. Suspension spring 36 (refer to FIG. 21) that constitutes a suspension mechanism (described later) is hooked in spring hook portion 122.

Figure 19:
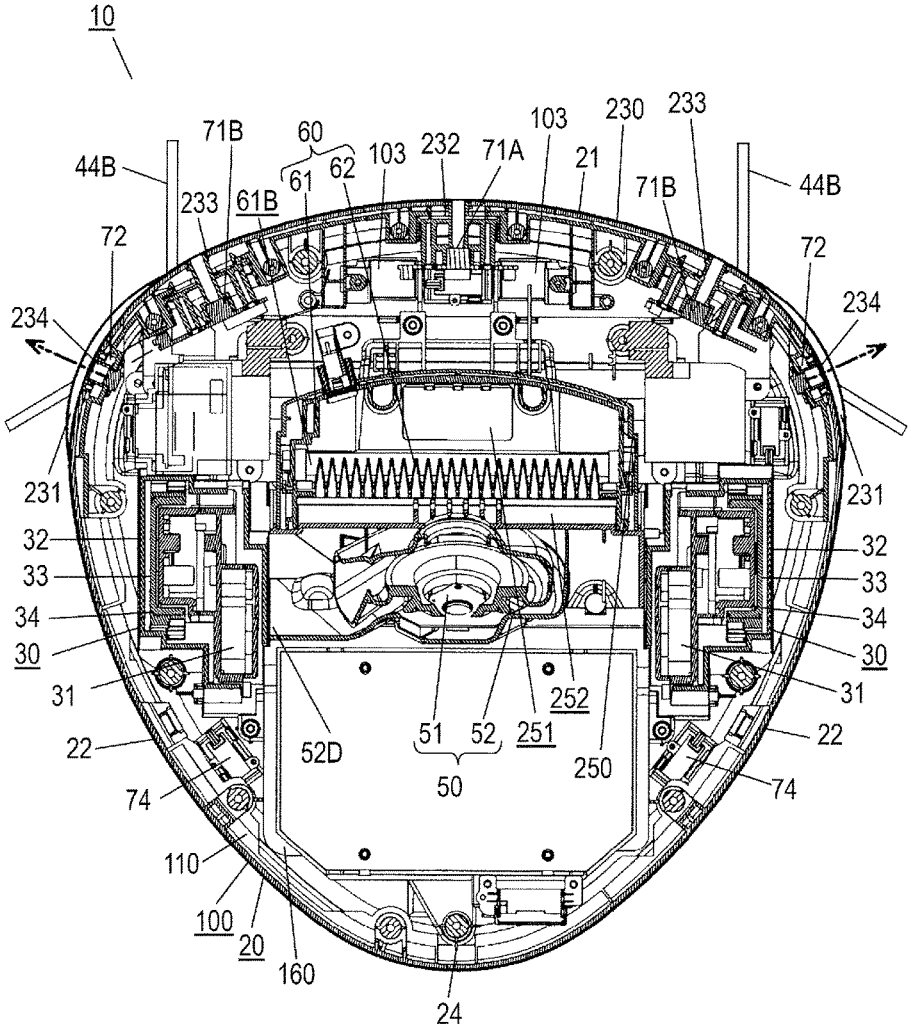
FIG. 19 is a sectional view taken along line 19-19 in FIG. 14.

Wheel house 121 protrudes upward from the upper surface of base 110 and is formed at a part of base 110 that is close to side surface 22 (refer to FIG. 19). Spring hook portion 122 is formed at a part in the front of wheel house 121 and is disposed to protrude substantially upward (including upward) from wheel house 121.

As illustrated in FIG. 21, derailing detection switch 75 is attached to an upper portion of wheel house 121. At the time of derailing of driving unit 30 (refer to FIG. 15) from the cleaning surface in the object region, derailing detection switch 75 is pressed by spring hook portion 32B in line with the derailing. In this manner, derailing of autonomous travel-type cleaner 10 is detected.

Cleaning part 130 that is illustrated in FIG. 20 is a functional region supporting cleaning unit 40 and is provided with a plurality of functional parts. Examples of the functional parts of cleaning part 130 include a pair of shaft insertion portions 131, coupling units 132, brush housing 170, and brush cover 180. The pair of shaft insertion portions 131 supports brush shaft 44A (refer to FIG. 22) of side brush 44. The pair of shaft insertion portions 131 and the pair of second gearboxes 42 (refer to FIG. 22) are placed in coupling units 132.

Figure 17:
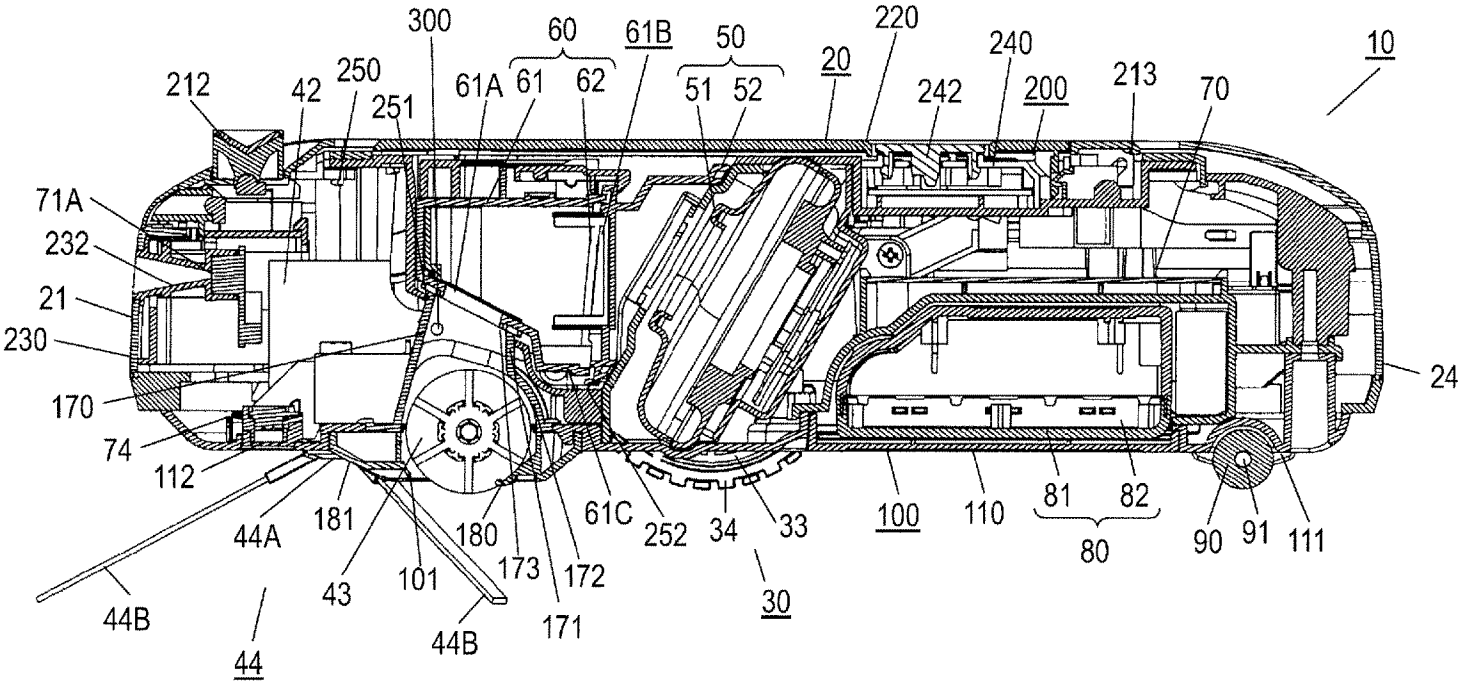
FIG. 17 is a sectional view taken along line 17-17 in FIG. 11.

As illustrated in FIG. 17, both end parts of main brush 43 protrude from brush housing 170 to coupling unit 132 (refer to FIG. 20) once main brush 43 is placed in brush housing 170.

Brush shaft 44A of side brush 44 illustrated in FIG. 15 is inserted into a hole that is formed in shaft insertion portion 131 (refer to FIG. 20).

One of the second gearboxes 42 illustrated in FIG. 15 is placed in one of coupling units 132 (refer to FIG. 20) and is connected to each of an end portion of main brush 43 and one of brush shafts 44A. The other second gearbox 42 is placed in the other coupling unit 132 (refer to FIG. 20) and is connected to each of the end portion of main brush 43 and the other brush shaft 44A.

Rubbish bin part 140 illustrated in FIG. 20 is a functional region that is formed between cleaning part 130 and suction part 150 in the front-rear direction of body 20. Rubbish bin part 140 forms a space where rubbish bin receiver 250 (refer to FIG. 18) is placed.

Suction part 150 is a functional region supporting suction unit 50 and is formed substantially at the center of base 110 of in the vicinity thereof. The pair of wheel houses 121 is formed in both side portions of suction part 150.

Power supply part 160 is a functional region supporting power supply unit 80 and has a recessed portion that is recessed to the upper surface side when viewed from the bottom surface of base 110. Control unit 70 is mounted in an upper portion of power supply part 160.

As illustrated in FIGS. 15 and 17, brush cover 180 protrudes downward from the bottom surface of base 110 and is attached to base 110. Brush cover 180 is provided with suction port 101 that causes main brush 43 to be exposed to the outside of body 20 and inclined surface 181 that is formed at a front part. Inclined surface 181 is formed as a surface that is disposed such that the distance from the bottom surface of lower unit 100 increases toward the rear from the front of body 20. In this manner, inclined surface 181 comes into contact with a step that is present on the cleaning surface in the object region and contributes to floating of the front of body 20.

Duct 171 of brush housing 170 is shaped to extend substantially in the vertical direction of body 20. Duct 171 is provided with inlet 172 that accommodates an upper portion of main brush 43 and outlet 173 that is connected to the space in rubbish bin unit 60. Outlet 173 is inserted into bottom portion opening 251 of rubbish bin receiver 250. Outlet 173 is formed to be smaller in passage area than inlet 172. In other words, as illustrated in FIG. 15, the passage in duct 171 is formed to be slightly inclined to the rear side of body 20 from inlet 172 toward outlet 173. The shape of this passage contributes to guiding of the rubbish to a filter 62 (described later) side after the suctioning of the rubbish into body 20 via suction port 101.

Figure 18:
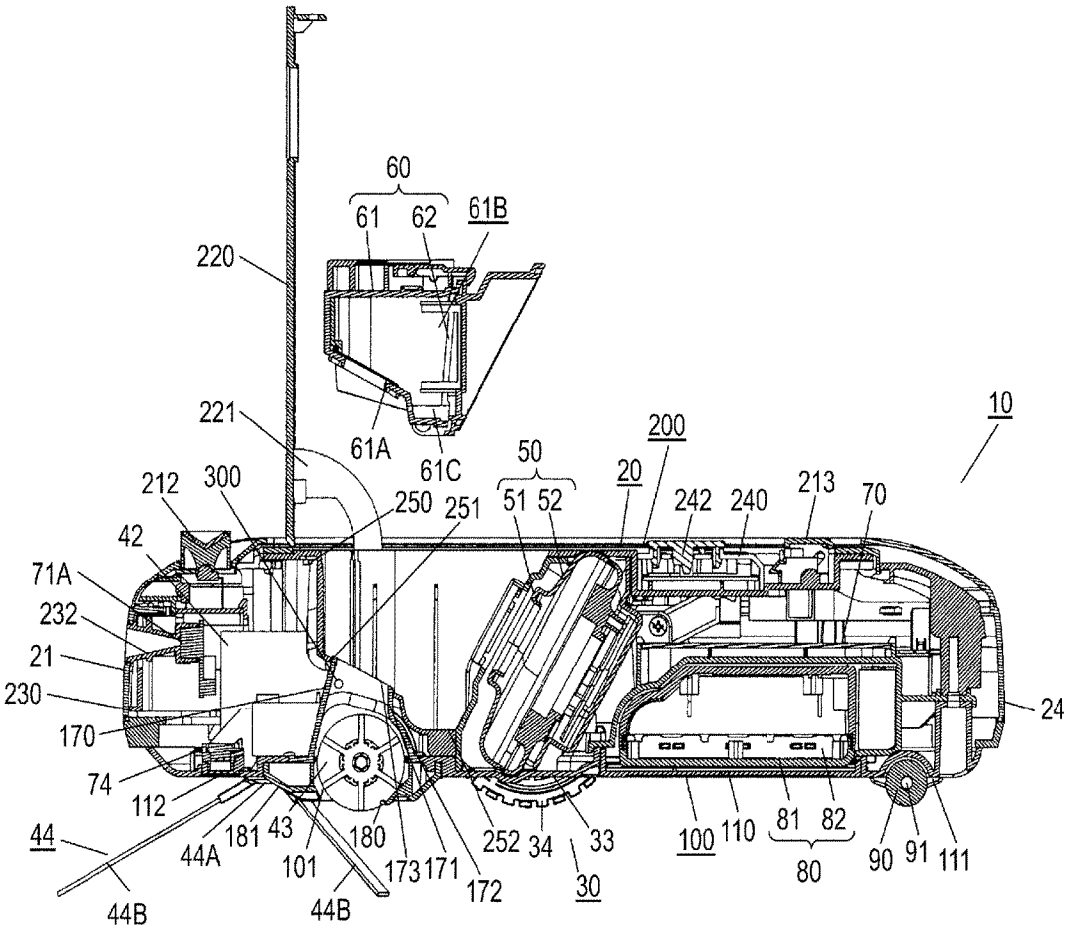
FIG. 18 is a sectional view illustrating a state where some of elements illustrated in FIG. 17 are separated.

As illustrated in FIG. 18, rubbish bin unit 60 is provided with rubbish bin 61 that has a rubbish accumulation space and filter 62 that is attached to rubbish bin 61. Rubbish bin 61 is provided with inlet 61A that is connected to outlet 173 of duct 171, outlet 61B where filter 62 is placed, and bottom portion 61C with a set dimension smaller than that of an upper portion.

As illustrated in FIG. 19, filter 62 is placed to face suction unit 50 in rear opening 252 of rubbish bin receiver 250 and substantially over the entire width direction of rubbish bin 61.

As illustrated in FIG. 17, bottom portion 61C of rubbish bin 61 is placed between the rear side of duct 171 and the front side of fan case 52. This placement contributes to setting of the position of bottom portion 61C in the height direction of body 20 at a lower position and lowering of the center of gravity of rubbish bin 61.

As illustrated in FIG. 18, suction unit 50 is placed at an angle to base 110. In other words, suction unit 50 with respect to base 110 is placed in an inclined posture in which a bottom portion of suction unit 50 is positioned relatively on the front side of body 20 and a top portion of suction unit 50 is positioned relatively on the rear side of body 20. This placement contributes to setting of a small height for body 20.

As illustrated in FIG. 19, fan case 52 has discharge port 52D in one (for example, the left) side portion with the other side portion closed. This configuration contributes to stabilization of the flow of the air that is discharged from electric fan 51.

Figure 22:
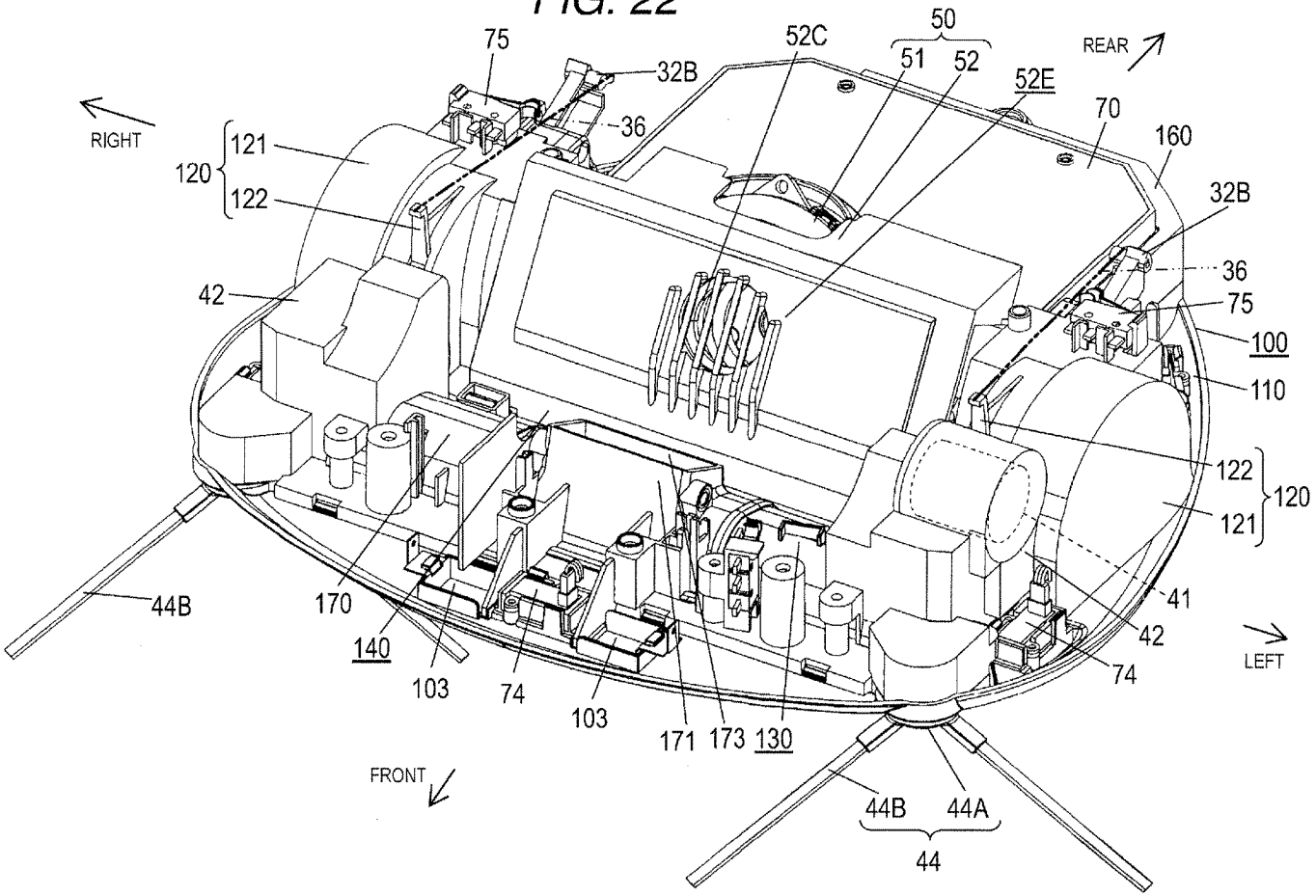
FIG. 22 is a perspective view of the lower unit illustrated in FIG. 15.
Figure 23:
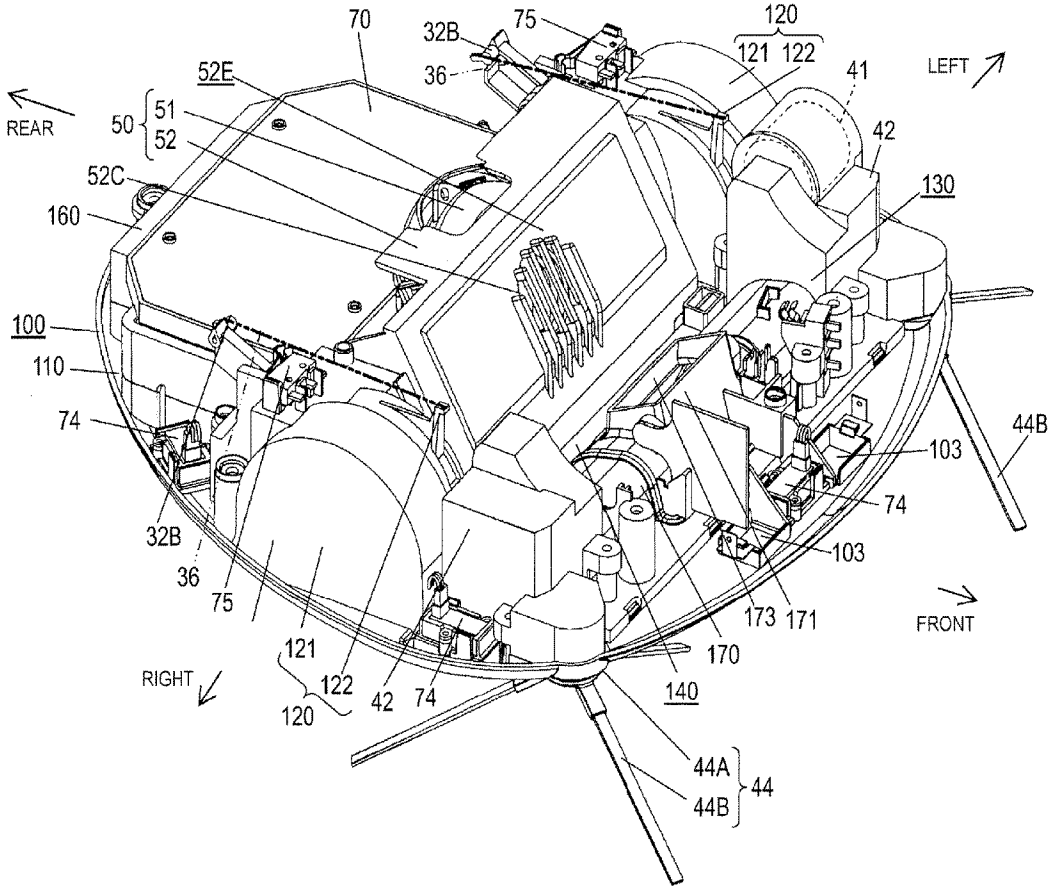
FIG. 23 is a perspective view of the lower unit illustrated in FIG. 15.

FIGS. 21, 22, and 23 are perspective views showing an internal structure of lower unit 100 viewed from the left side, the front side, and the right side.

As illustrated in FIGS. 21, 22, and 23, the pair of second gearboxes 42, main brush 43, the pair of side brushes 44, suction unit 50, control unit 70, and power supply unit 80 are attached to lower unit 100. Upper unit 200 illustrated in FIGS. 24 and 25 constitutes body 20 illustrated in FIG. 10 by being attached to lower unit 100.

FIG. 16 is an exploded perspective view of driving unit 30 that is separated from lower unit 100.

Driving unit 30, which is a functional block causing autonomous travel-type cleaner 10 to move forward, move rearward, and turn, is provided with a plurality of elements. As illustrated in FIG. 16, driving unit 30 is provided with tire 34 in addition to above-described traveling motor 31, housing 32, wheel 33, and the like. Tire 34 is attached around wheel 33 and has a block-shaped tread pattern.

In addition, driving unit 30 is provided with supporting shaft 35 and the suspension mechanism.

Supporting shaft 35 has the axis of rotation of housing 32. Suspension spring 36 (refer to FIG. 21) and the like constitute the suspension mechanism and the suspension mechanism absorbs an impact that is applied to wheel 33.

Housing 32 is provided with motor accommodating portion 32A, spring hook portion 32B, and bearing portion 32C. Motor accommodating portion 32A accommodates traveling motor 31. One end portion of suspension spring 36 is hooked in spring hook portion 32B. Supporting shaft 35 is press-fitted into bearing portion 32C. Wheel 33 is supported by housing 32 to be capable of rotating with respect to housing 32.

One end portion of supporting shaft 35 is press-fitted into bearing portion 32C and the other end portion of supporting shaft 35 is inserted into a bearing portion formed in driving part 120. Because of the coupling of these elements, housing 32 and supporting shaft 35 can rotate with respect to driving part 120 about the axis of rotation of supporting shaft 35.

As illustrated in FIG. 21, the other end portion of suspension spring 36 is hooked in spring hook portion 122 of driving part 120. Suspension spring 36 gives housing 32 a reaction force that acts such that tire 34 (refer to FIG. 16) is pressed against the cleaning surface in the object region. In this manner, a state where tire 34 is grounded on the cleaning surface is maintained.

Once a pressing force toward the body 20 side is applied to tire 34 illustrated in FIG. 16 from the cleaning surface, housing 32 rotates from the cleaning surface side to the body 20 side about the center line of supporting shaft 35 while compressing suspension spring 36 (refer to FIG. 21). In this manner, a force that acts on tire 34 depending on a situation of the surface to be cleaned is absorbed by suspension spring 36.

In the case of derailing of wheel 33, housing 32 rotates with respect to driving part 120 because of the reaction force of suspension spring 36. As a result of the rotation of housing 32, spring hook portion 32B presses derailing detection switch 75. Then, derailing detection switch 75 illustrated in FIG. 21 is turned ON and a signal is output to control unit 70. Control unit 70 stops the traveling of autonomous travel-type cleaner 10 based on the output signal. As a result, an unnatural operation of autonomous travel-type cleaner 10 such as an idle operation can be prevented.

In addition, autonomous travel-type cleaner 10 is provided with, for example, the plurality of floor surface detection sensor 74, obstacle detection sensor 71, distance measurement sensor 72, and collision detection sensor 73 described above as illustrated in FIGS. 21 to 24. Three floor surface detection sensors 74 that are placed on the front side of body 20 with respect to the pair of driving units 30, two floor surface detection sensors 74 that are placed on the rear side of body 20 with respect to the pair of driving units 30, and the like constitute floor surface detection sensor 74.

Front-side floor surface detection sensor 74 is attached to three places such as the center in the front of base 110, right front top portion 23 of base 110, and left front top portion 23 of base 110. As illustrated in FIG. 19, rear-side floor surface detection sensor 74 is attached to two places, one being in the vicinity of right side surface 22 of base 110 and the other being in the vicinity of left side surface 22 of base 110.

As illustrated in FIG. 13, base 110 is provided with a plurality of sensor windows 112 responding to the plurality of floor surface detection sensors 74. Sensor window 112 includes three sensor windows 112 responding to floor surface detection sensors 74 at the center in the front, on the right side in the front, and on the left side in the front described above. In addition, sensor window 112 includes two sensor windows 112 responding to floor surface detection sensors 74 on the right rear side and the left rear side.

Obstacle detection sensor 71 is provided with transmitting unit 71A outputting ultrasonic waves and receiving unit 71B receiving reflected ultrasonic waves. Each of transmitting unit 71A and receiving unit 71B is attached to a back surface of bumper 230 (inner surface side of body 20).

Upper unit 200 is provided with a plurality of windows in addition to cover 210, lid 220, and bumper 230. The plurality of windows include, for example, transmission window 232, reception window 233, and a pair of distance measurement windows 234 illustrated in FIG. 10.

As illustrated in FIG. 19, transmission window 232 is formed in bumper 230 in response to transmitting unit 71A of obstacle detection sensor 71. Accordingly, the ultrasonic waves output from transmitting unit 71A are guided to the outside by transmission window 232 and emitted to the outside.

Reception window 233 is formed in bumper 230 in response to receiving unit 71B of obstacle detection sensor 71. Accordingly, the ultrasonic waves output from transmitting unit 71A and reflected from the surrounding object are guided to receiving unit 71B by reception window 233. As a result, the surrounding object is detected.

Distance measurement windows 234 are formed in bumper 230 in response to respective distance measurement sensors 72. As shown by the dashed-line arrows in FIG. 19, light output from distance measurement sensors 72 is emitted obliquely forward from body 20 after passing through distance measurement windows 234.

Autonomous travel-type cleaner 10 according to this embodiment has the configuration described above.

Hereinafter, a configuration of an electrical system of the autonomous travel-type cleaner according to this embodiment will be described with reference to FIG. 26.

Figure 26:
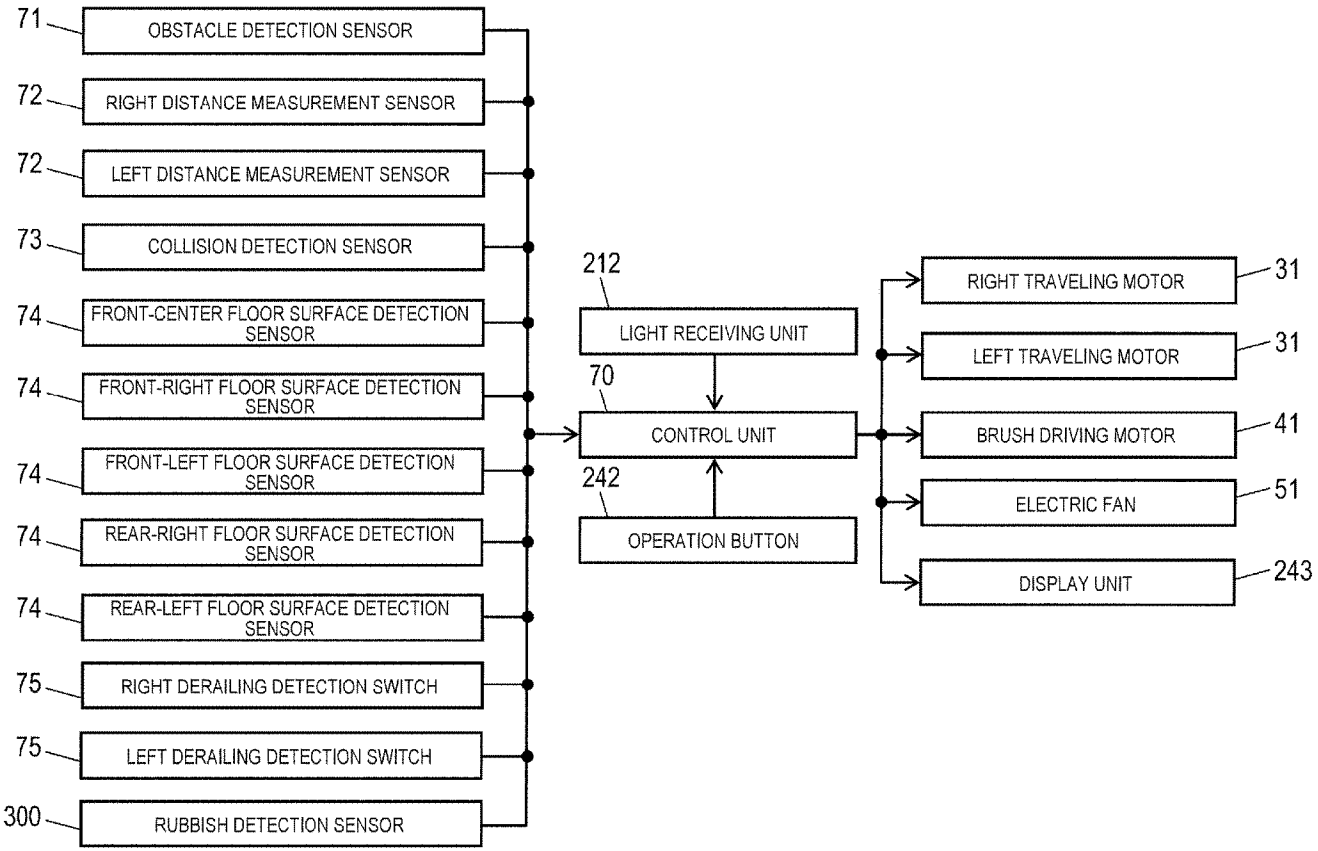
FIG. 26 is a functional block diagram illustrating a configuration of an electrical system in the autonomous travel-type cleaner illustrated in FIG. 10.

FIG. 26 is a functional block diagram illustrating the configuration of the electrical system in the autonomous travel-type cleaner illustrated in FIG. 10.

As illustrated in FIG. 26, control unit 70 is electrically connected to obstacle detection sensor 71, distance measurement sensor 72, collision detection sensor 73, floor surface detection sensor 74, derailing detection switch 75, rubbish detection sensor 300, and the like. In addition, control unit 70 is electrically connected to light receiving unit 212, operation button 242, the pair of traveling motors 31, brush driving motor 41, electric fan 51, and the like. As illustrated in FIG. 17, rubbish detection sensor 300 is placed in the passage in duct 171.

Hereafter, the operation of autonomous travel-type cleaner 10 according to this embodiment will be described in detail.

Firstly, the user turns ON the power supply of autonomous travel-type cleaner 10 by operating operation button 242. Control unit 70 initiates operations of traveling motor 31, brush driving motor 41, and electric fan 51 based on the power supply ON signal.

Driving of electric fan 51 causes the air in rubbish bin 61 illustrated in FIG. 17 to be suctioned by electric fan 51. At the same time, the air in electric fan 51 is discharged around electric fan 51. Then, the air on the bottom surface side of base 110 is suctioned into rubbish bin 61 via suction port 101 and duct 171. Then, the air in fan case 52 is exhausted to the outside from body 20 via the plurality of exhaust ports 211 illustrated in FIG. 10. In other words, the air in a bottom portion of base 110 illustrated in FIG. 17 is discharged to the outside after flowing through suction port 101, duct 171, rubbish bin 61, filter 62, electric fan 51, fan case 52, the space surrounding fan case 52 in body 20, and exhaust port 211 in this order.

Then, control unit 70 sets a traveling route of autonomous travel-type cleaner 10 based on the detection signals input from obstacle detection sensor 71, distance measurement sensor 72, collision detection sensor 73, and floor surface detection sensor 74.

Then, control unit 70 causes autonomous travel-type cleaner 10 to travel in accordance with the set traveling route.

Then, control unit 70 performs the following operation and executes cleaning, similarly to autonomous travel-type cleaner 10 according to Embodiment 1, when corner R3 in the object region is included in the traveling route. In other words, as described with reference to FIGS. 5 to 7, control unit 70 causes corner R3 to be cleaned by causing autonomous travel-type cleaner 10 to travel and turn. In this manner, the rubbish that is present at corner R3 in the object region can be efficiently and reliably suctioned so that the cleaning can be performed.

In other words, autonomous travel-type cleaner 10 according to this embodiment achieves, for example, the following effects in addition to the effects of (1) to (10) achieved by autonomous travel-type cleaner 10 according to Embodiment 2.

(11) Autonomous travel-type cleaner 10 according to this embodiment is provided with R-shaped right front top portion 23, left front top portion 23, and rear top portion 24. According to this configuration, body 20 is capable of softly coming into contact with the surrounding object when body 20 comes into contact with the surrounding object and turns. Accordingly, the occurrence of damage to the surrounding object, damage to autonomous travel-type cleaner 10, and the like can be forestalled.

Embodiment 4

Hereinafter, a control operation of the autonomous travel-type cleaner according to Embodiment 4 will be described with reference to FIG. 27. The configuration of autonomous travel-type cleaner 10 according to Embodiment 4 is substantially identical to the configuration of autonomous travel-type cleaner 10 according to Embodiment 3. Therefore, elements in the description of Embodiment 4 that have the same reference numerals as in Embodiment 3 have functions identical or similar to those of the corresponding elements of Embodiment 3.

Figure 27:
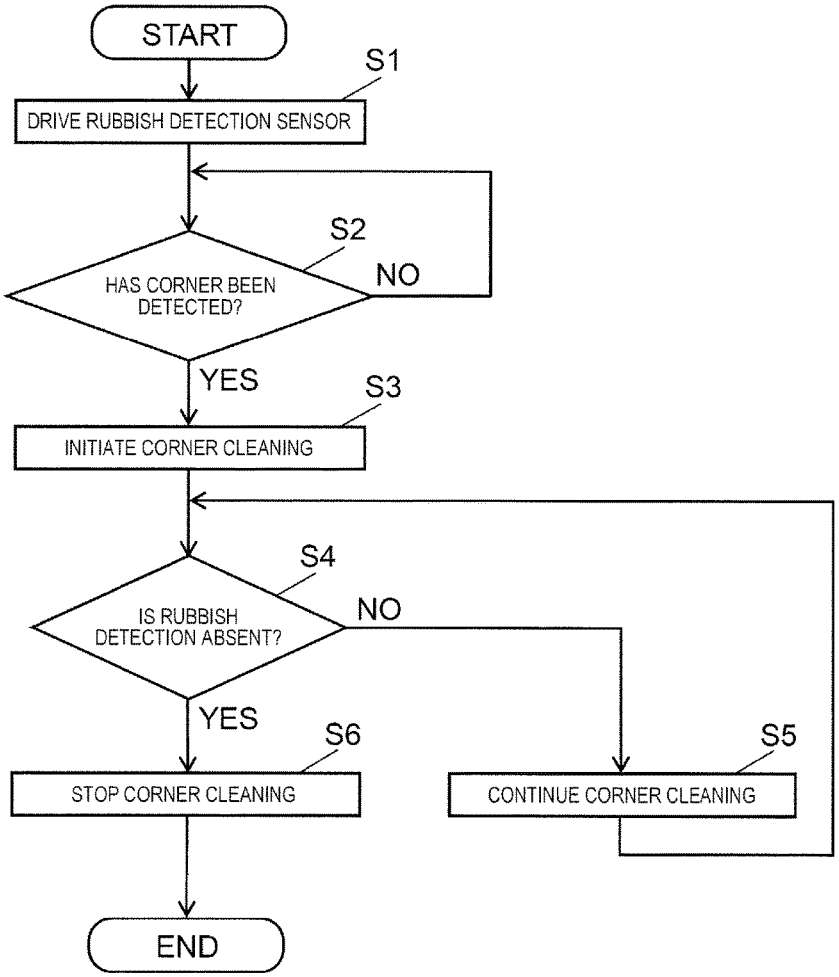
FIG. 27 is a flowchart related to a first corner cleaning control according to Embodiment 4.

FIG. 27 is a flowchart related to a first corner cleaning control of the autonomous travel-type cleaner according to Embodiment 4.

As illustrated in FIG. 27, control unit 70 executes the first corner cleaning control as follows.

Firstly, control unit 70 drives rubbish detection sensor 300 (Step S1). The driving of rubbish detection sensor 300 is initiated at a point in time when, for example, autonomous travel-type cleaner 10 initiates cleaning or a movement.

Then, control unit 70 determines whether or not a corner has been detected in the object region by a corner detection unit (Step S2). The corner corresponds to, for example, corner R3 that is illustrated in FIGS. 5 to 7.

In a case where it is determined that no corner has been detected (NO in Step S2), the processing of Step S2 is repeatedly executed. The first corner cleaning control may be terminated in the case where it is determined that no corner has been detected.

In a case where it is determined that the corner has been detected (YES in Step S2), the processing proceeds to Step S3 and the corner cleaning is initiated.

The above-described determination is executed by the use of the corner detection unit such as obstacle detection sensor 71 and distance measurement sensor 72. Specifically, control unit 70 detects the presence or absence of a wall in front with obstacle detection sensor 71. At the same time, the presence or absence of a wall is detected by right distance measurement sensor 72 or left distance measurement sensor 72. In a case where the wall is detected to be present, control unit 70 determines that autonomous travel-type cleaner 10 has approached the corner.

More specifically, obstacle detection sensor 71 emits the ultrasonic waves to a space around the front from transmission window 232. If the object is present around the front, the ultrasonic wave reflected from the object will enter reception window 233. The ultrasonic wave incident upon reception window 233 is received by receiving unit 71B of obstacle detection sensor 71. In this manner, control unit 70 determines the presence or absence of the wall in front, which is an example of the obstacle, based on the received result.

At the same time, distance measurement sensor 72 emits the light such as the infrared ray to the outside through distance measurement window 234. If the object such as the wall is present therearound at this time, the light will be reflected by the wall. The reflected light is received by distance measurement sensor 72. In this manner, control unit 70 determines whether or not the wall is present nearby by using right distance measurement sensor 72 or left distance measurement sensor 72.

As described above, control unit 70 determines whether or not the corner has been detected based on the detection result of the corner detection unit.

Then, control unit 70 initiates the corner cleaning by autonomous travel-type cleaner 10 (Step S3). At this time, an operation for swinging body 20 to the left and right is executed such that body 20 performs a reciprocating motion in a state where, for example, autonomous travel-type cleaner 10 is stationary without moving forward or rearward. In this manner, the corner is cleaned.

In other words, control unit 70 controls, for example, right traveling motor 31 and left traveling motor 31. Specifically, control unit 70 moves right tire 34 forward and retracts left tire 34. Then, control unit 70 moves left tire 34 forward and retracts right tire 34. Then, this operation is repeated. In this manner, the operation for swinging body 20 of autonomous travel-type cleaner 10 to the left and right is realized and the corner is cleaned.

At this time in Step S3, the presence or absence of the rubbish at the corner needs to be detected for the first time. Therefore, the operation for swinging body 20 to the left and right may be performed, for example, once, twice, or three times. The expression that the operation is performed once means a series of operation starting in the state where body 20 is stationary and ending in a state where body 20 is put back into the stationary state after hitting one wall and then hitting the other wall. The operation being performed once may also be body 20 hitting the other wall from one wall and then hitting one wall again. In any of the above, body 20 returning to a predetermined position after starting at the predetermined position is regarded as one reciprocating motion. Therefore, it is a matter of course that the reciprocating motion may be any operation in which the state described above is realized and is not limited to the definition described above.

Then, control unit 70 determines the absence or presence of rubbish detection by rubbish detection sensor 300 (Step S4). The processing proceeds to Step S6 in a case where it is determined that the rubbish detection is absent (YES in Step S4).

The processing proceeds to Step S5 in a case where it is determined that the rubbish detection is present (NO in Step S4). Control unit 70 determines the presence or absence of the rubbish by executing Step S4 as described above during the execution of Step S3.

Then, control unit 70 continues to perform the corner cleaning pertaining to Step S3 (Step S5) and causes the processing to return to Step S4.

Then, control unit 70 stops the corner cleaning once the rubbish disappears (Step S6). In this manner, control unit 70 terminates the first corner cleaning control of autonomous travel-type cleaner 10.

At this time, control unit 70 may cause the processing to return to Step S2 after the termination of Step S6 and may execute a processing for detecting a next corner until cleaning termination.

In other words, during the first corner cleaning control according to Embodiment 4, the cleaning is performed in line with the swinging of body 20 of autonomous travel-type cleaner 10 to the left and right until rubbish detection sensor 300 detects no rubbish, that is, until the rubbish at the corner disappears. Accordingly, the cleaning can be automatically performed until the removal of the rubbish accumulated at the corner.

Embodiment 5

Hereinafter, a control operation of the autonomous travel-type cleaner according to Embodiment 5 will be described with reference to FIG. 28. The configuration of autonomous travel-type cleaner 10 according to Embodiment 5 is substantially identical to the configuration of autonomous travel-type cleaner 10 according to Embodiment 3. Therefore, elements in the description of Embodiment 5 that have the same reference numerals as in Embodiment 3 have functions identical or similar to those of the corresponding elements of Embodiment 3.

Figure 28:
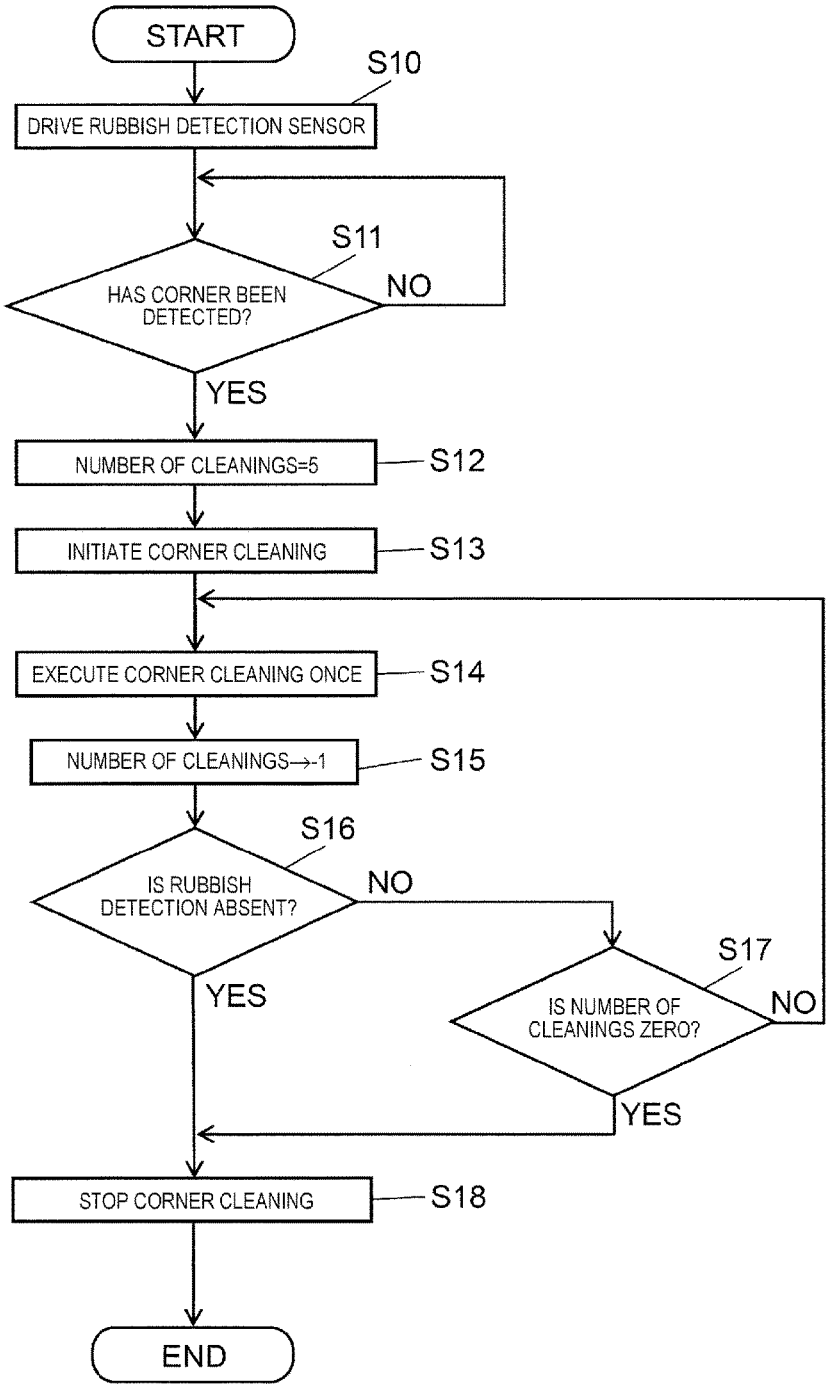
FIG. 28 is a flowchart related to a second corner cleaning control according to Embodiment 5.

FIG. 28 is a flowchart that is related to a second corner cleaning control which is executed by autonomous travel-type cleaner 10 according to Embodiment 5.

As illustrated in FIG. 28, control unit 70 executes the following second corner cleaning control instead of the first corner cleaning control described in Embodiment 4.

Firstly, control unit 70 drives rubbish detection sensor 300 (Step S10). The driving of rubbish detection sensor 300 is initiated at a point in time when, for example, autonomous travel-type cleaner 10 initiates cleaning or a movement.

Then, control unit 70 determines whether or not a corner has been detected in the object region by the corner detection unit (Step S11). In a case where it is determined that no corner has been detected (NO in Step S11), the processing of Step S11 is repeatedly executed. The second corner cleaning control may be terminated in the case where it is determined that no corner has been detected.

In a case where it is determined that the corner has been detected (YES in Step S11), the processing proceeds to Step S12. In Step S11, control unit 70 executes substantially the same processing as Step S2 that is illustrated in FIG. 27.

Then, control unit 70 sets the number of cleanings to, for example, five times, the number of cleanings being the number of the reciprocating motions for swinging body 20 to the left and right, and stores the set information in the storage unit (not illustrated) of control unit 70 (Step S12). The number of cleanings is not limited to five times, and any number of cleanings may be set by a designer or the user. One cleaning is equivalent to one reciprocating operation to the left and right.

Then, control unit 70 initiates the corner cleaning by autonomous travel-type cleaner 10 (Step S13). At this time, the operation for swinging body 20 to the left and right is executed such that body 20 performs the reciprocating motion in the state where, for example, autonomous travel-type cleaner 10 is stationary without moving forward or rearward. In this manner, the corner is cleaned. In Step S13, control unit 70 executes substantially the same processing as Step S3 that is illustrated in FIG. 27.

Then, control unit 70 executes the corner cleaning once (Step S14), the corner cleaning being the operation for swinging body 20 to the left and right.

Then, control unit 70 subtracts one (Step S15) from the number of cleanings stored in the storage unit in Step S12.

Then, control unit 70 determines the absence or presence of rubbish detection by rubbish detection sensor 300 (Step S16). The processing proceeds to Step S18 in a case where it is determined that the rubbish detection is absent (YES in Step S16).

The processing proceeds to Step S17 in a case where it is determined that the rubbish detection is present (NO in Step S16).

Then, control unit 70 determines whether or not the number of cleanings stored in the storage unit is zero (Step S17). The processing returns to Step S14 in a case where the number of cleanings is not zero (NO in Step S17). Then, the processing following Step S14 is similarly executed.

The processing proceeds to Step S18 in a case where the number of cleanings is zero (YES in Step S17).

Then, control unit 70 stops the corner cleaning initiated in Step S13 (Step S18) in a case where the rubbish is absent or has disappeared and once a predetermined number of cleanings have terminated. In this manner, control unit 70 terminates the second corner cleaning control of autonomous travel-type cleaner 10.

At this time, control unit 70 may cause the processing to return to Step S11 after the termination of Step S18 and may execute a processing for detecting a next corner until cleaning termination.

In other words, during the second corner cleaning control according to Embodiment 5, the cleaning is performed by body 20 being swung to the left and right a predetermined number of times in a case where control unit 70 determines that the corner has been detected.

Then, once rubbish detection sensor 300 detects no rubbish, the corner cleaning is terminated even before the predetermined number of the swings of body 20 to the left and right (corresponding to YES in Step S16).

Even in a case where rubbish detection sensor 300 is detecting the rubbish, the corner cleaning is terminated insofar as the operation for swinging body 20 to the left and right the predetermined number of times is terminated (corresponding to YES in Step S17).

In this manner, the corner cleaning is stopped immediately after the removal of the rubbish in a case where a small amount of the rubbish is at the corner. In a case where a large amount of the rubbish is at the corner, the corner cleaning is terminated, despite the rubbish detection by rubbish detection sensor 300, once body 20 is swung to the left and right the predetermined number of times.

In other words, the second corner cleaning control according to Embodiment 5 is to clean a next place with cleaning performed not thoroughly but only to some extent in the case where the amount of the rubbish at the corner is large. Therefore, the second corner cleaning control according to Embodiment 5 is effective as a control operation for a case where the user puts the length of time required for the cleaning before thorough corner cleaning.

Embodiment 6

Hereinafter, a control operation of the autonomous travel-type cleaner according to Embodiment 6 will be described with reference to FIG. 29. The configuration of autonomous travel-type cleaner 10 according to Embodiment 6 is substantially identical to the configuration of autonomous travel-type cleaner 10 according to Embodiment 3. Therefore, elements in the description of Embodiment 6 that have the same reference numerals as in Embodiment 3 have functions identical or similar to those of the corresponding elements of Embodiment 3.

Figure 29:
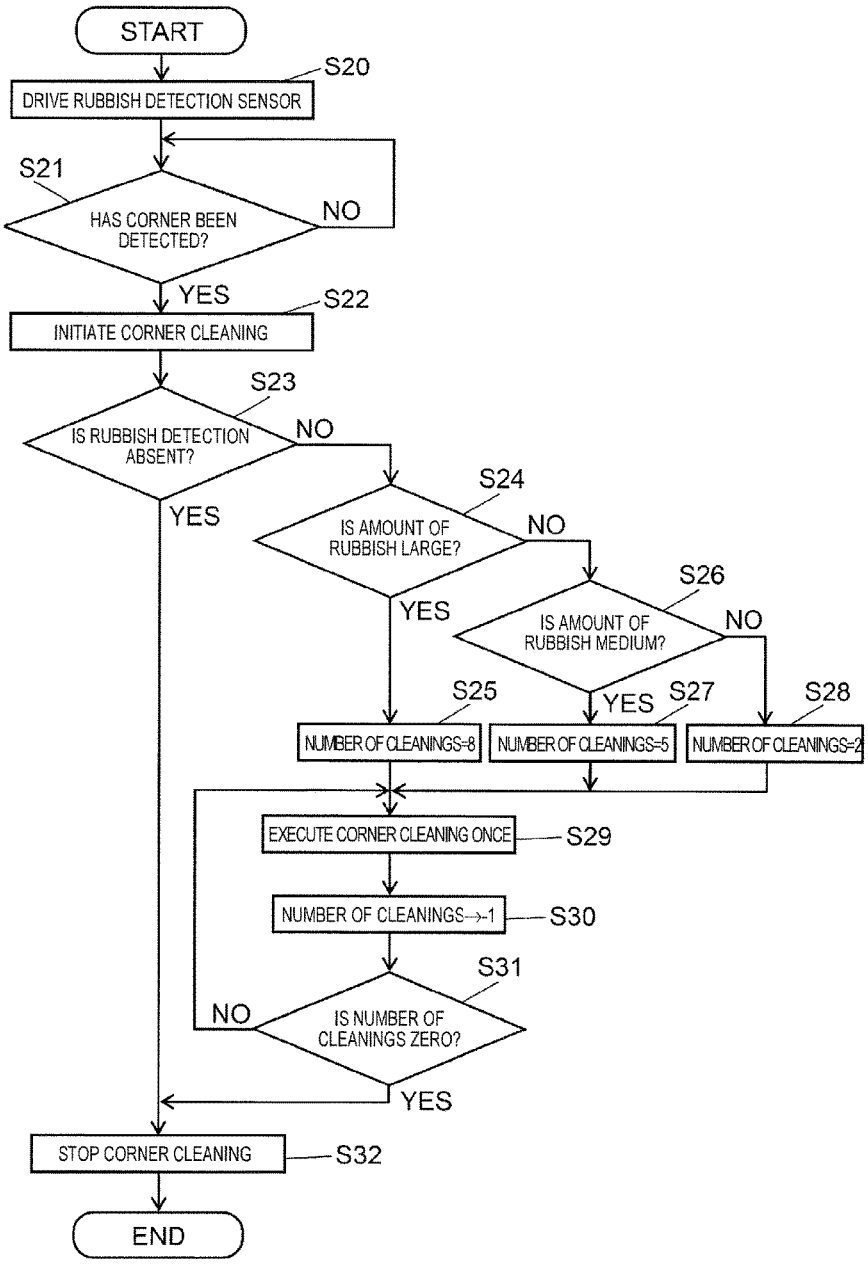
FIG. 29 is a flowchart related to a third corner cleaning control according to Embodiment 6.

FIG. 29 is a flowchart that is related to a third corner cleaning control which is executed by autonomous travel-type cleaner 10 according to Embodiment 6.

As illustrated in FIG. 29, control unit 70 executes the following third corner cleaning control instead of the first corner cleaning control described in Embodiment 4 and the second corner cleaning control described in Embodiment 5.

Firstly, control unit 70 drives rubbish detection sensor 300 (Step S20). The driving of rubbish detection sensor 300 is initiated at a point in time when, for example, autonomous travel-type cleaner 10 initiates cleaning or a movement.

Then, control unit 70 determines whether or not a corner has been detected in the object region by the corner detection unit (Step S21). In a case where it is determined that no corner has been detected (NO in Step S21), the processing of Step S21 is repeatedly executed. The third corner cleaning control may be terminated in the case where it is determined that no corner has been detected.

In a case where it is determined that the corner has been detected (YES in Step S21), the processing proceeds to Step S22. In Step S21, control unit 70 executes substantially the same processing as Step S2 that is illustrated in FIG. 27.

Then, control unit 70 initiates the corner cleaning by autonomous travel-type cleaner 10 (Step S22). At this time, the operation for swinging body 20 to the left and right is executed such that body 20 performs the reciprocating motion in the state where, for example, autonomous travel-type cleaner 10 is stationary without moving forward or rearward. In this manner, the corner is cleaned. In Step S22, control unit 70 executes substantially the same processing as Step S3 that is illustrated in FIG. 27.

Then, control unit 70 determines the absence or presence of rubbish detection by rubbish detection sensor 300 (Step S23). The processing proceeds to Step S32 in a case where it is determined that the rubbish detection is absent (YES in Step S23).

The processing proceeds to Step S24 in a case where it is determined that the rubbish detection is present (NO in Step S23).

Then, control unit 70 determines whether or not the amount of the rubbish detected by rubbish detection sensor 300 is large (Step S24). The processing proceeds to Step S25 in a case where the amount of the rubbish is large (YES in Step S24). The processing proceeds to Step S26 in a case where the amount of the rubbish is not large (NO in Step S24).

In the third corner cleaning control, determination references of large, medium, and small are set in advance depending on the amount of the rubbish detected per unit time or the like by rubbish detection sensor 300. However, the present invention is not limited thereto. For example, the amounts of the rubbish corresponding to large, medium, and small may be appropriately changed by the designer or the user.

Then, control unit 70 sets the number of cleanings to, for example, eight times, the number of cleanings being the number of the reciprocating motions for swinging body 20 to the left and right, in the case of a large rubbish amount. Then, control unit 70 stores the set information in the storage unit (not illustrated) of control unit 70 (Step S25). The number of cleanings is not limited to eight times, and any number of cleanings may be set by the designer or the user.

In a case where the amount of the rubbish is not large, control unit 70 determines whether or not the amount of the rubbish detected by rubbish detection sensor 300 is medium (Step S26). The processing proceeds to Step S27 in the case of a medium rubbish amount (YES in Step S26). The processing proceeds to Step S28 in a case where the amount of the rubbish is not medium (NO in Step S26). In the case where the amount of the rubbish is not medium, it is determined that the amount of the rubbish is small.

Then, control unit 70 sets the number of cleanings to, for example, five times in the case of the medium rubbish amount. Then, control unit 70 stores the set information in the storage unit of control unit 70 (Step S27). The number of cleanings is not limited to five times, and any number of cleanings may be set by the designer or the user.

Then, control unit 70 sets the number of cleanings to, for example, twice in the case where the amount of the rubbish is not medium. Then, control unit 70 stores the set information in the storage unit of control unit 70 (Step S28). The number of cleanings is not limited to twice, and any number of cleanings may be set by the designer or the user.

Control unit 70 sets the number of cleanings in accordance with the large, medium, or small rubbish amount through the steps described above. Then, the processing proceeds to Step S29.

Then, the processing proceeds to Step S30 after control unit 70 executes the corner cleaning once (Step S29), the corner cleaning being the operation for swinging body 20 to the left and right. Then, the processing proceeds to Step S31 after control unit 70 subtracts one (Step S30) from the number of cleanings stored in the storage unit in Step S25, Step S27, or Step S28.

Then, control unit 70 determines whether or not the number of cleanings stored in the storage unit in Step S25, Step S27, or Step S28 is zero (Step S31). The processing returns to Step S29 in a case where the number of cleanings is not zero (NO in Step S31).

The processing proceeds to Step S32 in a case where the number of cleanings is zero (YES in Step S31).

Then, control unit 70 stops the corner cleaning initiated in Step S22 (Step S32) at the time of no rubbish detection or termination of the cleanings with the number thereof set in accordance with the amount of the rubbish. In this manner, control unit 70 terminates the third corner cleaning control of autonomous travel-type cleaner 10.

At this time, control unit 70 may cause the processing to return to Step S21 after the termination of Step S32 and may execute a processing for detecting a next corner until cleaning termination.

In other words, in the third corner cleaning control according to Embodiment 6, the number of the swings of body 20 to the left and right is set in accordance with the amount of the rubbish detected by rubbish detection sensor 300 during the corner cleaning.

Then, the control is performed such that the corner is cleaned by the set number of the swings of body 20 to the left and right being performed.

In this manner, an operation for meticulously cleaning the corner in the event of a large rubbish amount and for simply cleaning the corner in the event of a small rubbish amount can be realized.

Embodiment 7

Hereinafter, a control operation of the autonomous travel-type cleaner according to Embodiment 7 will be described with reference to FIG. 30. The configuration of autonomous travel-type cleaner 10 according to Embodiment 7 is substantially identical to the configuration of autonomous travel-type cleaner 10 according to Embodiment 3. Therefore, elements in the description of Embodiment 7 that have the same reference numerals as in Embodiment 3 have functions identical or similar to those of the corresponding elements of Embodiment 3.

Figure 30:
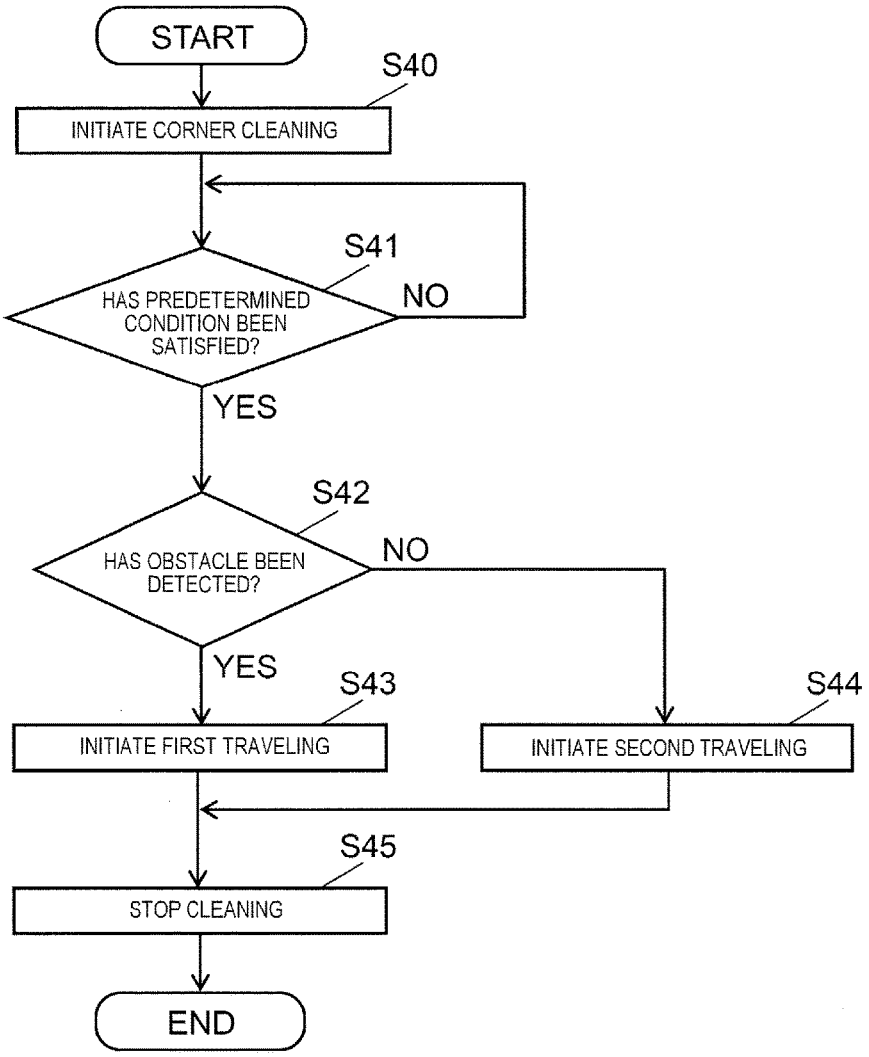
FIG. 30 is a flowchart related to a fourth corner cleaning control according to Embodiment 7.

FIG. 30 is a flowchart that is related to a fourth corner cleaning control which is executed by autonomous travel-type cleaner 10 according to Embodiment 7.

As illustrated in FIG. 30, control unit 70 executes the following fourth corner cleaning control instead of the first to third corner cleaning controls shown in Embodiments 4 to 6.

Firstly, control unit 70 initiates cleaning in the object region (Step S40).

Then, control unit 70 determines whether or not predetermined conditions have been satisfied (Step S41). A first predetermined condition is, for example, a case where a state where a value detected by distance measurement sensor 72 is equal to or less than a predetermined value continues for at least a predetermined period of time. A second predetermined condition is a case where the obstacle has been detected by obstacle detection sensor 71. In a case where the first condition and the second condition have been satisfied, control unit 70 determines that the predetermined conditions have been satisfied and executes the following control.

In a case where it is determined that the predetermined conditions have not been satisfied (NO in Step S41), the processing of Step S41 is repeatedly executed.

In a case where it is determined that the predetermined conditions have been satisfied (YES in Step S41), the processing proceeds to Step S42. The satisfaction of the predetermined conditions implies that body 20 has moved to the corner in the object region.

Then, control unit 70 determines whether or not the obstacle has been detected by obstacle detection sensor 71 (Step S42).

The processing proceeds to Step S43 in a case where it is determined that the obstacle has been detected (YES in Step S42).

In a case where it is determined that the obstacle has not been detected (NO in Step S42), the processing proceeds to Step S44. A case where, for example, the detected obstacle has been removed after the detection of the obstacle in Step S41 is conceivable as the case of no obstacle detection in Step S42.

In the case of obstacle detection, control unit 70 initiates a first traveling of body 20 (Step S43). The first traveling is, for example, an operation in which one of tires 34 and the other tire 34 rotate in opposite directions. This is equivalent to traveling for turning body 20. In this case, body 20 turns at the corner, and thus the corner becomes likely to be cleaned. In Step S43, the first traveling operation of body 20 continues to be executed even in the event of detection of a collision between body 20 and the object by collision detection sensor 73.

In the case of no obstacle detection, control unit 70 initiates a second traveling of body 20 (Step S44). The second traveling is, for example, an operation in which one of tires 34 and the other tire 34 rotate in the same direction. This is equivalent to traveling for causing body 20 to move forward or retract.

Once a predetermined traveling operation of body 20 terminates, control unit 70 stops the cleaning in the object region (Step S45). In this manner, control unit 70 terminates the fourth corner cleaning control of autonomous travel-type cleaner 10. The fourth corner cleaning control may be repeatedly executed until the cleaning in the object region is completed.

With the control operation of autonomous travel-type cleaner 10 according to Embodiment 7, the following effects are achieved in addition to the effects of (1) to (11) achieved by autonomous travel-type cleaner 10 according to Embodiment 3.

(12) Autonomous travel-type cleaner 10 according to this embodiment detects the corner before the contact between body 20 and the obstacle by using the corner detection unit including obstacle detection sensor 71 and distance measurement sensor 72. Therefore, body 20 and the obstacle are unlikely to come into contact with each other in a case where the corner is cleaned by body 20 being turned.

(13) In a case where, for example, the obstacle has been removed after the detection of the obstacle by obstacle detection sensor 71 of autonomous travel-type cleaner 10 according to this embodiment, body 20 is moved forward or retracted without detouring around a region where the obstacle was placed. Therefore, the region where the obstacle was placed can also be cleaned.

(14) In the case of turning of body 20 of autonomous travel-type cleaner 10 according to this embodiment, body 20 continues to turn even in the event of a collision between body 20 and the object. Therefore, the corner can be sufficiently cleaned compared to a case where the cleaning is stopped once body 20 and the object come into contact with each other.

Embodiment 8

Hereinafter, a control operation of the autonomous travel-type cleaner according to Embodiment 8 will be described with reference to FIG. 31. The configuration of autonomous travel-type cleaner 10 according to Embodiment 8 is substantially identical to the configuration of autonomous travel-type cleaner 10 according to Embodiment 3. Therefore, elements in the description of Embodiment 8 that have the same reference numerals as in Embodiment 3 have functions identical or similar to those of the corresponding elements of Embodiment 3.

Figure 31:
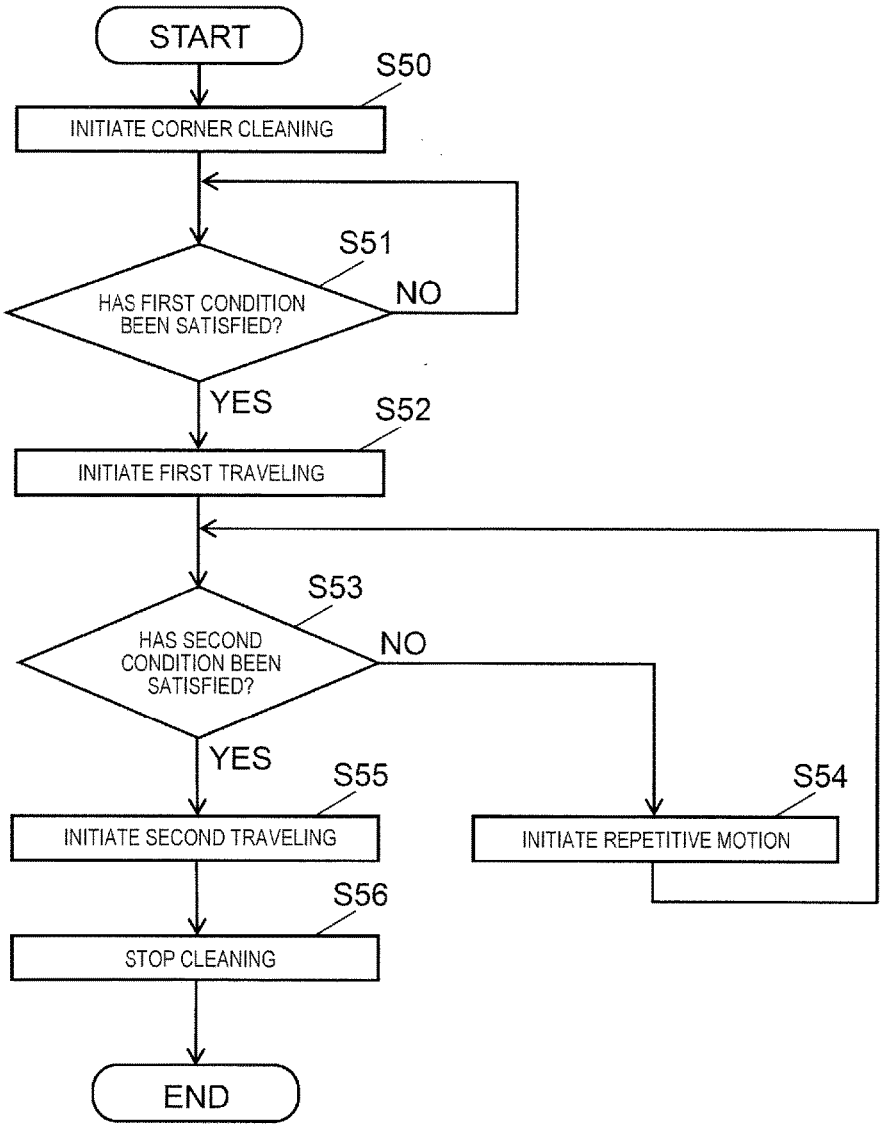
FIG. 31 is a flowchart related to a first escape control according to Embodiment 8.

FIG. 31 is a flowchart that is related to a first escape control which is executed by autonomous travel-type cleaner 10 according to Embodiment 8.

As illustrated in FIG. 31, control unit 70 executes the first escape control as follows.

Firstly, control unit 70 initiates cleaning in the object region (Step S50).

Then, control unit 70 determines whether or not the first condition has been satisfied (Step S51). The first condition is a condition that is substantially the same as the predetermined condition pertaining to Step S41 and described with reference to FIG. 30 in Embodiment 7.

The processing of Step S51 is repeatedly executed in a case where it is determined that the first condition has not been satisfied (NO in Step S51).

The processing proceeds to Step S52 in a case where it is determined that the first condition has been satisfied (YES in Step S51). The satisfaction of the first condition implies that body 20 has moved to the corner in the object region.

Then, control unit 70 initiates the first traveling of body 20 (Step S52). The first traveling is a traveling that is substantially the same as the first traveling pertaining to Step S43 and described with reference to FIG. 30 in Embodiment 7. In this case, the corner becomes likely to be cleaned by body 20 turning at the corner.

Then, control unit 70 determines whether or not the second condition has been satisfied (Step S53). The second condition is, for example, a case where no collision between body 20 and the object is detected by collision detection sensor 73 in a state where no obstacle is detected by obstacle detection sensor 71. Then, control unit 70 executes the following control based on the second condition determination result.

The processing proceeds to Step S54 in a case where it is determined that the second condition has not been satisfied (NO in Step S53). The non-satisfaction of the second condition implies, for example, body 20 being stuck at the corner.

The processing proceeds to Step S55 in a case where it is determined that the second condition has been satisfied (YES in Step S53).

In the case of the non-satisfaction of the second condition, control unit 70 causes body 20 to initiate a repetitive motion (Step S54). In the repetitive motion, one of tires 34 that is, for example, on the side which is close to the part of contact between body 20 and the object is stopped and the other tire 34 is retracted first. Then, the other tire 34 is stopped and one tire 34 is moved forward in the case of a further collision of body 20 with another part of the object or another object resulting from the retraction of the other tire 34. Furthermore, one tire 34 is stopped and the other tire 34 is retracted in the case of a further collision of body 20 with another part of the object or another object resulting from the forward movement of one tire 34. In other words, body 20 can be caused to execute the repetitive motion by the operation described above being repeated.

During the repetitive motion of body 20 in Step S54, control unit 70 executes, for example, the processing of Step S53 after the elapse of a predetermined period of time (such as two seconds) following the start of the operation for stopping one tire 34 and retracting the other tire 34. Then, body 20 continues to perform the repetitive motion in Step S54 until the second condition is satisfied in Step S53.

Then, control unit 70 initiates the second traveling of body 20 (Step S55) in the case of the satisfaction of the second condition. The second traveling is a traveling that is substantially the same as the second traveling pertaining to Step S44 and described with reference to FIG. 30 in Embodiment 7. Specifically, the second traveling is a traveling for moving body 20 forward. In this manner, body 20 stuck at the corner is allowed to escape from the corner.

Control unit 70 stops the cleaning in the object region (Step S56) once body 20 escapes from the corner. In this manner, control unit 70 terminates the first escape control of autonomous travel-type cleaner 10. The first escape control may be repeatedly executed until the cleaning in the object region is completed.

With the control operation of autonomous travel-type cleaner 10 according to Embodiment 8, the following effect is achieved in addition to the effects of (1) to (11) achieved by autonomous travel-type cleaner 10 according to Embodiment 3.

(15) Autonomous travel-type cleaner 10 according to this embodiment executes the first escape control in a case where body 20 is stuck at the corner during the cleaning of the corner. At this time, the angle (relative position) of body 20 with respect to the corner gradually changes because of the execution of the repetitive motion of body 20. Therefore, body 20 can change its direction and easily escape from the corner despite body 20 being stuck at the corner.

Embodiment 9

Hereinafter, a control operation of the autonomous travel-type cleaner according to Embodiment 9 will be described with reference to FIG. 32. The configuration of autonomous travel-type cleaner 10 according to Embodiment 9 is substantially identical to the configuration of autonomous travel-type cleaner 10 according to Embodiment 3. Therefore, elements in the description of Embodiment 9 that have the same reference numerals as in Embodiment 3 have functions identical or similar to those of the corresponding elements of Embodiment 3.

Figure 32:
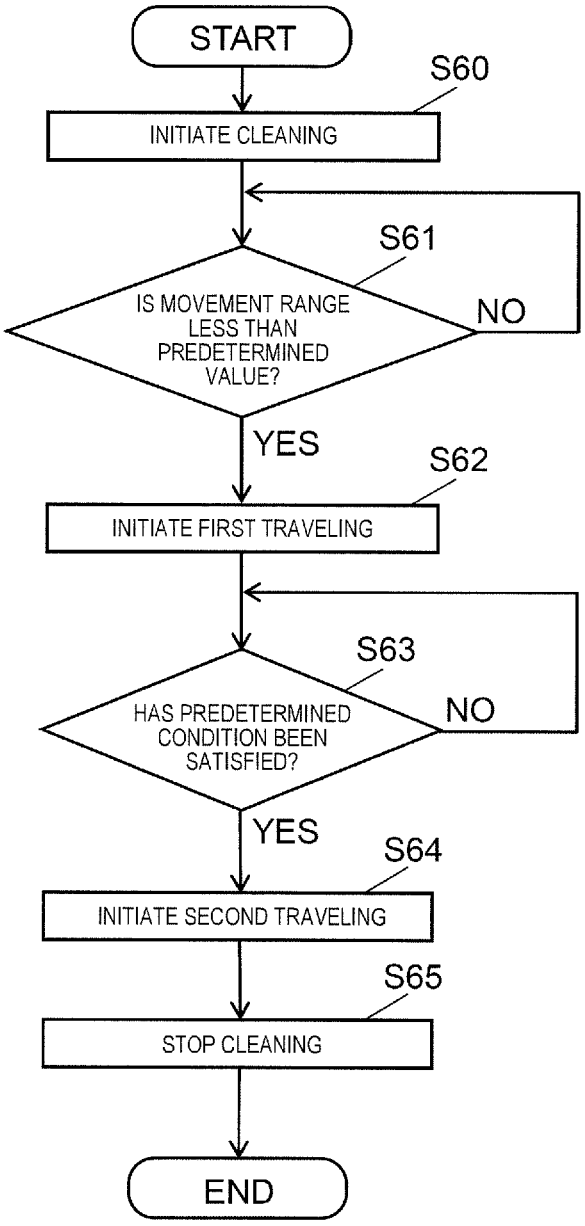
FIG. 32 is a flowchart related to a second escape control according to Embodiment 9.

FIG. 32 is a flowchart that is related to a second escape control which is executed by autonomous travel-type cleaner 10 according to Embodiment 9.

As illustrated in FIG. 32, control unit 70 executes the following second escape control instead of the first escape control shown in Embodiment 8.

Firstly, control unit 70 initiates cleaning in the object region (Step S60).

Then, control unit 70 determines whether or not a movement range of body 20 at a predetermined time is less than a predetermined value (Step S61). The movement range of body 20 is calculated based on, for example, the rotation speed of wheel 33 that is detected by a rotation sensor (not illustrated) attached to wheel 33 and the traveling direction of body 20 that is detected by a gyro sensor (not illustrated) placed in body 20.

The processing of Step S61 is repeatedly executed in a case where it is determined that the movement range of body 20 is not less than the predetermined value (NO in Step S61).

The processing proceeds to Step S62 in a case where it is determined that the movement range of body 20 is less than the predetermined value (YES in Step S61). The case where the movement range of body 20 at the predetermined time is less than the predetermined value implies that body 20 has moved to the corner in the object region.

Then, control unit 70 initiates the first traveling of body 20 (Step S62). The first traveling is a traveling that is substantially the same as the first traveling pertaining to Step S43 and described with reference to FIG. 30 in Embodiment 7. In this case, the corner becomes likely to be cleaned by body 20 turning at the corner.

Then, control unit 70 determines whether or not the predetermined condition has been satisfied (Step S63). The predetermined condition is a condition that is substantially the same as the predetermined condition pertaining to Step S41 and described with reference to FIG. 30 in Embodiment 7.

The processing of Step S63 is repeatedly executed in a case where it is determined that the predetermined condition has not been satisfied (NO in Step S63).

The processing proceeds to Step S64 in a case where it is determined that the predetermined condition has been satisfied (YES in Step S63). In the case of the satisfaction of the predetermined condition, body 20 is in a state where body 20 is directed to be capable of escaping from the corner.

In the case of the satisfaction of the predetermined condition, control unit 70 initiates the second traveling of body 20 (Step S64) in the state where body 20 is directed to be capable of escaping from the corner. The second traveling is a traveling that is substantially the same as the second traveling pertaining to Step S44 and described with reference to FIG. 30 in Embodiment 7. This is equivalent to a traveling for moving body 20 forward. In this manner, body 20 stuck at the corner is allowed to escape from the corner.

Control unit 70 stops the cleaning in the object region (Step S65) once body 20 escapes from the corner. In this manner, control unit 70 terminates the second escape control of autonomous travel-type cleaner 10. The second escape control may be repeatedly executed until the cleaning in the object region is completed.

With the control operation of autonomous travel-type cleaner 10 according to Embodiment 9, the following effect is achieved in addition to the effects of (1) to (11) achieved by autonomous travel-type cleaner 10 according to Embodiment 3.

(16) Autonomous travel-type cleaner 10 according to this embodiment detects body 20 being stuck at the corner or the like from the movement range of body 20 at a predetermined time. Then, in a case where body 20 is stuck at the corner, for example, body 20 is allowed to travel in a direction that allows body 20 to escape from the corner by obstacle detection sensor 71 and distance measurement sensor 72. Accordingly, body 20 and the object are unlikely to come into contact with each other during the escape.

Embodiment 10

Hereinafter, a control operation of the autonomous travel-type cleaner according to Embodiment 10 will be described with reference to FIG. 33. The configuration of autonomous travel-type cleaner 10 according to Embodiment 10 is substantially identical to the configuration of autonomous travel-type cleaner 10 according to Embodiment 3. Therefore, elements in the description of Embodiment 10 that have the same reference numerals as in Embodiment 3 have functions identical or similar to those of the corresponding elements of Embodiment 3.

Autonomous travel-type cleaner 10 according to Embodiment 10 is also provided with a first rotation sensor (not illustrated) and a second rotation sensor (not illustrated). The first rotation sensor is attached to wheel 33 and detects the rotation speed of wheel 33. The second rotation sensor is attached to caster 90 and detects the rotation speed of caster 90.

Figure 33:
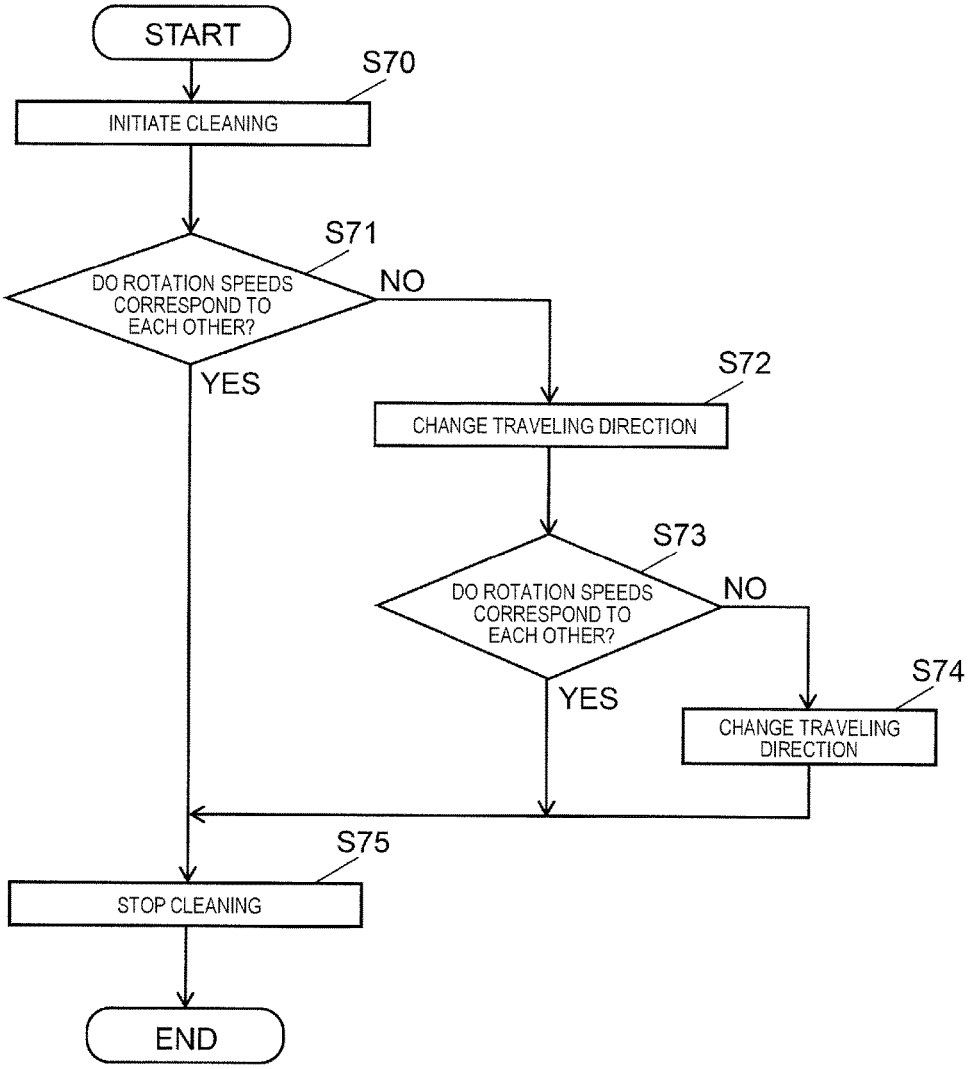
FIG. 33 is a flowchart related to a step control according to Embodiment 10.

FIG. 33 is a flowchart that is related to a step control which is executed by autonomous travel-type cleaner 10 according to Embodiment 10.

As illustrated in FIG. 33, control unit 70 executes the step control as follows.

Firstly, control unit 70 initiates cleaning in the object region (Step S70).

Then, control unit 70 determines whether or not the rotation speed of wheel 33 detected by the first rotation sensor and the rotation speed of caster 90 detected by the second rotation sensor correspond to each other (Step S71).

The processing proceeds to Step S75 in a case where it is determined that the rotation speed of wheel 33 and the rotation speed of caster 90 correspond to each other (YES in Step S71).

The processing proceeds to Step S72 in a case where it is determined that the rotation speed of wheel 33 and the rotation speed of caster 90 do not correspond to each other (NO in Step S71). The case where the rotation speed of wheel 33 and the rotation speed of caster 90 do not correspond to each other implies a state where wheel 33 or caster 90 has slipped due to the step or the like.

Control unit 70 changes the traveling direction of body 20 (Step S72). Specifically, control unit 70 changes the traveling direction of body 20 such that the traveling direction becomes askew with respect to the traveling direction of body 20 pertaining to Step S71. Then, body 20 is allowed to move in obliquely with respect to, for example, the step that is likely to result in the slipping. As a result, body 20 becomes likely to ride over the step.

Then, control unit 70 determines whether or not the rotation speed of wheel 33 detected by the first rotation sensor and the rotation speed of caster 90 detected by the second rotation sensor correspond to each other (Step S73). The processing of Step S73 is a processing substantially the same as the processing of Step S71.

The processing proceeds to Step S75 in a case where it is determined that the rotation speed of wheel 33 and the rotation speed of caster 90 correspond to each other (YES in Step S73).

The processing proceeds to Step S74 in a case where it is determined that the rotation speed of wheel 33 and the rotation speed of caster 90 do not correspond to each other (NO in Step S73).

In the case where the rotation speeds do not correspond to each other, control unit 70 changes the traveling direction of body 20 again (Step S74). Specifically, control unit 70 changes the traveling direction of body 20 to a direction that differs from the traveling direction of body 20 in Step S71 or Step S72, examples of which include the direction opposite to the traveling direction of body 20 in Step S71 or Step S72. Then, body 20 becomes more likely to ride over, for example, the step that is likely to result in the slipping.

Then, control unit 70 stops the cleaning in the object region (Step S75). In this manner, control unit 70 terminates the step control of autonomous travel-type cleaner 10. The step control may be repeatedly executed until the cleaning in the object region is completed.

With the control operation of autonomous travel-type cleaner 10 according to Embodiment 10, the following effects are achieved in addition to the effects of (1) to (11) achieved by autonomous travel-type cleaner 10 according to Embodiment 3.

(17) The first rotation sensor and the second rotation sensor of autonomous travel-type cleaner 10 according to this embodiment detects the slipping of wheel 33 or caster 90 when, for example, the step is ridden over. In the case of slip detection, the traveling direction is changed and body 20 is caused to move in, for example, obliquely with respect to the step. Accordingly, the step is more likely to be ridden over than in a case where body 20 is moved straight to the step.

(18) According to autonomous travel-type cleaner 10 of this embodiment, body 20 is caused to travel in the opposite direction to the step in a case where, for example, the state of slipping continues despite the oblique movement of body 20 with respect to the step. Accordingly, the step can be avoided. As a result, it can become more difficult for body 20 to be stuck at the step.

Embodiment 11

Hereinafter, a control operation of the autonomous travel-type cleaner according to Embodiment 11 will be described with reference to FIG. 34. The configuration of autonomous travel-type cleaner 10 according to Embodiment 11 is substantially identical to the configuration of autonomous travel-type cleaner 10 according to Embodiment 3. Therefore, elements in the description of Embodiment 11 that have the same reference numerals as in Embodiment 3 have functions identical or similar to those of the corresponding elements of Embodiment 3.

Figure 34:
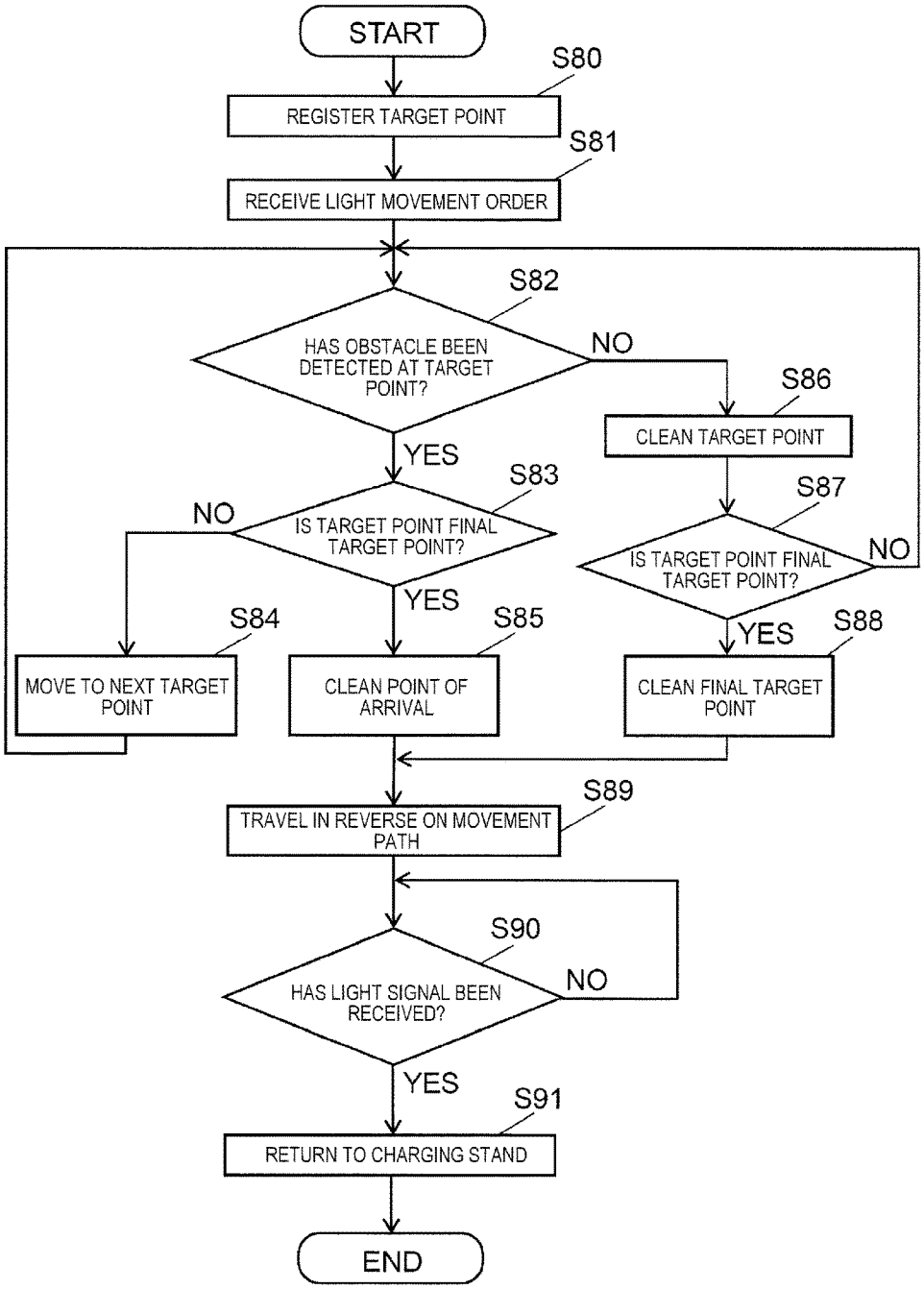
FIG. 34 is a flowchart related to a designated region cleaning control according to Embodiment 11.

FIG. 34 is a flowchart that is related to a designated region cleaning control which is executed by autonomous travel-type cleaner 10 according to Embodiment 11.

As illustrated in FIG. 34, control unit 70 executes the designated region cleaning control as follows.

Firstly, control unit 70 registers a target point or a plurality of target points on a path of movement of body 20 (Step S80). In this embodiment, control unit 70 registers the plurality of target points on the path of movement of body 20 in, for example, the storage unit.

Specifically, control unit 70 stores a distance and an angle with respect to a reference position for each target point on the path of movement of body 20 based on a signal output from the remote controller. The reference position is the position of the charging stand, which is a start point, or the immediately preceding target point. In this manner, control unit 70 can store a cleaning region that is designated by the user.

Then, control unit 70 receives light information related to a movement order from the remote controller with light receiving unit 212 (Step S81). In this manner, control unit 70 moves body 20 along the plurality of registered target points. In a case where, for example, an obstacle is detected on the movement path by obstacle detection sensor 71 at this time, control unit 70 moves body 20 so that body 20 deviates from the movement path as will be described later. Then, control unit 70 performs a control so that body 20 is back on the movement path after the obstacle is avoided.

In other words, control unit 70 determines whether or not the obstacle has been detected at the target point by using obstacle detection sensor 71 (Step S82). The processing proceeds to Step S83 in a case where it is determined that the obstacle has been detected at the target point (YES in Step S82).

Then, control unit 70 determines whether or not the target point that is present at a position which is superposed on the position of the obstacle detected in the processing of Step S82 is a final target point (Step S83). The final target point is a target point that shows an end point of the movement path of body 20. The processing proceeds to Step S85 in a case where it is determined that the target point is the final target point (YES in Step S83).

The processing proceeds to Step S84 in a case where it is determined that the target point is not the final target point (NO in Step S83).

Then, control unit 70 causes body 20 to move toward the next target point without passing through the target point where the obstacle is present (Step S84). After moving body 20 to the next target point, control unit 70 allows the processing to return to Step S82.

Then, control unit 70 causes the point of arrival, which is a point that is actually reached, to be cleaned (Step S85) in a case where obstacle detection sensor 71 detects that the obstacle is present at the final target point.

The processing proceeds to Step S86 in a case where it is determined that no obstacle is detected at the target point (NO in Step S82). Then, control unit 70 causes the target point to be cleaned (Step S86).

Then, control unit 70 determines whether or not the target point cleaned in the processing of Step S86 is the final target point (Step S87). The processing returns to Step S82 in the case of a determination that the target point is not the final target point (NO in Step S87). Then, a similar processing is executed.

The processing proceeds to Step S88 in the case of a determination that the target point is the final target point (YES in Step S87).

Then, control unit 70 causes body 20 to clean the final target point (Step S88). In this manner, the plurality of target points can be cleaned in order.

After the cleaning of the final target point, control unit 70 causes body 20 to travel in reverse (Step S89) so that body 20 moves in reverse on the movement path and reaches the target point.

Then, control unit 70 determines whether or not light receiving unit 212 has received the light signal output from the charging stand (Step S90). The processing of Step S90 is repeatedly executed in a case where it is determined that light receiving unit 212 has not received the light signal (NO in Step S90).

The processing proceeds to Step S91 in a case where it is determined that light receiving unit 212 has received the light signal (YES in Step S90).

In this case, control unit 70 causes body 20 to deviate from the movement path on which the reverse traveling is performed. Then, control unit 70 causes autonomous travel-type cleaner 10 to return to the charging stand based on the signal output from the charging stand (Step S91). In this manner, the control unit terminates the designated region cleaning control of autonomous travel-type cleaner 10.

With the control operation of autonomous travel-type cleaner 10 according to Embodiment 11, the following effects are achieved in addition to the effects of (1) to (11) achieved by autonomous travel-type cleaner 10 according to Embodiment 3.

(19) Autonomous travel-type cleaner 10 according to this embodiment stores the target point to be cleaned in advance. Accordingly, any region of the object region that is set by the user or the like can be cleaned. Therefore, efficient cleaning can be executed by autonomous travel-type cleaner 10.

(20) In a case where the obstacle is present on one target point, body 20 of autonomous travel-type cleaner 10 according to this embodiment is moved toward the next target point without passing through that target point. Therefore, any region of the object region is more likely to be cleaned than in a control operation configuration in which the cleaning is terminated in a case where it is impossible to pass through one target point.

(21) In a case where it has been impossible to reach the final target point due to the obstacle or the like, autonomous travel-type cleaner 10 according to this embodiment cleans the point that has been actually reached. Therefore, a wider region can be cleaned than in a case where the cleaning is terminated in a case where the final target point cannot be reached.

(22) In the case of returning to the charging stand following the arrival at the final target point, autonomous travel-type cleaner 10 according to this embodiment performs the reverse traveling on the movement path until the light signal output from the charging stand is received. Therefore, the returning toward the charging stand can be performed on an appropriate path.

Embodiment 12

Hereinafter, a control operation of the autonomous travel-type cleaner according to Embodiment 12 will be described with reference to FIG. 35. The configuration of autonomous travel-type cleaner 10 according to Embodiment 12 is substantially identical to the configuration of autonomous travel-type cleaner 10 according to Embodiment 3. Therefore, elements in the description of Embodiment 12 that have the same reference numerals as in Embodiment 3 have functions identical or similar to those of the corresponding elements of Embodiment 3.

Figure 35:
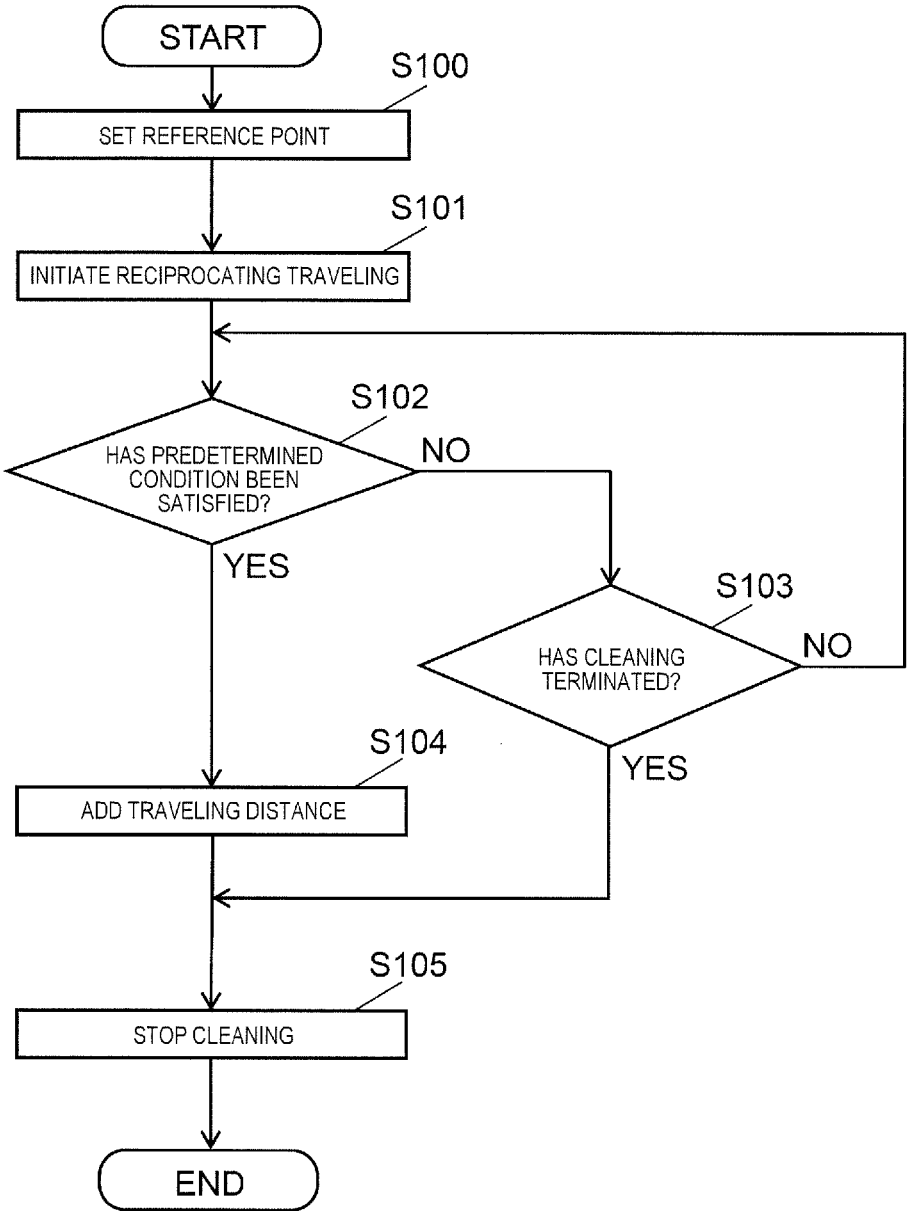
FIG. 35 is a flowchart related to a reciprocating cleaning control according to Embodiment 12.

FIG. 35 is a flowchart that is related to a reciprocating cleaning control which is executed by autonomous travel-type cleaner 10 according to Embodiment 12.

As illustrated in FIG. 35, control unit 70 executes the reciprocating cleaning control as follows.

Firstly, control unit 70 sets a reference point or a reference line in the object region (Step S100). In this embodiment, control unit 70 sets, for example, the reference point in the object region.

Then, control unit 70 initiates a reciprocating traveling of body 20 (Step S101). At this time, control unit 70 causes body 20 to perform the reciprocating traveling ranging from the reference point set in Step S100 to the outline of the object region. Then, control unit 70 causes cleaning to be initiated while causing body 20 to perform the reciprocating traveling.

Specifically, control unit 70 turns body 20 in the case of obstacle detection by obstacle detection sensor 71. Then, control unit 70 causes body 20 to perform the reciprocating traveling over the distance between the reference point and the obstacle-detected point.

Then, control unit 70 determines whether or not the predetermined condition has been satisfied (Step S102). The predetermined condition is, for example, a case where the distance of traveling in one direction of the reciprocating traveling is less than a predetermined value. In a case where the traveling distance is less than the predetermined value, control unit 70 determines that the predetermined condition has been satisfied. The traveling distance is detected by, for example, the rotation sensor (not illustrated) attached to wheel 33.

The processing proceeds to Step S104 in a case where it is determined that the predetermined condition has been satisfied (YES in Step S102).

The processing proceeds to Step S103 in a case where it is determined that the predetermined condition has not been satisfied (NO in Step S102). The case of the satisfaction of the predetermined condition implies that the resistance causing body 20 to travel in the object region varies with the direction of traveling.

Then, control unit 70 determines whether or not the cleaning in the object region has terminated (Step S103). In a case where it is determined that the cleaning in the object region has not terminated (NO in Step S103), the processing returns to Step S102 and a similar processing is executed.

The processing proceeds to Step S105 in a case where it is determined that the cleaning in the object region has terminated (YES in Step S103).

In the case of the satisfaction of the predetermined condition, control unit 70 adds the distance of traveling in the other direction of the reciprocating traveling of body 20 (Step S104). In this manner, the difference between the distance by which body 20 is moved in one direction and the distance by which body 20 is moved in the other direction during the reciprocating traveling can be reduced. Accordingly, the reference point can be corrected in the case of a deviation of the reference point in the object region.

Then, control unit 70 stops the cleaning in the object region (Step S105). In this manner, control unit 70 terminates the reciprocating cleaning control of autonomous travel-type cleaner 10. The reciprocating cleaning control may be repeatedly executed until the cleaning in the object region is completed.

With the control operation of autonomous travel-type cleaner 10 according to Embodiment 12, the following effect is achieved in addition to the effects of (1) to (11) achieved by autonomous travel-type cleaner 10 according to Embodiment 3.

(23) In a case where the resistance that is applied to body 20 varies with the traveling direction during carpet cleaning or the like, autonomous travel-type cleaner 10 according to this embodiment can correct the positional deviation attributable to the difference in traveling resistance by using the reciprocating cleaning control. Therefore, the object region can be more accurately cleaned than in a configuration in which the positional deviation is not corrected.

Modification Example

Each of the embodiments described above is the description of an example of the form that can be taken by the autonomous travel-type cleaner. The present invention is not limited to the embodiments described above.

In other words, the autonomous travel-type cleaner according to the embodiments can take, for example, the forms of the following modification examples as well as those of the embodiments described above.

Figure 36:
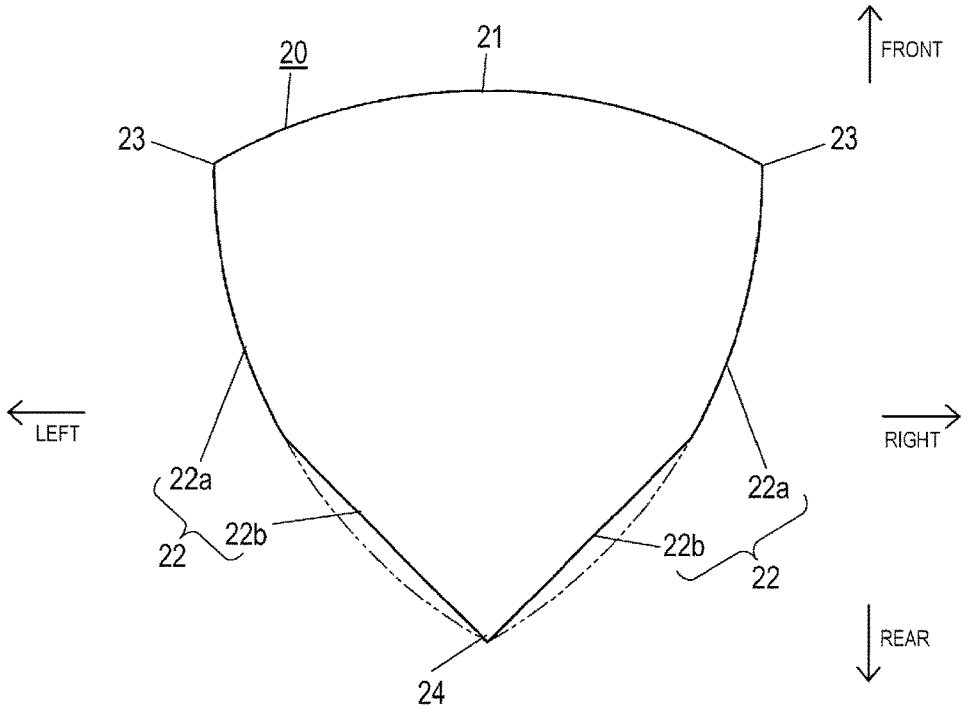
FIG. 36 is a front view of an autonomous travel-type cleaner according to a modification example.
Figure 37:
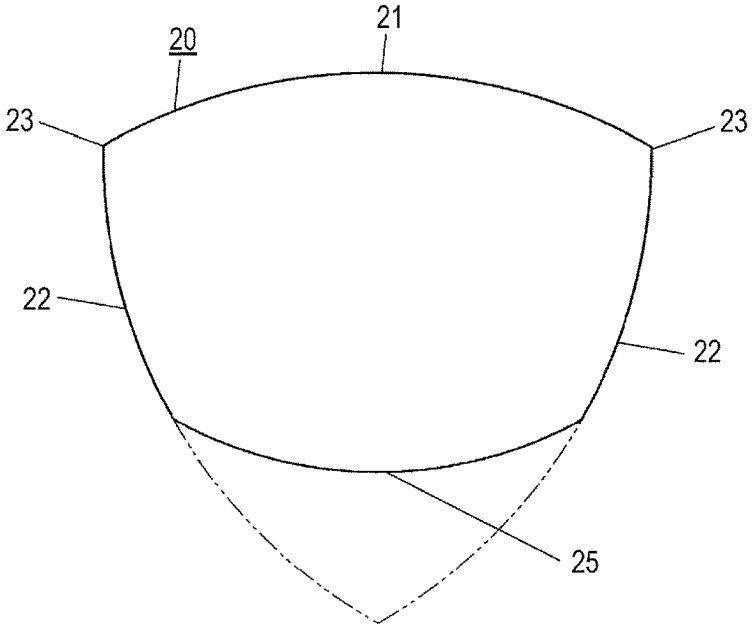
FIG. 37 is a front view of an autonomous travel-type cleaner according to a modification example.
Figure 38:
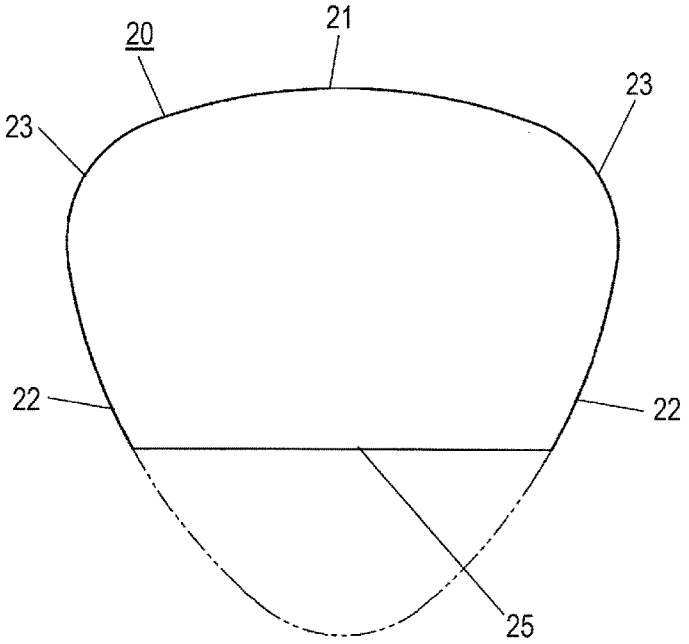
FIG. 38 is a front view of an autonomous travel-type cleaner according to a modification example.

For example, bodies 20 according to the modification examples may have outlines that differ from the outline of body 20 shown in each embodiment as illustrated in FIGS. 36 to 38.

Body 20 according to the modification example that is illustrated in FIG. 36 will be described first.

FIG. 36 shows an example of the modification example that is related to the outline of body 20. The two-dot chain line in this drawing shows the outline of body 20 according to Embodiment 1.

As illustrated in FIG. 36, side surfaces 22*a* on the front side and side surfaces 22*b* on the rear side constitute left and right side surfaces 22 of body 20 according to the modification example, side surfaces 22*a* and side surfaces 22*b* differing from each other in shape. Specifically, side surface 22*a* on the front side is configured as a curved surface and side surface 22*b* on the rear side is configured as a flat surface.

Body 20 according to the modification example illustrated in FIG. 37 will be described below.

FIG. 37 shows another example of the modification example that is related to the outline of body 20. The two-dot chain line in this drawing shows the outline of body 20 according to Embodiment 1.

In body 20 according to the modification example, a part of the rear portion of body 20 including rear top portion 24 is omitted and rear surface 25 is newly formed as illustrated in FIG. 37. A curved surface that is curved to bulge to the outside is an example of rear surface 25. Rear surface 25 may also be a flat surface or the like.

Body 20 according to the modification example illustrated in FIG. 38 will be described below.

FIG. 38 shows another example of the modification example that is related to the outline of body 20. The two-dot chain line in this drawing shows the outline of body 20 according to Embodiment 3.

In body 20 according to the modification example, a predetermined part including rear top portion 24 of body 20 according to Embodiment 3 is omitted and rear surface 25 is newly formed as illustrated in FIG. 38. A flat surface is an example of rear surface 25. Rear surface 25 may also be a curved surface that is curved to bulge to the outside or the like.

Bodies 20 according to these modification examples can achieve effects similar to those achieved with the body according to each Embodiment described above.

According to the corner cleaning control of Embodiments 4 to 6 related to the modification example, control unit 70 may control electric fan 51 such that a suction force of electric fan 51 increases in a case where it is determined that the corner has been detected by the corner detection unit. In addition, control unit 70 may control brush driving motor 41 for an increase in the rotation speed of brush driving motor 41 in the case where it is determined that the corner has been detected by the corner detection unit. In this case, the rotation speeds of main brush 43 and side brush 44 increase.

In this manner, at least one of the control for increasing the suction force of electric fan 51 and the control for increasing the rotation speed of brush driving motor 41 is executed in the case of corner detection. As a result, the rubbish accumulated at the corner and unlikely to be picked up can be quickly picked up. In a place other than the corner where the rubbish is unlikely to accumulate, the suction force of electric fan 51 is reduced in comparison to that at the corner. Likewise, the rotation speed of the brush driving motor is reduced in comparison to that at the corner. Then, electric power consumption by the autonomous travel-type cleaner can be suppressed.

Although a configuration in which the amount of the rubbish is detected by rubbish detection sensor 300 when body 20 completes one reciprocating motion or a plurality of the reciprocating motions has been described as an example with regard to the corner cleaning control according to Embodiments 4 to 6, the present invention is not limited thereto. For example, a modification example related to the corner cleaning control may be a configuration in which the amount of the rubbish at the corner is determined with the amount of the rubbish detected by rubbish detection sensor 300 until body 20 approaches a wall on one side to the maximum extent possible after body 20 is put into a state where body 20 is stopped. In addition, another modification example related to the corner cleaning control may be a configuration in which the amount of the rubbish at the corner is determined with the amount of the rubbish detected by rubbish detection sensor 300 until body 20 approaches one wall to the maximum extent possible and then approaches the other wall after body 20 is put into a state where body 20 is stopped. Yet another modification example related to the corner cleaning control may be a configuration in which the amount of the rubbish at the corner is determined with the amount of the rubbish detected by rubbish detection sensor 300 when body 20 is swung from one wall to the other wall. In this manner, effects similar to those of the respective embodiments described above are achieved.

The second escape control according to Embodiment 9 that is related to the modification example may be determined based on whether or not an alternative predetermined condition has been satisfied in place of the predetermined condition pertaining to Step S63. This alternative predetermined condition is, for example, whether or not body 20 and the object collide with each other that is detected by collision detection sensor 73. In the case of no detection of the collision between body 20 and the object by collision detection sensor 73, control unit 70 determines that the alternative predetermined condition has been satisfied and performs a control.

In this modification example, collision detection sensor 73 detects the presence or absence of a collision between body 20 and objects in a case where, for example, body 20 is stuck between the objects. In the case of a no-collision detection result, control unit 70 repeats the first traveling and the second traveling. Then, body 20 can escape from the space between the objects which body 20 is stuck. As a result, body 20 can escape more quickly than in a case where body 20 escapes by repeating contacts with the objects.

In addition, autonomous travel-type cleaner 10 according to Embodiment 9 that is related to the modification example may also have a configuration in which the rotation sensor is attached to caster 90 instead of wheel 33 or the rotation sensor is attached to each of caster 90 and wheel 33.

Furthermore, the gyro sensor may be omitted in autonomous travel-type cleaner 10 according to Embodiment 9 that is related to the modification example. In this case, the traveling direction of body 20 is calculated from the ratio between the rotation speeds that are detected by the rotation sensors attached to right wheel 33 and left wheel 33. In this manner, a simplified configuration is obtained along with a reduction in cost.

Side brushes 44 according to the modification example may have a configuration in which the rotation occurs toward the front from the rear of body 20 at the part of the orbit of rotation of each side brush 44 that approaches the orbit of rotation of the other side brush 44.

According to this configuration, side brush 44 causes the rubbish to move forward on the width-direction center side of body 20. Therefore, the rubbish collected by side brush 44 is likely to approach suction port 101 during a forward movement of autonomous travel-type cleaner 10. Accordingly, insufficient rubbish suctioning is unlikely to occur on the rear side of suction port 101.

In addition, autonomous travel-type cleaner 10 according to the modification example may be configured to be provided with a brush driving motor giving torque to main brush 43 and one of side brushes 44 and a brush driving motor giving torque to the other side brush 44. This can result in reduction in size, weight, and cost.

In addition, autonomous travel-type cleaner 10 according to the modification example may be configured for each of main brush 43, side brush 44 on the right side, and side brush 44 on the left side to be provided with a brush driving motor. Then, the respective brush driving motors can give torque individually to the responding brushes. As a result, effective cleaning can be performed by an appropriate driving force being provided in accordance with a situation of the surface to be cleaned and a situation of the rubbish.

In a case where light receiving unit 212 of autonomous travel-type cleaner 10 according to the modification example receives the light signal output from the charging stand, control unit 70 may cause the distance between body 20 and the obstacle at the time of obstacle detection by obstacle detection sensor 71 to exceed the distance at the time of no light signal reception by light receiving unit 212.

This allows the charging stand as an obstacle to become more likely to be detected by obstacle detection sensor 71 in a case where the distance between body 20 and the charging stand is short. Therefore, contact between body 20 and the charging stand can become less likely to occur during the cleaning.

In autonomous travel-type cleaner 10 according to the modification example, control unit 70 may change the distance between body 20 and the object at a time when the obstacle is detected by obstacle detection sensor 71 based on at least one of the driving time of obstacle detection sensor 71 as an ultrasonic sensor and the magnitude of an ultrasonic signal of obstacle detection sensor 71 that reaches receiving unit 71B from transmitting unit 71A without passing through the obstacle.

According to this modification example, the distance between body 20 and the obstacle at the time of obstacle detection by obstacle detection sensor 71 is changed. Accordingly, the obstacle becomes more likely to be detected in, for example, the first half of the driving time of obstacle detection sensor 71 than in the latter half of the driving time of obstacle detection sensor 71. Likewise, the obstacle becomes more likely to be detected in a case where the ultrasonic signal reaching receiving unit 71B is strong than in a case where the ultrasonic signal reaching receiving unit 71B is weak.

The distance between body 20 and the obstacle at the time of obstacle detection by obstacle detection sensor 71 is changed as described above. Accordingly, the accuracy of obstacle detection sensor 71 can be improved.

In addition, control unit 70 of autonomous travel-type cleaner 10 according to the modification example may be configured to determine that the amount of the rubbish present in rubbish bin unit 60 is equal to or greater than a predetermined amount in a case where rubbish detection sensor 300 detects at least a predetermined amount of the rubbish in line with the driving of electric fan 51. In this case, notification based on light, sound, or the like is preferable.

According to this modification example, it is implied that rubbish bin unit 60 is full of the accumulated rubbish in the case where rubbish detection sensor 300 detects at least a predetermined amount of the rubbish. Accordingly, rubbish bin unit 60 being full of the accumulated rubbish can be easily confirmed with a simple configuration.

In addition, autonomous travel-type cleaner 10 according to the modification example may be provided with a non-ultrasonic sensor as obstacle detection sensor 71. Examples of the non-ultrasonic sensor include an infrared sensor.

Furthermore, autonomous travel-type cleaner 10 according to the modification example may be provided with a non-infrared sensor as distance measurement sensor 72. Examples of the non-infrared sensor include an ultrasonic sensor.

Moreover, autonomous travel-type cleaner 10 according to the modification example may be provided with a sensor that is not a contact-type displacement sensor as collision detection sensor 73, examples of which include an impact sensor.

Moreover, autonomous travel-type cleaner 10 according to the modification example may be provided with a non-infrared sensor as floor surface detection sensor 74. Examples of the non-infrared sensor include an ultrasonic sensor. With these modification examples, effects similar to those of the respective embodiments described above are achieved.

Autonomous travel-type cleaner 10 according to the modification example may also be configured to be provided with a plurality of casters 90 on the rear side of body 20 with respect to driving unit 30. Then, the stability of autonomous travel-type cleaner 10 is further improved.

Autonomous travel-type cleaner 10 according to the modification example may also be configured to be provided with at least one caster on the front side of body 20 with respect to the pair of driving units 30. Then, the stability of autonomous travel-type cleaner 10 is further improved.

The detailed description above is intended to be illustrative and not to be restrictive. For example, each of the embodiments described above or the one or more modification examples described above may be combined with each other if necessary.

The technical features or subjects disclosed in the embodiments can also be present as features smaller in number than all the features of a certain embodiment. Therefore, it is a matter of course that the scope of claims is incorporated into the detailed description of the present invention and each claim can claim itself as an individual embodiment.

In addition, it is a matter of course that a range disclosed in the embodiment is established based on both the range of rights given to the scope of claims and the entire range of the equivalents.

As described above, the autonomous travel-type cleaner according to the present invention is provided with the body provided with the suction port in the bottom surface, the suction unit mounted on the body, the corner detection unit detecting the corner in the object region, the driving unit driving the body to perform the reciprocating motion, and the control unit controlling the driving unit. The control unit may control the driving unit for the reciprocating motion of the body once the corner is detected by the corner detection unit.

According to this configuration, the autonomous travel-type cleaner performs the reciprocating motion upon reaching the corner. Accordingly, a large amount of the rubbish accumulating at the corner can be picked up in an efficient manner.

In the autonomous travel-type cleaner according to the present invention, the reciprocating motion may be an operation for swinging the body to the left and right.

According to this configuration, the autonomous travel-type cleaner causes the body to swing to the left and right upon reaching the corner. Accordingly, a large amount of the rubbish accumulating at the corner can be picked up.

The autonomous travel-type cleaner according to the present invention is provided with the right wheel-driving right traveling motor and the left wheel-driving left traveling motor in the driving unit. The control unit controls the body, such that the body is swung to the left and right, by repeatedly performing a controlling operation for a forward movement of the right wheel and retraction of the left wheel followed by a forward movement of the left wheel and retraction of the right wheel.

According to this configuration, the two, right and left, wheels are separately controlled once the autonomous travel-type cleaner reaches the corner. Accordingly, the body can be swung to the left and right. As a result, a large amount of the rubbish accumulating at the corner can be picked up.

In the autonomous travel-type cleaner according to the present invention, the body may be provided with the front surface and the plurality of side surfaces that are curved surfaces bulging to the outside and the front top portions that are the top portions defined by the front surface and the side surfaces and the angle formed by the tangent of the front surface and the tangent of the side surface may be an acute angle.

According to this configuration, the body is substantially identical in planar shape to a Reuleaux triangle and performs the reciprocating motion in the shape of the Reuleaux triangle. Accordingly, even the rubbish accumulating at the corner can be removed.

In the autonomous travel-type cleaner according to the present invention, the suction unit may be provided with the air-suctioning electric fan and the control unit may perform a control for increasing the suction force of the electric fan once the corner is detected by the corner detection unit.

According to this configuration, the autonomous travel-type cleaner increases the suction force of the electric fan upon reaching the corner. Accordingly, a large amount of the rubbish accumulating at the corner can be picked up in an effective manner. In a place other than the corner where the rubbish is unlikely to accumulate, the suction force of the electric fan is reduced in comparison to that at the corner. In this manner, electric power consumption by the autonomous travel-type cleaner can be suppressed.

The autonomous travel-type cleaner according to the present invention is also provided with the side brush that is placed on the bottom surface side of the body and the brush driving motor that drives the side brush. The control unit may perform a control for increasing the rotation speed of the brush driving motor once the corner is detected by the corner detection unit.

According to this configuration, the autonomous travel-type cleaner increases the rotation speed of the side brush upon reaching the corner. Accordingly, a large amount of the rubbish accumulating at the corner can be picked up in an efficient manner. In the place other than the corner where the rubbish is unlikely to accumulate, the rotation speed of the brush driving motor is reduced in comparison to that at the corner. In this manner, the electric power consumption by the autonomous travel-type cleaner can be suppressed.

The autonomous travel-type cleaner according to the present invention is also provided with the main brush that is placed at the suction port and the brush driving motor that drives the main brush. The control unit may perform a control for increasing the rotation speed of the brush driving motor once the corner is detected by the corner detection unit.

According to this configuration, the autonomous travel-type cleaner increases the rotation speed of the main brush upon reaching the corner. Accordingly, a large amount of the rubbish accumulating at the corner can be picked up in an efficient manner. In the place other than the corner where the rubbish is unlikely to accumulate, the rotation speed of the brush driving motor is reduced in comparison to that at the corner. In this manner, the electric power consumption by the autonomous travel-type cleaner can be suppressed.

(Notes Regarding Means for Solving Problems)

Note (A1)

An autonomous travel-type cleaner including a body, a pair of wheels, a suction port, and an electric fan, the autonomous travel-type cleaner further including an obstacle detection sensor detecting the presence or absence of an obstacle in the direction that is orthogonal to the axis of rotation of the wheel, a distance measurement sensor detecting the distance between an object in the direction that is parallel to the axis of rotation of the wheel and the body, and a control unit and the control unit causing one of the wheels and the other wheel to rotate in opposite directions in a case where a state where a value detected by the distance measurement sensor is equal to or less than a predetermined value continues for at least a predetermined period of time and the obstacle is detected by the obstacle detection sensor.

This autonomous travel-type cleaner detects the corner before contact between the body and the obstacle by using the obstacle detection sensor and the distance measurement sensor. Therefore, the body and the obstacle are unlikely to come into contact with each other in a case where the corner is cleaned by the body being turned.

Note (A2)

An autonomous travel-type cleaner including a body, a pair of wheels, a suction port, and an electric fan, the autonomous travel-type cleaner further including an obstacle detection sensor detecting the presence or absence of an obstacle in the direction that is orthogonal to the axis of rotation of the wheel, a distance measurement sensor detecting the distance between an object in the direction that is parallel to the axis of rotation of the wheel and the body, and a control unit and the control unit causing the pair of wheels to rotate in the same direction in a case where a state where a value detected by the distance measurement sensor is equal to or less than a predetermined value continues for at least a predetermined period of time and obstacle detection by the obstacle detection sensor has become impossible after obstacle detection by the obstacle detection sensor.

In a case where, for example, the obstacle has been removed after the detection of the obstacle by the obstacle detection sensor of this autonomous travel-type cleaner, the body is moved forward or retracted without detouring around a region where the obstacle was placed. Therefore, the region where the obstacle was placed can also be cleaned.

Note (A3)

An autonomous travel-type cleaner including a body, a pair of wheels, a suction port, and an electric fan, the autonomous travel-type cleaner further including an obstacle detection sensor detecting the presence or absence of an obstacle in the direction that is orthogonal to the axis of rotation of the wheel, a distance measurement sensor detecting the distance between an object in the direction that is parallel to the axis of rotation of the wheel and the body, a collision detection sensor detecting a collision of the body with the surrounding object, and a control unit, the control unit causing one of the wheels and the other wheel to rotate in opposite directions in a case where a state where a value detected by the distance measurement sensor is equal to or less than a predetermined value continues for at least a predetermined period of time and the obstacle is detected by the obstacle detection sensor, and the operation of the wheels continuing, despite the detection of the collision between the body and the object by the collision detection sensor, during the opposite-direction rotation of the wheel and the other wheel.

According to this autonomous travel-type cleaner, the body continues to turn despite a collision between the body and the object in the case of turning of the body. Therefore, the corner can be sufficiently cleaned compared to a case where the cleaning is stopped once the body and the object come into contact with each other.

Note (A4)

An autonomous travel-type cleaner including a body, a pair of wheels, a suction port, and an electric fan, the autonomous travel-type cleaner further including an obstacle detection sensor detecting the presence or absence of an obstacle in the direction that is orthogonal to the axis of rotation of the wheel, a distance measurement sensor detecting the distance between an object in the direction that is parallel to the axis of rotation of the wheel and the body, a collision detection sensor detecting a collision of the body with the surrounding object, and a control unit, the control unit executing a repetitive motion, the repetitive motion being to cause one of the wheels and the other wheel to rotate in opposite directions in a case where a state where a value detected by the distance measurement sensor is equal to or less than a predetermined value continues for at least a predetermined period of time and the obstacle is detected by the obstacle detection sensor and then stop the wheel on the side which is close to the part of contact between the body and the object and retract the other wheel in a case where the collision between the body and the object is detected by the collision detection sensor, stop the other wheel and move forward one wheel in the case of a further collision of the body with another part of the object or another object resulting from the retraction of the other wheel, and stop one wheel and retract the other wheel in the case of a further collision of the body with another part of the object or another object resulting from the forward movement of one wheel, and the pair of wheels being moved forward in the case of no obstacle detection by the obstacle detection sensor.

According to this autonomous travel-type cleaner, the above-described control is executed in a case where the body is stuck at the corner during corner cleaning. In this case, the angle of the body with respect to the corner gradually changes. Therefore, the body can escape from the corner by changing its direction even if the body is stuck at the corner.

Note (B1)

An autonomous travel-type cleaner including a body, a pair of wheels, a suction port, and an electric fan, the autonomous travel-type cleaner further including an obstacle detection sensor detecting the presence or absence of an obstacle in the direction that is orthogonal to the axis of rotation of the wheel, a distance measurement sensor detecting the distance between an object in the direction that is parallel to the axis of rotation of the wheel and the body, and a control unit, the control unit calculating a movement range of the body at a predetermined time, and the control unit causing the pair of wheels to rotate in a direction in which a value detected by the distance measurement sensor is equal to or less than a predetermined value and no obstacle is detected by the obstacle detection sensor in a case where the movement range at the predetermined time is less than a predetermined value.

According to this autonomous travel-type cleaner, the body being stuck at the corner or the like can be detected from the movement range of the body at a predetermined time. Therefore, the body is allowed to travel in a direction that allows the body to escape from the corner by the obstacle detection sensor and the distance measurement sensor in a case where, for example, the body is stuck at the corner. Accordingly, the body and the object are unlikely to come into contact with each other during the escape.

Note (B2)

An autonomous travel-type cleaner including a body, a pair of wheels, a suction port, and an electric fan, the autonomous travel-type cleaner further including an obstacle detection sensor detecting the presence or absence of an obstacle in the direction that is orthogonal to the axis of rotation of the wheel, a distance measurement sensor detecting the distance between an object in the direction that is parallel to the axis of rotation of the wheel and the body, a collision detection sensor detecting a collision of the body with the surrounding object, and a control unit, the control unit calculating a movement range of the body at a predetermined time, and the control unit causing the pair of wheels to rotate in a direction in which the body and the object are detected not to collide with each other, based on a detection result of the collision detection sensor, in a case where the movement range at the predetermined time is less than a predetermined value.

According to this autonomous travel-type cleaner, the body can perform escaping by the use of the body-object collision detection result of the collision detection sensor, turning of the body, and repeated wheel operations in a case where, for example, the body is stuck between objects. Therefore, the body can perform the escaping more quickly than in a case where the body performs the escaping by repeating contacts with the objects.

Note (C1)

An autonomous travel-type cleaner including a body, a pair of wheels, a caster, a suction port, and an electric fan, the autonomous travel-type cleaner further including a first rotation sensor detecting the rotation speed of the wheel and a second rotation sensor detecting the rotation speed of the caster, and the control unit changing the direction in which the body travels, in a case where it is determined from detection results of the first rotation sensor and the second rotation sensor that the wheel rotation speed and the caster rotation speed do not correspond to each other, such that the traveling direction of the body is inclined with respect to the traveling direction of the body at that time.

In the case of wheel slipping or caster slipping detection at a step or the like by the first rotation sensor and the second rotation sensor of this autonomous travel-type cleaner, the body is caused to move in obliquely with respect to the step. Therefore, the step is more likely to be ridden over than in a case where the body is moved straight to the step.

Note (C2)

An autonomous travel-type cleaner including a body, a pair of wheels, a caster, a suction port, and an electric fan, the autonomous travel-type cleaner further including a first rotation sensor detecting the rotation speed of the wheel and a second rotation sensor detecting the rotation speed of the caster, the control unit changing the direction in which the body travels, in a case where it is determined from detection results of the first rotation sensor and the second rotation sensor that the wheel rotation speed and the caster rotation speed do not correspond to each other, such that the traveling direction of the body is inclined with respect to the traveling direction of the body at that time, and the control unit changing the traveling direction of the body to the direction opposite to the traveling direction of the body in a case where the wheel rotation speed and the caster rotation speed still do not correspond to each other thereafter.

According to this autonomous travel-type cleaner, a step is avoided based on traveling in the opposite direction to the step in a case where, for example, a state of slipping continues despite an oblique movement of the body with respect to the step. Therefore, the body becomes unlikely to be stuck at the step.

Note (D1)

An autonomous travel-type cleaner including a body, a pair of wheels, a suction port, and an electric fan, the autonomous travel-type cleaner further including an obstacle detection sensor detecting the presence or absence of an obstacle in the direction that is orthogonal to the axis of rotation of the wheel, a light receiving unit receiving a light signal output from a charging stand charging the autonomous travel-type cleaner, and a control unit and the control unit causing the distance between the body and the obstacle at the time of obstacle detection by the obstacle detection sensor to exceed the distance at the time of no light signal reception by the light receiving unit in a case where the light receiving unit receives the light signal output from the charging stand.

According to this autonomous travel-type cleaner, the charging stand as an obstacle becomes more likely to be detected by the obstacle detection sensor in a case where the body and the charging stand are close to each other. Therefore, contact between the body and the charging stand can become less likely to occur during the cleaning.

Note (E1)

An autonomous travel-type cleaner including a body, a pair of wheels, a suction port, and an electric fan, the autonomous travel-type cleaner further including a light receiving unit receiving a light signal output from a remote controller operating the autonomous travel-type cleaner and a control unit, the control unit storing a distance and an angle with respect to a reference position for each of one or more target points on a path of movement of the body based on the signal output from the remote controller, and the control unit causing the body to move along the target point by the light receiving unit receiving light information related to a movement order from the remote controller.

This autonomous travel-type cleaner stores the target point to be cleaned in advance. Accordingly, any region of an object region can be cleaned. Therefore, efficient cleaning can be executed by the autonomous travel-type cleaner.

Note (E2)

An autonomous travel-type cleaner including a body, a pair of wheels, a suction port, and an electric fan, the autonomous travel-type cleaner further including a light receiving unit receiving a light signal output from a remote controller operating the autonomous travel-type cleaner and a light signal output from a charging stand charging the autonomous travel-type cleaner and a control unit, the control unit storing a distance and an angle with respect to a reference position for each of one or more target points on a path of movement of the body based on the signal output from the remote controller, the body performing reverse traveling on the movement path back to the target point after the body reaches a final target point by the control unit moving the body along the one or more target points, and the control unit causing the body to deviate from the movement path and move toward the charging stand by the light receiving unit receiving the light signal output from the charging stand.

According to this autonomous travel-type cleaner, the reverse traveling on the movement path is performed until the light signal output from the charging stand is received in the case of returning to the charging stand following arrival at the final target point. Therefore, the returning toward the charging stand can be performed on an appropriate path.

Note (E3)

An autonomous travel-type cleaner including a body, a pair of wheels, a suction port, and an electric fan, the autonomous travel-type cleaner further including an obstacle detection sensor detecting the presence or absence of an obstacle in the direction that is orthogonal to the axis of rotation of the wheel, a light receiving unit receiving a light signal output from a remote controller operating the autonomous travel-type cleaner, and a control unit, the control unit storing a distance and an angle with respect to a reference position for each of one or more target points on a path of movement of the body based on the signal output from the remote controller, the control unit causing the body to move along the target point by the light receiving unit receiving light information related to a movement order from the remote controller, and the control unit moving the body toward the next target point in a case where one of the target points is superposed on the position of the obstacle detected by the obstacle detection sensor.

In a case where the obstacle is present on one target point, this autonomous travel-type cleaner moves toward the next target point without passing through that target point. Therefore, any region of the object region is more likely to be cleaned than in a configuration in which the cleaning is terminated in a case where it is impossible to pass through one target point.

Note (E4)

An autonomous travel-type cleaner including a body, a pair of wheels, a suction port, and an electric fan, the autonomous travel-type cleaner further including a light receiving unit receiving a light signal output from a remote controller operating the autonomous travel-type cleaner and a control unit, the control unit storing a distance and an angle with respect to a reference position for each of one or more target points on a path of movement of the body based on the signal output from the remote controller, the control unit causing the body to move along the target point by the light receiving unit receiving light information related to a movement order from the remote controller, and the control unit driving the electric fan at an actually-reached point in a case where an obstacle is present at a final target point.

In a case where it has been impossible to reach the final target point due to the obstacle or the like, this autonomous travel-type cleaner performs cleaning at the point that has been actually reached. Therefore, a wider region can be cleaned than in a case where the cleaning is terminated in a case where the final target point cannot be reached.

Note (E5)

An autonomous travel-type cleaner including a body, a pair of wheels, a suction port, and an electric fan, the autonomous travel-type cleaner further including an obstacle detection sensor detecting the presence or absence of an obstacle in the direction that is orthogonal to the axis of rotation of the wheel and a control unit, the control unit detecting a traveling distance with a rotation sensor attached to the wheel and causing the body to perform reciprocating traveling to the outline of an object region from a reference point or a reference line set in the object region in the case of the traveling of the body for cleaning the object region determined in advance, the control unit turning the body and causing the body to travel over the distance between the reference point or the reference line and an obstacle-detected point in the case of obstacle detection by the obstacle detection sensor during the reciprocating traveling, and the control unit causing the body to travel with a predetermined distance added in a case where the traveling distance is less than a predetermined value.

According to this autonomous travel-type cleaner, a positional deviation that is attributable to a difference in traveling resistance is corrected even in a case where, for example, the cleaning is performed on a carpet or the like where the resistance during the traveling of the body varies with the traveling direction. Accordingly, the object region is more likely to be cleaned than in a configuration in which the positional deviation is not corrected in the case of the cleaning on the carpet or the like.

Note (F1)

An autonomous travel-type cleaner including a body, a pair of wheels, a suction port, and an electric fan, the autonomous travel-type cleaner further including a rubbish bin unit accumulating rubbish suctioned from the suction port, a duct connecting the suction port and the rubbish bin unit to each other, and a rubbish detection sensor placed in a passage of the duct and detecting the rubbish suctioned from the suction port, the control unit determining that at least a predetermined amount of the rubbish is present in the rubbish bin unit in a case where the amount of the rubbish detected by the rubbish detection sensor in line with driving of the electric fan is equal to or greater than a predetermined amount.

According to this autonomous travel-type cleaner, a case where the amount of the rubbish detected by the rubbish detection sensor is equal to or greater than the predetermined amount implies that the rubbish bin unit is full of the accumulated rubbish. Therefore, the rubbish bin unit being full of the accumulated rubbish can be easily confirmed with a simple configuration.

Note (G1)

An autonomous travel-type cleaner including a body, a pair of wheels, a suction port, and an electric fan, the autonomous travel-type cleaner further including an obstacle-detecting ultrasonic sensor detecting the presence or absence of an obstacle in the direction that is orthogonal to the axis of rotation of the wheel and a control unit, the obstacle detection sensor being provided with a transmitting unit outputting ultrasonic waves and a receiving unit receiving reflected ultrasonic waves, and the control unit changing the distance between the body and the obstacle at the time of obstacle detection by the obstacle detection sensor based on at least one of a driving time, which is a period of time during which the obstacle detection sensor is driven, and the magnitude of the ultrasonic wave that reaches the receiving unit from the transmitting unit without passing through the obstacle.

According to this autonomous travel-type cleaner, the distance between the body and the obstacle at the time of obstacle detection by the obstacle detection sensor is changed such that, for example, the obstacle is more likely to be detected in the first half of the driving time of the obstacle detection sensor than in the latter half of the driving time of the obstacle detection sensor. In addition, the distance between the body and the obstacle at the time of obstacle detection by the obstacle detection sensor is changed such that the obstacle is more likely to be detected in a case where the ultrasonic wave reaching the receiving unit without passing through the obstacle is strong than in a case where the ultrasonic wave reaching the receiving unit without passing through the obstacle is weak. In other words, according to this autonomous travel-type cleaner, the distance between the body and the obstacle at the time of obstacle detection by the obstacle detection sensor is changed as described above. Accordingly, the accuracy of the obstacle detection sensor is likely to be improved.

INDUSTRIAL APPLICABILITY

The present invention can be applied to autonomous travel-type cleaners used in various environments, including autonomous travel-type cleaners for home and office use requiring a high level of corner cleaning ability.

What is claimed is:

1. An autonomous travel-type cleaner comprising:

a body including a suction port open in a bottom surface of the body;

a suction unit mounted on the body and operable to suck air from the suction port;

a corner detection unit configured to detect a corner of household walls;

a driving unit configured to move the body on a household floor;

a dirt sensor configured to detect dirt sucked by the suction unit; and a control unit programmed to perform a corner cleaning operation in which the control unit controls the drive unit to reciprocally move the body in a corner of household walls when the corner detection unit detects that the body is in the corner of the household walls, wherein the control unit is programmed to terminate the corner cleaning operation when the dirt sensor detects that dirt in the corner becomes less than an amount detectable by the dirt sensor.

2. The autonomous travel-type cleaner of claim 1, wherein the control unit is programmed to control the drive unit to swing the body left and right in the corner of the household walls.

3. The autonomous travel-type cleaner of claim 1, wherein the driving unit includes:

right and left wheels;

a right traveling motor operable to drive the right wheel;

a left traveling motor operable to drive the left wheel; and, wherein the control unit is programmed to control the drive unit to swing the body left and right by repeatedly driving the right and left wheels forward and backward alternately in opposite directions.

4. The autonomous travel-type cleaner of claim 1, wherein the body is formed generally in a triangular shape in a plane view and has three rounded corners and three outwardly arcuate side surfaces.

5. The autonomous travel-type cleaner of claim 1, wherein the suction unit includes an air-suctioning electric fan, and wherein the control unit is programmed to increase a suction force of the electric fan during the corner cleaning operation.

6. The autonomous travel-type cleaner of claim 1, further comprising:

a side brush placed on the bottom surface of the body; and a brush driving motor operable to drive the side brush, wherein the control unit is programmed to control the brush driving motor to increase a rotation speed of the side brush during the corner cleaning operation.

7. The autonomous travel-type cleaner of claim 1, further comprising:

a main brush placed at the suction port; and a brush driving motor operable to drive the main brush, wherein the control unit is programmed to control the brush driving motor to increase a rotation speed of the main brush during the corner cleaning operation.

* * * * *